US007838188B2

(12) United States Patent
Mori et al.

(10) Patent No.: US 7,838,188 B2
(45) Date of Patent: Nov. 23, 2010

(54) ELECTROPHOTOGRAPHIC PHOTOCONDUCTOR, IMAGE FORMING METHOD, IMAGE FORMING APPARATUS, AND PROCESS CARTRIDGE

(75) Inventors: Nobuya Mori, Sunto-gun (JP); Kazukiyo Nagai, Numazu (JP); Tomoyuki Shimada, Sunto-gun (JP); Tetsuro Suzuki, Fuji (JP); Tetsuya Toshine, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 837 days.

(21) Appl. No.: 11/692,682

(22) Filed: Mar. 28, 2007

(65) Prior Publication Data

US 2007/0231720 A1 Oct. 4, 2007

(30) Foreign Application Priority Data

Mar. 29, 2006 (JP) ..... 2006-092443

(51) Int. Cl.
*G03G 5/047* (2006.01)

(52) U.S. Cl. ..... 430/58.7; 430/74; 430/58.65; 399/159

(58) Field of Classification Search ..... 430/58.7, 430/58.65, 74; 399/159
See application file for complete search history.

(56) References Cited

U.S. PATENT DOCUMENTS 5,168,025 A * 12/1992 Ono et al. ..... 430/58.15
5,314,775 A * 5/1994 Ueda ..... 430/58.3
5,322,753 A * 6/1994 Tamura et al. ..... 430/58.7
5,330,866 A * 7/1994 Ueda ..... 430/58.35
5,338,634 A * 8/1994 Ueda ..... 430/58.75
5,427,880 A * 6/1995 Tamura et al. ..... 430/58.7
5,550,293 A * 8/1996 Shimada et al. ..... 564/426
5,871,876 A 2/1999 Ikuno et al.
5,976,746 A 11/1999 Tanaka et al.
6,027,846 A 2/2000 Shimada et al.
6,030,733 A 2/2000 Kami et al.

(Continued)

FOREIGN PATENT DOCUMENTS

JP 60-196768 10/1985

(Continued)

OTHER PUBLICATIONS

U.S. Appl. No. 12/000,239, filed Dec. 11, 2007, Fujiwara, et al.

(Continued)

*Primary Examiner*—Christopher RoDee
(74) *Attorney, Agent, or Firm*—Oblon, Spivak, McClelland, Maier & Neustadt, L.L.P.

(57) ABSTRACT

A preferred aspect of an electrophotographic photoconductor of the present invention contains a layer containing a hardened material which is prepared by polymerizing (A) a chain-polymerizable group-containing tertiary amine compound in which at least one alkyl group is bound to a nitrogen atom constituting an amine structure through chain polymerization. Another preferred aspect of the electrophotographic photoconductor contains a layer containing a hardened material which is prepared by polymerizing the (A) component, and (B) a chain-polymerizable charge transporting compound through chain polymerization. Still another preferred aspect of the electrophotographic photoconductor contains a layer containing a hardened material which is prepared by polymerizing the (A) component, (B) the chain-polymerizable charge transporting compound, and (C) a trifunctional or more chain-polymerizable compound through chain polymerization.

14 Claims, 7 Drawing Sheets

U.S. PATENT DOCUMENTS

| | | | | |
|---|---|---|---|---|
| 6,066,428 | A | 5/2000 | Katayama et al. | |
| 6,151,468 | A | 11/2000 | Kami et al. | |
| 6,172,176 | B1 | 1/2001 | Tanaka et al. | |
| 6,187,492 | B1 | 2/2001 | Ri et al. | |
| 6,194,535 | B1 | 2/2001 | Katayama et al. | |
| 6,210,848 | B1 | 4/2001 | Nagai et al. | |
| 6,316,577 | B1 | 11/2001 | Shimada et al. | |
| 6,486,293 | B1 | 11/2002 | Ri et al. | |
| 6,548,216 | B2 | 4/2003 | Kawamura et al. | |
| 6,790,571 | B2 | 9/2004 | Kawamura et al. | |
| 6,861,188 | B2 | 3/2005 | Ikegami et al. | |
| 6,899,983 | B2 | 5/2005 | Tamoto et al. | |
| 6,936,388 | B2 | 8/2005 | Suzuki et al. | |
| 6,974,654 | B2 | 12/2005 | Kawamura et al. | |
| 7,018,755 | B2 | 3/2006 | Ikegami et al. | |
| 7,056,633 | B2 | 6/2006 | Kawamura et al. | |
| 7,071,285 | B2 | 7/2006 | Kawamura et al. | |
| 7,112,392 | B2 | 9/2006 | Shimada et al. | |
| 7,122,284 | B2 | 10/2006 | Kawamura et al. | |
| 7,160,658 | B2 | 1/2007 | Suzuki et al. | |
| 7,175,957 | B2 | 2/2007 | Suzuki et al. | |
| 7,179,573 | B2 | 2/2007 | Suzuki et al. | |
| 7,364,824 | B2 * | 4/2008 | Kikuchi et al. | 430/58.7 |
| 7,416,823 | B2 * | 8/2008 | Yanagawa et al. | 430/58.7 |
| 2004/0053152 | A1 | 3/2004 | Nagai et al. | |
| 2004/0180280 | A1 | 9/2004 | Ikegami et al. | |
| 2004/0248024 | A1 * | 12/2004 | Suzuki et al. | 430/66 |
| 2004/0253527 | A1 * | 12/2004 | Suzuki et al. | 430/66 |
| 2005/0008957 | A1 | 1/2005 | Ikegami et al. | |
| 2005/0118518 | A1 * | 6/2005 | Ikegami et al. | 430/58.75 |
| 2005/0158641 | A1 | 7/2005 | Yanagawa et al. | |
| 2005/0175911 | A1 | 8/2005 | Tamoto et al. | |
| 2005/0196193 | A1 | 9/2005 | Tamoto et al. | |
| 2005/0221210 | A1 | 10/2005 | Suzuki et al. | |
| 2005/0238987 | A1 | 10/2005 | Ohshima et al. | |
| 2005/0260511 | A1 * | 11/2005 | Kunieda et al. | 430/58.8 |
| 2005/0266325 | A1 | 12/2005 | Yanagawa et al. | |
| 2005/0266328 | A1 | 12/2005 | Yanagawa et al. | |
| 2005/0282075 | A1 | 12/2005 | Ikuno et al. | |
| 2005/0287452 | A1 | 12/2005 | Tamura et al. | |
| 2005/0287465 | A1 | 12/2005 | Ohshima et al. | |
| 2006/0014093 | A1 | 1/2006 | Li et al. | |
| 2006/0014096 | A1 | 1/2006 | Ohshima et al. | |
| 2006/0051689 | A1 | 3/2006 | Suzuki et al. | |
| 2006/0068308 | A1 | 3/2006 | Ohshima et al. | |
| 2006/0093055 | A1 | 5/2006 | Goldberg | |
| 2006/0093955 | A1 | 5/2006 | Ohshima et al. | |
| 2006/0110668 | A1 | 5/2006 | Kawasaki et al. | |
| 2006/0160003 | A1 | 7/2006 | Nagai et al. | |
| 2006/0177749 | A1 | 8/2006 | Tamoto et al. | |
| 2007/0122724 | A1 * | 5/2007 | Suzuki et al. | 430/58.7 |

FOREIGN PATENT DOCUMENTS

| | | |
|---|---|---|
| JP | 5-66598 | 3/1993 |
| JP | 2884353 | 2/1999 |
| JP | 2000-231204 | 8/2000 |
| JP | 2004-102080 | 4/2004 |

OTHER PUBLICATIONS

U.S. Appl. No. 12/035,016, filed Feb. 21, 2008, Iwamoto et al.
U.S. Appl. No. 12/047,011, filed Mar. 12, 2008, Kami et al.

* cited by examiner

ELECTROPHOTOGRAPHIC PHOTOCONDUCTOR, IMAGE FORMING METHOD, IMAGE FORMING APPARATUS, AND PROCESS CARTRIDGE

BACKGROUND OF THE INVENTION

1. Field of the Invention

The present invention relates to an electrophotographic photoconductor (may be hereinafter referred to as "photoconductor", "image bearing member", or "latent electrostatic image bearing member") which has very high abrasion resistance even when repeatedly used and is capable of forming high-quality images involving less image defects over a long period of time, an image forming method using the electrophotographic photoconductor, an image forming apparatus using the electrophotographic photoconductor, and a process cartridge using the electrophotographic photoconductor.

2. Description of the Related Art

Recently, there is remarkable progress in development of information processing system machines using an electrophotographic process. In particular, laser printers and digital copiers each configured to convert information to digital signals with use of a laser beam to thereby record the information have been remarkably improved in print-quality and reliability. An integration of the technology and speeding-up in recording has been used in applications of laser printers and digital copiers that allow for full-color image formation. With background like this, as functions required for photoconductors, it is important to achieve both high-quality image and high-resistance.

For electrophotographic photoconductors used for laser printers and digital copiers using an electrophotographic process, typically, organic photoconductors (OPC) using organic photosensitive materials are widely used from the perspective of cost, productivity, and pollution-free properties. Layer configurations of organic photoconductors are classified broadly into a single layer configuration and a functional separation type laminate configuration. A PVK-TNF charge-transfer complex photoconductor that was an organic photoconductor put into practical use for the first time was a single layer photoconductor. In the meanwhile, a photoconductor using a PVK/a-Se laminate was reported by Hayashi and by Regensburger, in 1968, individually. Thereafter, a laminate type photoconductor having at least an organic pigment dispersion layer, an organic low-molecular-weight dispersion polymer layer, and a photosensitive layer composed of an organic material was reported by Melz et al. in 1977 and by Scchlosser in 1978. Each of these laminate-type photoconductors has a charge generating layer (CGL) that absorbs light to generate a charge, and a charge transporting layer (CTL) that introduces and transports the charge generated at the CGL thereto to neutralize the charge residing on the surface of the photoconductor, and is called as a functional separation laminate type photoconductor. Since such a functional separation type laminate photoconductor is more excellent in photosensitivity and durability than a single layer photoconductor and allows for individual molecular designs of a charge generating layer (CGM) and a charge transporting layer (CTM), it allows for wide selection of materials. For the reasons, the layer configuration of a functional separation laminate type photoconductor is now a primary layer configuration of organic photoconductors.

In the mechanism of formation of a latent electrostatic image in the functional separation type laminate photoconductor, the photoconductor is charged and irradiated with a laser beam, the laser beam passes through a charge transporting layer and is absorbed by a charge generating material contained in a charge generating layer to generate a charge. Then, the generated charge is introduced to the charge transporting layer at a boundary surface between the charge generating layer and the charge transporting layer and moves into the charge transporting layer by effect of electric field to negate the effect of the charge residing on the photoconductor surface, thereby a latent electrostatic image can be formed.

An organic photoconductor (OPC) suffers from a large amount of film exfoliation due to repetitive use thereof, and when film exfoliation proceeds on the photoconductor, it causes a reduction in the electric charge potential and degradation of photosensitivity of the photoconductor, resulting in acceleration of contamination of the photoconductor surface such as scratches, degradation in image density, and degradation in quality of images. Therefore, there is a need to improve abrasion resistance of organic photoconductors. Recently, importance is further placed on making an organic photoconductor have high-durability with increased high-speed performance or down-sizing of image forming apparatuses.

As methods to improve abrasion resistance of an organic photoconductor, there are known methods of imparting lubricating property to a photosensitive layer, hardening a photosensitive layer, or adding a filler to a photosensitive layer, and a method of using a polymer charge-transporting material instead of a low-molecular weight charge-transporting material (CTM). Recently, a method of forming a three-dimensionally crosslinked hardened film as a protective layer is also proposed. For example, Japanese Patent Application Laid-Open (JP-A) No. 5-66598 disclosed an organic photoconductor in which an acrylic resin hardened film is formed as a protective layer, and excellent abrasion resistance is achieved.

However, when film exfoliation of a photoconductor is prevented by these methods, ozone, NOx, or other oxidized substances generated in ambient surroundings are absorbed to the photoconductor surface, which may cause low-resistance of the outermost surface thereof to thereby cause problems with occurrences of image deletion such as image blur and reductions in dot-resolution. Conventionally, an image-blur causing material is exfoliated little by little together with a photosensitive layer and such a problem has been avoided to a certain degree. However, to respond to requests for giving further higher-resolution and higher durability to photoconductors in recent years, it is desired to develop a new means.

Then, as a method of alleviating affect of an image-blur causing material, a method of mounting a heater on a photoconductor is exemplified, however, such a method poses an impediment to downsizing of apparatuses and reductions in electric power consumption. A method of adding additives such as antioxidant to a photosensitive layer is also employed, however, addition of a large amount of additives which have no photoconductivity such as antioxidant to a photosensitive layer has negative influences on electrophotographic properties, such as low-photosensitivity and increases in residual electric potential.

Further, as a method of preventing occurrences of image blur or reductions in dot-resolution, for example, a method of adding a tertiary amine compound having a specific alkyl amine structure to a photosensitive layer is proposed (see Japanese Patent Application Laid-Open (JP-A) No. 2004-102080). However, when a tertiary amine compound is added to a crosslinked hardened film as disclosed in the proposal, it causes problems such as degradation of abrasion resistance and degradation of uniform film-forming property.

As described above, an electrophotographic photoconductor involving less film exfoliation owing to giving high-abrasion resistance to the photoconductor or process designing of peripherals of the photoconductor makes it impossible to avoid influences as side-effects thereof on quality of images such as occurrences of image blur and reductions in resolution, and it is difficult to achieve both high-durability and high-quality image. An electrophotographic photoconductor having a higher electric resistance is effective to prevent occurrences of image blur. In contrast, an electrophotographic photoconductor having a lower resistance is effective to prevent increases in residual electric potential. Because of the above-noted trade-off relation between these requirements, it is further difficult to solve the problems.

SUMMARY OF THE INVENTION

The present invention aims to provide an electrophotographic photoconductor which has very high abrasion resistance and is capable of stably forming high-quality images without causing reductions in resolution and without causing abnormal images such as contamination, and toner-filming even when repeatedly used over a long period of time. The present invention also aims to provide an image forming method using the electrophotographic photoconductor, an image forming apparatus using the electrophotographic photoconductor, and a process cartridge using the electrophotographic photoconductor.

The electrophotographic photoconductor has a layer containing a hardened material which is prepared by polymerizing (A) a chain-polymerizable group-containing tertiary amine compound in which at least one alkyl group is bound to a nitrogen atom constituting an amine structure through chain polymerization. Thus, with the use of the electrophotographic photoconductor, it is possible to stably form an image with enhanced durability and without causing reductions in resolution and without causing abnormal images such as background smear, and toner-filming even when repeatedly used over a long period of time.

The reason why the electrophotographic photoconductor of the present invention is extremely effective in keeping image quality even when repeatedly used is not clearly verified at this point in time, however, the reason is assumed as follows. Namely, in (A) the chain-polymerizable group-containing tertiary amine compound in which at least one alkyl group is bound to a nitrogen atom constituting an amine structure, i.e., in the (A) component, an alkylamino group contained in the chemical structure is a group having strong basicity, and thus it can be considered that the alkylamino group contained in the chemical structure has a neutralization effect relative to oxidized gas that is believed as a material causing image blur or reductions in dot-resolution.

Further, an aromatic ring hydrocarbon group-substituted amino group which may be contained in the chemical structure of the tertiary amine compound ((A) component) is a functional group having high-charge transportability (The Society Journal of Electrophotography of Japan (No. 3, Vol. 25, page 16 (1986) Takahashi et al.). It is also known that it is possible to increase photosensitivity and repetitive stability of an electrophotographic photoconductor by using the aromatic ring hydrocarbon group-substituted amino group in combination with other charge-transporting material. With respect to that point, Japanese Patent Application Laid-Open (JP-A) No. 2000-231204 discloses an aromatic compound having a dialkylamino group as an acid scavenger used for a photoconductor. The compound is effective in keeping quality of images even when a single photoconductor is repeatedly used, however, the compound is hardly responsive to requirements of high-sensitivity and high-speed recording due to its low-charge transportability, and there is a limitation on the added amount of the compound.

Further, a stilbene compound having a dialkylamino group which is disclosed in Japanese Patent Application Laid-Open (JP-A) No. 60-196768 and Japanese Patent (JP-B) No. 2884353 respectively has a beneficial effect on image blur caused by oxidized gas (KONICA TECHNICAL REPORT, Vol. 13, page 37 (2000), Itami et al.). However, since the stilbene compound has a dialkylamino group which is a substituted group having strong Mesomeric effect (+M effect) in resonant sites of a triarylamine structure which are of charge transporting sites, the entire ionized electric potential value is extremely small. Therefore, the charge holding ability of the photosensitive layer of which the stilbene compound has been solely used as a charge-transporting material is degraded from the early stage of the use, further, the charge holding ability is significantly degraded after repetitive use, and it is very difficult to put it into practical use. Even when the stilbene compound is used in combination with other charge-transporting materials, the stilbene compound becomes hole-trap sites of transferred charge, resulting in an electrophotographic conductor having considerably low photosensitivity and causing a large amount of residual electric potential because the ionized electric potential value of the stilbene compound is considerably smaller than those of the other charge-transporting materials.

Thus, in the present invention, an electrophotographic photoconductor has a hardened material prepared by polymerizing (A) a chain-polymerizable group-containing tertiary amine compound in which at least one alkyl group is bound to a nitrogen atom constituting an amine structure through chain polymerization, and an electrophotographic photoconductor preferably has a layer containing a hardened layer prepared by polymerizing a tertiary amine compound composed of (A) component, (B) a chain-polymerizable charge-transporting compound, (C) a trifunctional or more chain-polymerizable compound, and (D) a photopolymerization initiator through chain polymerization. Such an electrophotographic photoconductor enables to achieve both high-durability and high-quality image and allows for stably obtaining high-quality images even when repeatedly used. By using the electrophotographic photoconductor of the present invention, it is possible to provide an image forming method, an image forming apparatus, and a process cartridge each allowing for obtaining high-quality images stably.

The image forming apparatus of the present invention is equipped with at least the electrophotographic photoconductor of the preset invention, a latent electrostatic image forming unit having a charger configured to charge the photoconductor surface and an exposer configured to expose the charged photoconductor surface to form a latent electrostatic image, a developing unit configured to form a visible image using the latent electrostatic image, a transferring unit configured to transfer the visible image onto a recording medium, and a fixing unit configured to fix the transferred image on the recording medium.

The image forming method of the present invention includes at least forming a latent electrostatic image by using a charger configured to charge the surface of the electrophotographic photoconductor of the present invention and an exposer configured to expose the photoconductor surface to form a latent electrostatic image, developing the latent electrostatic image using a toner to form a visible image, transferring the visible image onto a recording medium, and fixing the transferred image on the recording medium.

The process cartridge of the present invention is equipped with at least the electrophotographic photoconductor of the present invention and is further equipped with at least one selected from a charger configured to charge the photoconductor surface, an exposer configured to expose the charged photoconductor surface to form a latent electrostatic image, a developing unit configured to develop the latent electrostatic image formed on the electrophotographic photoconductor using a toner to form a visible image, a transferring unit, a cleaning unit, and a charge eliminating unit.

Figure 1:
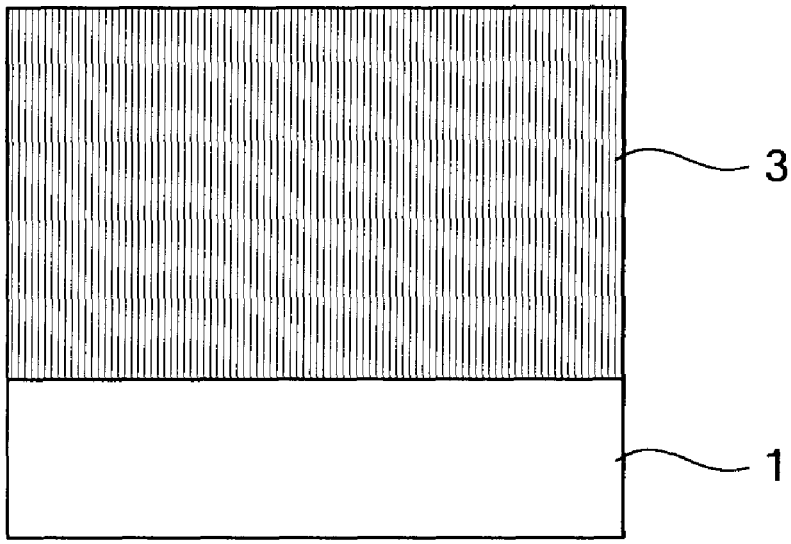
FIG. 1 is a schematic cross-sectional view exemplarily showing a layer configuration of a single layer electrophotographic photoconductor of the present invention.

DETAILED DESCRIPTION OF THE INVENTION (Electrophotographic Photoconductor)

The electrophotographic photoconductor has a layer containing a hardened material prepared by polymerizing (A) a chain-polymerizable group-containing tertiary amine compound in which at least one alkyl group is bound to a nitrogen atom constituting an amine structure through chain polymerization, and further has other layers in accordance with the necessity.

<Layer Containing a Hardened Material>

The layer containing the hardened material contains a hardened material prepared by polymerizing (A) a chain-polymerizable group-containing tertiary amine compound in which at least one alkyl group is bound to a nitrogen atom constituting an amine structure through chain polymerization. Preferably, the layer containing the hardened material prepared by polymerizing (A) a tertiary amine compound, (B) a chain-polymerizable charge-transporting compound, (C) a trifunctional or more chain-polymerizable compound, and (D) a photopolymerization initiator through chain polymerization, and further contains other components in accordance with the necessity.

-(A) component—chain-polymerizable group-containing tertiary amine compound in which at least one alkyl group is bound to a nitrogen atom constituting an amine structure- The chain-polymerizable group-containing tertiary amine compound composed of the (A) component is a compound having a chain-polymerizable group in a molecule thereof, in which at least one alkyl group is bound to a nitrogen atom constituting an amine structure, and one to three of the alkyl groups may be bound to a nitrogen atom constituting an amine structure.

Here, the alkyl group typically has 1 to 30 carbon atoms and more preferably has 1 to 12 carbon atoms. Examples of such an alkyl group include methyl group, ethyl group, propyl group, isopropyl group, butyl group, isobutyl group, sec-butyl group, tert-butyl group, pentyl group, isopentyl group, neopentyl group, hexyl group, heptyl group, octyl group, nonyl group, decyl group, undecyl group, dodecyl group, vinyl group, benzyl group, phenethyl group, styryl group, cyclopentyl group, cyclohexyl group, cycloheptyl group, and cyclohexenyl group.

The alkyl group may be substituted by a substituent group, and examples of such an alkyl group include alkyl group, aromatic hydrocarbon group, and combinations of two or more of these groups are exemplified. Besides, those further substituted by a group represented by the following structural formula, alkoxy group, carboxy group or esters thereof, cyano group, alkylamino group, aralkylamino group, amino group, nitro group, acetylamino group, and halogen atom are exemplified.

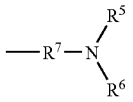

However, in the structural formula, $R^5$ and $R^6$ may be same to each other or may be different from each other and respectively represent any one of an alkyl group that may have a substituent group and an aromatic hydrocarbon group that may have a substituent group. $R^7$ represents any one of an alkylene group that may have a substituent group, an aromatic hydrocarbon divalent group that may have a substituent group, and a divalent group that is a combination thereof. The details of $R^5R^6$, and $R^7$ will be described hereinafter.

Here, in the present invention, the chain polymerization indicates a configuration of polymerization reaction, when polymer-forming reaction is classified broadly into two types, i.e., chain polymerization and successive polymerization, and the chain polymerization means, for example, unsaturation polymerization, ring opening polymerization, and isomerization polymerization in which the reaction proceeds via an intermediate such as radical, ion, or the like.

The unsaturation polymerization means a reaction in which an unsaturated group such as C═C, C≡C, C═O, C═N, or C≡N is polymerized.

The ring opening polymerization means a reaction in which an unstable ring structure having distortion induced from a carbocyclic ring or a heterocyclic ring is activated by effect of a catalyst or the like to open the ring as well as to repeat polymerization reactions to thereby generate a chain-like polymer.

The chain-polymerizable functional group used in the present invention is not particularly limited as long as it is a functional group capable of performing chain polymerization, and may be suitably selected in accordance with the intended use. However, an unsaturation polymerizable functional group that is a functional group capable of performing unsaturation polymerization, and a ring opening polymerizable functional group that is a functional group capable of performing ring opening polymerization are preferably used.

The unsaturation polymerizable functional group is not particularly limited as long as it is a functional group having at least one unsaturated group such as C═C, C≡C, C═O, C═N, and C≡N, however, a functional group having C═C is typically used. As an unsaturation polymerizable functional group used in the present invention, a functional group having C═C is particularly preferable.

Examples of the unsaturation polymerizable functional group having C═C include (1) 1-substituted ethylene functional group and (2) 1,1-substituted ethylene functional group, which are shown below.

For (1) 1-substituted ethylene functional group, functional groups represented by the following Structural Formula (3) are exemplified $$CH_2{=}CH{-}X^5{-} \qquad \text{Structural Formula (3)}$$

In the Structural Formula (3), $X^5$ represents a phenylene group that may have a substituent group, an allylene group such as naphthylene group; an alkenylene group that may have a substituent group, —CO— group, —COO— group, and —CON($R^{14}$)— group (where $R^{14}$ represents a hydrogen atom, or an alkyl group such as methyl group and ethyl group; aralkyl group such as benzyl group, naphthylmethyl group, and phenethyl group; or aryl group such as phenyl group, and naphthyl group), or —S— group.

Examples of substituent groups thereof include vinyl group, styryl group, 2-methyl-1,3-butadienyl group, vinylcarbonyl group, acryloyloxy group, acryloylamide group, and vinylthioether group.

For (2) 1,1-substituted ethylene functional group, functional groups represented by the following Structural Formula (4) are exemplified.

$$CH_2{=}C(Y){-}X^6{-} \qquad \text{Structural Formula (4)}$$

In the Structural Formula (4), Y represents an alkyl group that may have a substituent group, an aralkyl group that may have a substituent group, a phenyl group that may have a substituent group, an aryl group such as naphthyl group; halogen atom, a cyano group, a nitro group, an alkoxy group such as methoxy group or ethoxy group, or —$COOR^{15}$ group (where $R^{15}$ represents a hydrogen atom, an alkyl group that may have a substituent group such as methyl group, and ethyl group; an aralkyl group that may have a substituent group such as benzyl group, and phenethyl group, or an aryl group that may have a substituent group such as phenyl group and naphthyl group) or $CONR^{16}R^{17}$ (where $R^{16}$ and $R^{17}$ respectively present a hydrogen atom, a methyl group that may have a substituent group such as methyl group and ethyl group; an aralkyl group that may have a substituent group such as benzyl group, naphthylmethyl group or phenethyl group, or an aryl group that may have a substituent group such as phenyl group, and naphthyl group; and $R^{16}$ and $R^{17}$ may be same to each other or different from each other), and $X^6$ represents the same substituent group, a single bond, or an alkylene group as that of $X^5$ shown in the Structural Formula (3). However, at least one of Y and $X^6$ is an oxycarbonyl group, a cyano group, an alkenylene group, or an aromatic ring.

Examples of substituent groups thereof include α-acryloyloxy chloride group, methacryloyloxy group, α-cyanoethylene group, α-cyanoacryloyloxy group, α-cyanophenylene group, and methacryloylamino group.

Examples of a substituent group that is further substituted by the substituent group of $X^5$, $X^6$ and Y include halogen atom, alkyl group such as nitro group, cyano group, methyl group, and ethyl group; alkoxy group such as methoxy group and ethoxy group; aryloxy group such as phenoxy group; aryl group such as phenyl group and naphthyl group; and aralkyl group such as benzyl group and phenethyl group. Of these substituent groups, acryloyloxy group and methacryloyloxy group is particularly preferable in terms of polymerizability.

For the chain-polymerizable functional group, as mentioned above, it is possible to use a ring opening polymerizable functional group. The ring opening functional group is not particularly limited as long as it is a functional group having at least one unstable cyclic structure having distortion induced from a carbocyclic ring or a heterocyclic ring, and may be suitably selected in accordance with the intended use, however, basically, most of them are ring opening polymerizable functional groups in which ions acts as activated species. Examples of the ring opening polymerizable functional group include cyclic carbonyl, and oxirane.

Preferred examples of (A) the chain-polymerizable group-containing tertiary amine compound in which at least one alkyl group is bound to a nitrogen atom constituting an amine structure include compounds represented by any one of the following Structural Formulas (1) and (1').

Structural Formula (1)

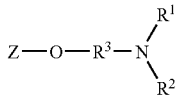

Structural Formula (1')

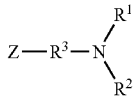

In the Structural Formulas (1) and (1'), $R^1$ and $R^2$ may be same to each other or different from each other and respectively represent any one of an alkyl group that may have a substituent group, an aromatic hydrocarbon group that may have a substituent group, a group represented by the following Structural Formula (1-1), and a group represented by the following Structural Formula (1-2), $R^1$ and $R^2$ may be bound together to form a heterocyclic ring containing a nitrogen atom, and the heterocyclic ring may be further substituted by a substituent group. $R^3$ represents any one of a single bond, an alkylene group that may have a substituent group, an aromatic hydrocarbon divalent group that may have a substituent group, and a divalent group that is a combination thereof. When $R^3$ is an aromatic hydrocarbon divalent group and the aromatic hydrocarbon divalent group is directly bound to the nitrogen atom, any one of $R^1$ and $R^2$ is the alkyl group that may have a substituent group or a group represented by the following Structural Formula (1-2). In addition, Z represents a chain-polymerizable functional group.

Structural Formula (1-1)

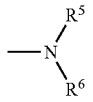

Structural Formula (1-2)

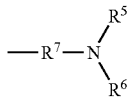

In the Structural Formulas (1-1) and (1-2), $R^5$ and $R^6$ may be same to each other or different from each other and respectively represent any one of an alkyl group that may have a substituent group and an aromatic hydrocarbon group that may have a substituent group; and $R^7$ represents any one of an alkylene group that may have a substituent group, an aromatic hydrocarbon divalent group that may have a substituent group, and a divalent group that is a combination thereof.

The alkyl groups in the Structural Formulas (1) and (1') are the same as mentioned above.

Examples of the aromatic hydrocarbon group in the Structural Formulas (1) and (1') include phenyl group, tolyl group, xylyl group, styryl group, naphthyl group, anthryl group, and biphenyl group.

Examples of the heterocyclic ring containing a nitrogen atom in the Structural Formulas (1) and (1') include pyrrolidine, imidazolidine, pyrazolidine, piperidine, piperazine, morpholine, indoline, pyridine, pyrazine, pyrimidine, pyridazine, oxopyridazine, quinoline, isoquinoline, phthalazine, quinazoline, quinoxaline, naphthylidine, cinnoline, pyrrole, pyrazole, imidazole, triazine, triazole, tetrazole, thiazole, isothiazole, oxazole, isooxazole, oxadiazole, thiadiazole, oxooxadiazole, indole, isoindole, indazole, 2-oxobenzoimidazole, benzoimidazole, benzotriazole, benzothiazole, benzooxazole, purine, 2,5-dioxysopyrrolidine, thiazolidine, thiomorphorine, homopiperidine, homopiperazine, tetrahydropyridine, dihydroisoquinoline, tetrahydroquinoline, tetrahydroisoquinoline, oxazoline, oxazolidine, oxsooxazolidine, osadiazoline, oxirane, oxopiperazine, 2-oxopyrrolidine, perhydrodiazepine, perhydroazocine, perhydrodiazonine, octahydroquinoline, and dihydroindoline.

Examples of the alkylene group in the Structural Formulas (1) and (1') include methylene group, ethylene group, 1,3-propylene group, 1,4-butylene group, vinylene group, ethynylene group, cyclohexylene group, and cyclo hexenylene group.

Examples of the aromatic hydrocarbon divalent group in the Structural Formulas (1) and (1') include phenylene group, biphenyldiyl group, quaterphenyldiyl group, kinkphenyldiyl group, sexiphenyldiyl group, septiphenyldiyl group, octiphenyldiyl group, noviphenyldiyl group, deciphenyldiyl group, diphenylmethanediyl, diphenyl acetylenediyl, diphenyletherdiyl, diphenylsufidediyl, diphenyl sulfonediyl, naphthalenediyl group, fluolenediyl group, and stilbenediyl group.

Examples of the chain-polymerizable functional group represented by the Structural Formulas (1) and (1') include the unsaturation polymerizable functional groups and ring opening functional groups mentioned above.

For the alkyl group, aromatic hydrocarbon group, alkylene group, and aromatic hydrocarbon divalent group in the Structural Formulas (1-1) and (1-2), same ones represented by the Structural Formulas (1) and (1') can be used.

For substituted groups that can be introduced into $R^1$, $R^2$, and $R^3$ in the Structural Formulas (1) and (1') and $R^5$, $R^6$, and $R^7$ in the Structural Formulas (1-1) and (1-2), for example, those further substituted by alkoxy group, carboxy group or esters thereof, cyano group, alkylamino group, aralkylamino group, amino group, nitro group, acetylamino group, or a halogen atom are exemplified, besides the alkyl group, aromatic hydrocarbon group, and a combinations thereof set forth above.

A photoconductor having a uniform film can be produced by using a tertiary amine compound having a chain-polymerizable group represented by any one of the Structural Formulas (1) and (1') in a molecule thereof and in which at least one alkyl group is bound to a nitrogen atom constituting an amine structure. The reason is assumed that in a tertiary amine compound represented by the Structural Formulas (1) or (1'), only one chain-polymerizable functional group resides in a molecule thereof and therefore a chain polymerization reaction proceeds at a favorable speed during hardening the film. Further, it is possible to produce a photoconductor that allows for obtaining high-resolution images by using a tertiary amine compound represented by the Structural Formulas (1) or (1'). The reason is assumed that a tertiary amine compound represented by the Structural Formula (1) or Structural formula (1') has a suitable structure to repeatedly use a photoconductor surface as well as to trap and remove ozone and NOx and oxidized substances occurred in ambient surroundings.

The tertiary amine compound represented by the Structural Formula (1) can be prepared, for example, by the following method.

First, a primary amine compound represented by the following Structural Formula (5) and respective halogenated compounds represented by the following Structural Formulas (6) or (7) respectively are reacted together in the presence of a basic compound at a temperature ranging from room temperature to about 170° C. to thereby yield a tertiary amine compound represented by the following Structural Formula (8).

Structural Formula (5)

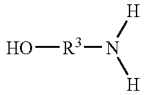

In the Structural Formula (5), $R^3$ represents an alkylene group that may have a substituent group, an aromatic hydrocarbon divalent group that may have a substituent group, or a divalent group that is a combination thereof.

$R^1$—X Structural Formula (6)

$R^2$—X Structural Formula (7)

In the Structural Formulas (6) and (7), $R^1$ and $R^2$ may be same to each other or different from each other and respectively represent an alkyl group that may have a substituent group or an aromatic hydrocarbon group that may have a substituent group. Further, $R^1$ and $R^2$ may be bound together to form a heterocyclic group containing a nitrogen atom, and $R^1$ and $R^2$ may have a substituent group on the heterocyclic group containing a nitrogen atom; and X represents a halogen atom.

Structural Formula (8)

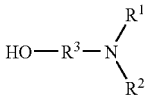

In the Structural Formula (8), $R^1$ and $R^2$ may be same to each other or different from each other and respectively represent an alkyl group that may have a substituent group or an aromatic hydrocarbon group that may have a substituent group. Further, $R^1$ and $R^2$ may be bound together to form a heterocyclic group containing a nitrogen atom, and $R^1$ and $R^2$ may have a substituent group on the heterocyclic group containing a nitrogen atom; $R^3$ represents an alkylene group that may have a substituent group, an aromatic hydrocarbon divalent group that may have a substituent group or a divalent group that is a combination thereof. However, when $R^3$ has an aromatic hydrocarbon divalent group and the aromatic hydrocarbon divalent group is directly bound to the nitrogen atom, any one of $R^1$ and $R^2$ is an alkyl group that may have a substituent group.

Next, a tertiary amine compound represented by the Structural Formula (8) and a halogenated compound represented by the following Structural Formula (9) are reacted together in the presence of a basic compound at a temperature of minus (−) 20° C. to (−) 90° C. to thereby yield a chain-polymerizable tertiary amine compound represented by the Structural Formula (1).

Z—X Structural Formula (9)

In the Structural Formula (9), Z represents a chain-polymerizable functional group, and X represented a halogen atom.

Preferred examples of (A) the chain-polymerizable group-containing tertiary amine compound in which at least one alkyl group is bound to a nitrogen atom constituting an amine structure include compounds represented by any one of the following Structural Formulas (2) and (2').

Structural Formula (2)

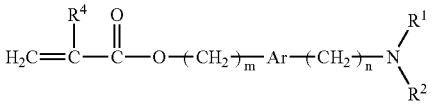

-continued

Structural Formula (2')

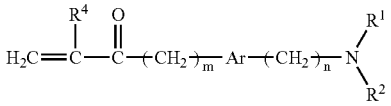

In the Structural Formulas (2) and (2'), $R^1$ and $R^2$ respectively represent the same meanings as those described in the Structural Formulas (1) and (1'); $R^4$ represents any one of a hydrogen atom or a methyl group; Ar represents an aromatic hydrocarbon divalent group that may have a substituent group; "m" and "n" are respectively an integer of 0 to 6, and when "n" is equal to zero, any one of $R^1$ and $R^2$ represents the alkyl group that may have a substituent group or the group represented by the Structural Formula (1-2).

For the aromatic hydrocarbon divalent group represented by "Ar" in the Structural Formulas (2) and (2') or substituent groups thereof, the same ones as mentioned in the Structural Formula (1) can be used.

By using a compound represented by the Structural Formulas (2) or (2'), it is possible to produce a photoconductor having a further smooth film and further favorable electric properties. The reason is assumed that in a compound represented by the Structural Formulas (2) or (2'), a divalent group having an aromatic hydrocarbon skeleton which may have a substituent group resides between an amine structural site and a chain-polymerizable functional group.

Preferred examples of the chain polymerizable tertiary amine compound composed of the (A) component include a tertiary amine compound having a chain-polymerizable group in a molecule thereof and two or more alkyl groups bound to a nitrogen atom constituting an amine structure. By using such a tertiary amine compound having two or more (two or three) alkyl groups bound to a nitrogen atom, it is possible to produce a photoconductor having further favorable electric properties. The reason is assumed that such a tertiary amine compound has stronger basicity than a tertiary amine compound having one alkyl group, and therefore a neutralization effect relative to oxidized gas that is believed as a material causing image blur or reductions in dot-resolution is improved.

Then, specific examples of (A) the chain-polymerizable group-containing tertiary amine compound in which at least one alkyl group is bound to a nitrogen atom constituting an amine structure are shown below. The chain-polymerizable tertiary amine compound composed of the (A) component is not limited to the ones disclosed below.

No. 1

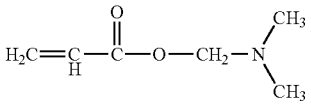

No. 2

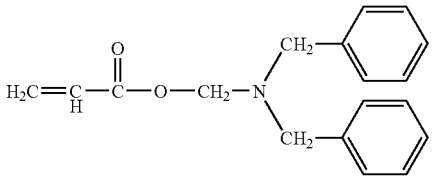

No. 3

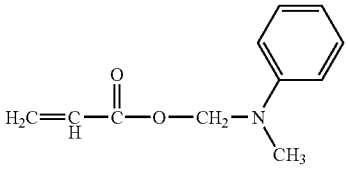

No. 4

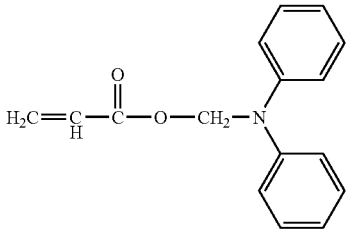

-continued
No. 5
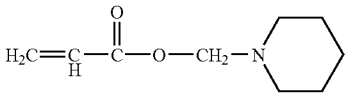
No. 6
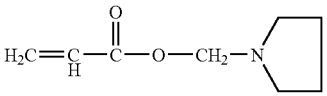
No. 7
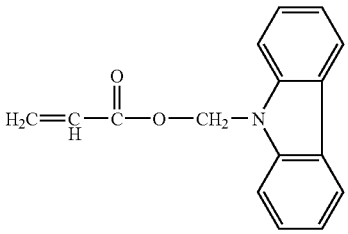
No. 8
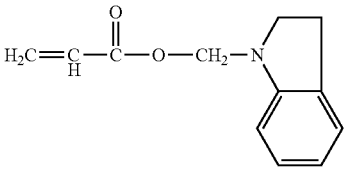
No. 9
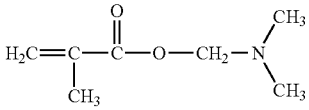
No. 10
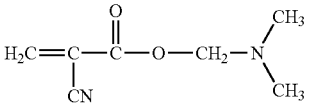
No. 11
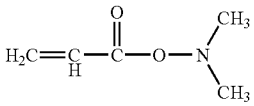
No. 12
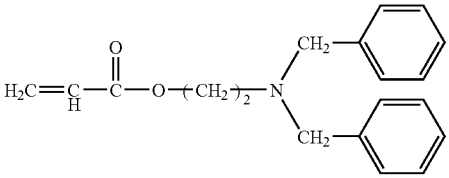
No. 13
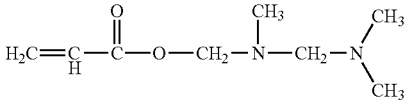
No. 14
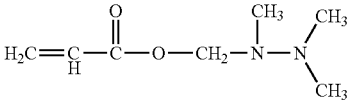
No. 15
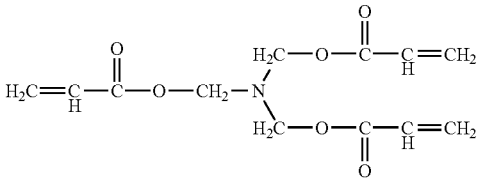
No. 16
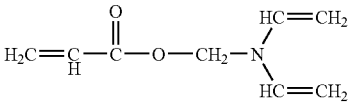
No. 17
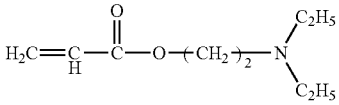
No. 18
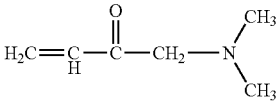
No. 19
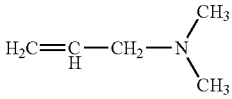
No. 20
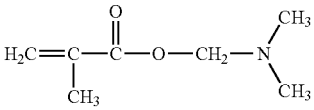
No. 21
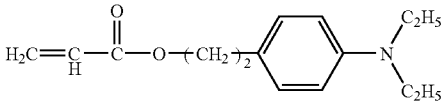
No. 22
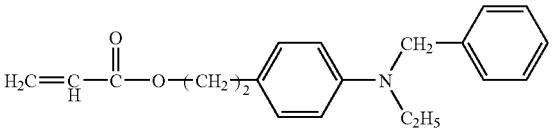
No. 23
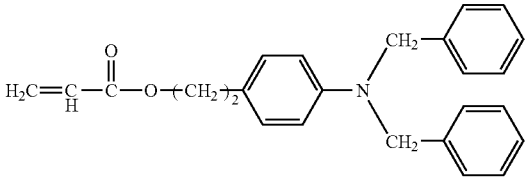
No. 24
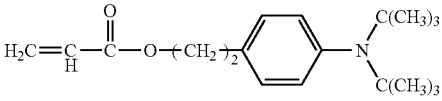

-continued
No. 25
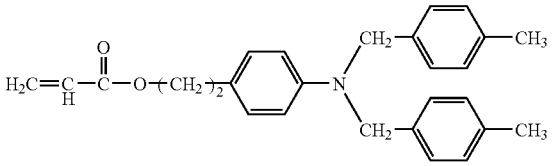
No. 26
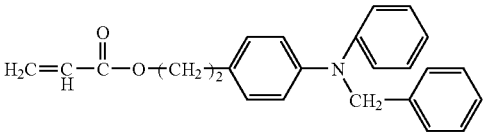
No. 27
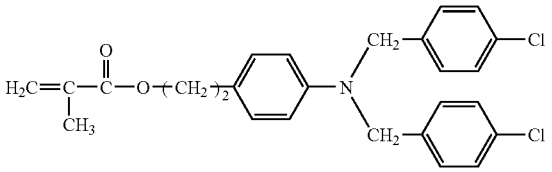
No. 28
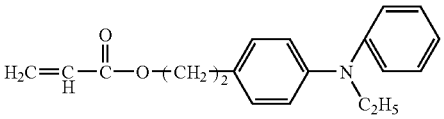
No. 29
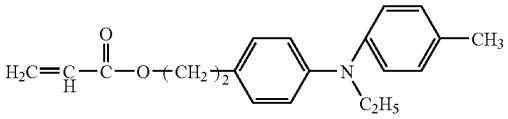
No. 30
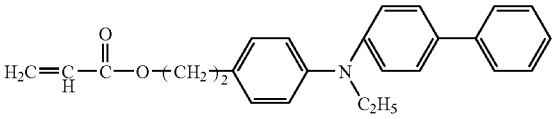
No. 31
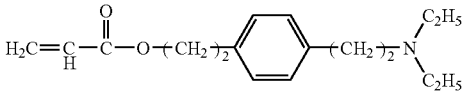
No. 32
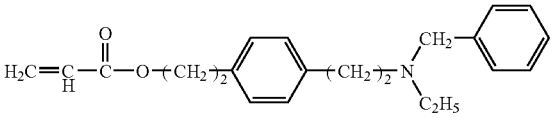
No. 34
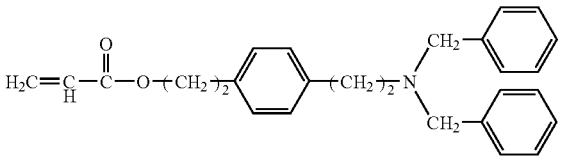
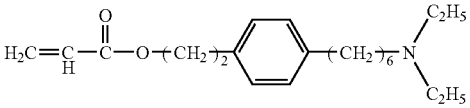
No. 35
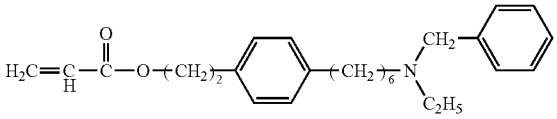
No. 36
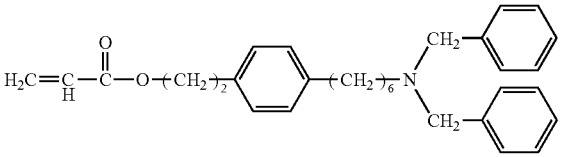
No. 37
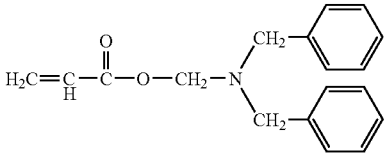
No. 38
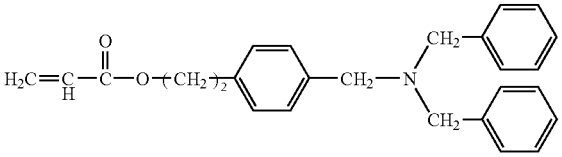
No. 39
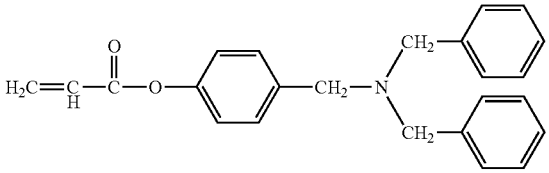
No. 40
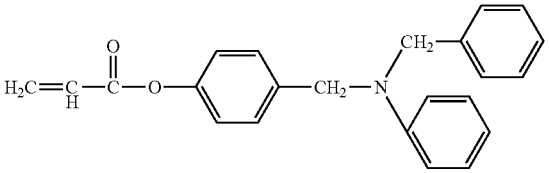
No. 41
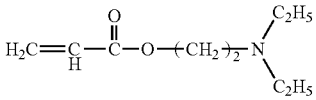
No. 42
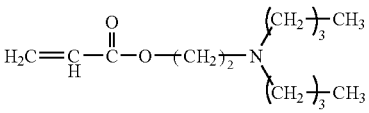

-continued
No. 43
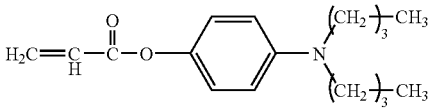
No. 44
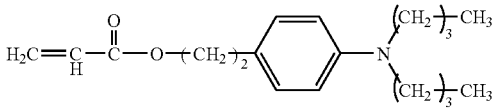
No. 45
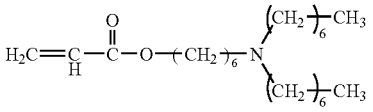
No. 46
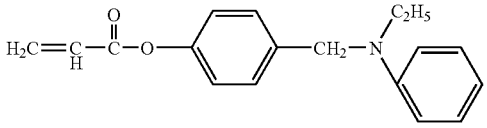
No. 47
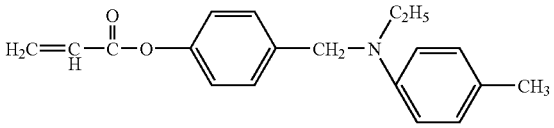
No. 48
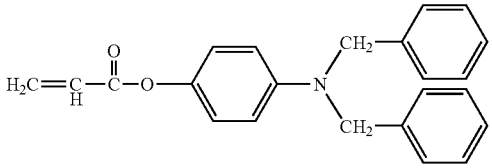
No. 49
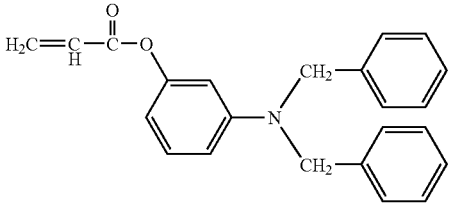
No. 50
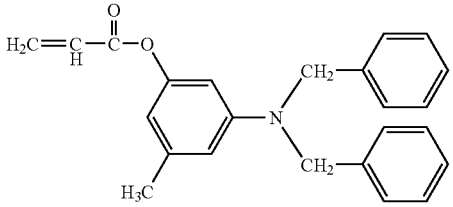
No. 51
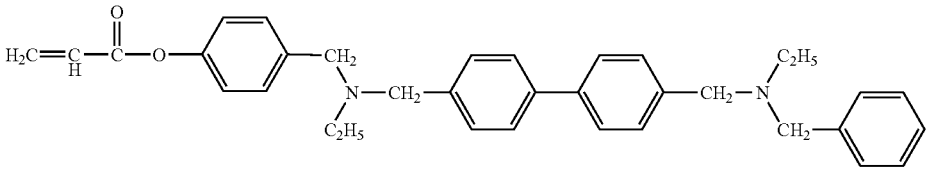
No. 52
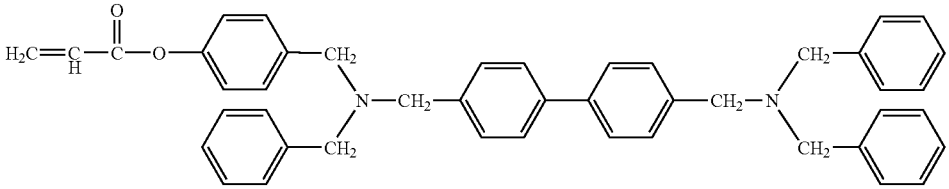
No. 53
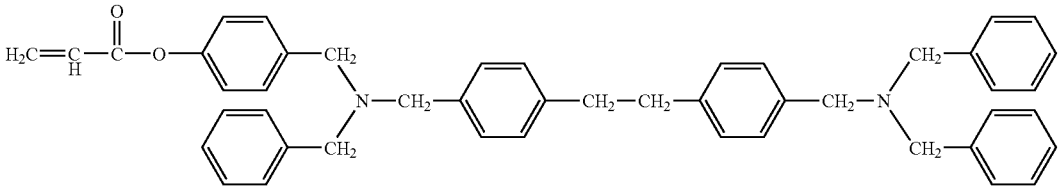
No. 54
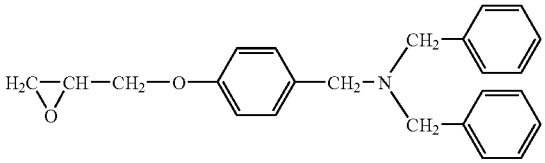
No. 55
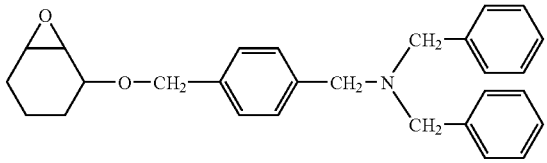
No. 56
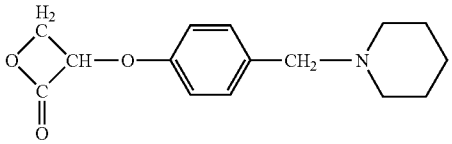
No. 57
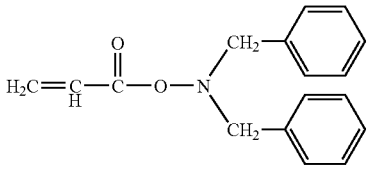

-continued

No. 58

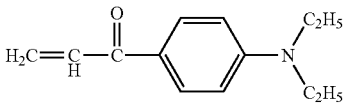

No. 59

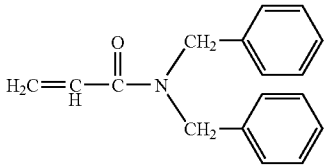

No. 60

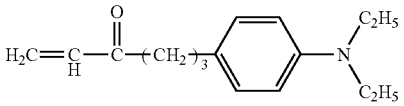

No. 61

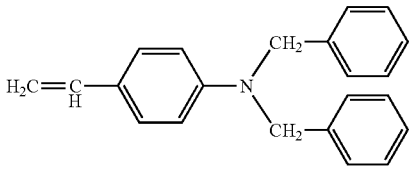

No. 62

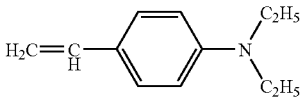

No.63

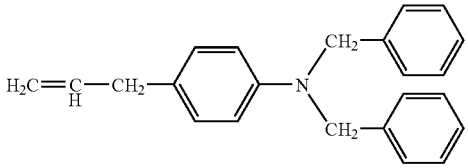

No. 64

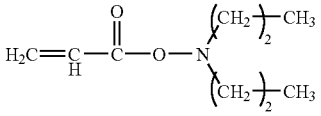

No. 65

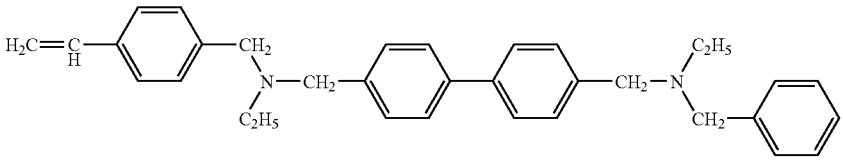

No. 66

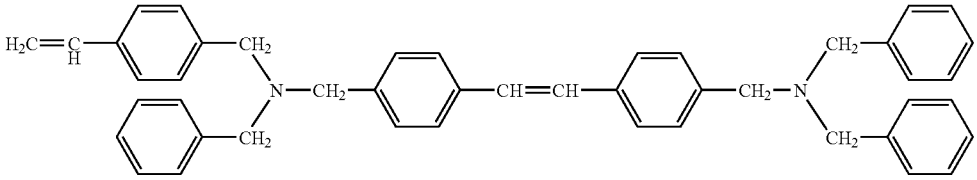

The content of (A) the chain-polymerizable group-containing tertiary amine compound in which at least one alkyl group is bound to a nitrogen atom constituting an amine structure in the total content of the hardened material cannot be uniformly defined because it depends on the amine structure, however, it is preferably 1% by mass to 20% by mass, and more preferably 3% by mass to 10% by mass. When the content of the tertiary amine compound is less than 1% by mass, image blur may easily occur at the time of repeatedly using the photoconductor in a long term, and when the content is more than 20% by mass, the charge holding ability may degrade due to repetitive use of the photoconductor.

-Chain-Polymerizable Charge-Transportable Compound as (B) Component-

By adding a chain-polymerizable charge-transporting compound to materials of the hardened layer, the electrophotographic properties of the electrophotographic photoconductor having a layer containing the hardened material can be further enhanced. The compound composed of the (B) component is not particularly limited as long as the component is of a component in which a charge-transporting material known in the art is substituted by a chain-polymerizable functional group, and may be suitably selected in accordance with the intended use.

For the chain-polymerizable functional group in the chain-polymerizable charge-transporting compound composed of the (B) component, the same ones as mentioned in the (A) component compound can be used.

Specific examples of the charge-transporting material in the chain-polymerizable charge-transporting compound composed of the (B) component are shown below. The (B)

component is of a component in which any one of the following materials is substituted by a chain-polymerizable functional group.

Examples of the charge-transporting material include poly-N-carbazole or derivatives thereof, poly-γ-carbazolylethylglutamate or derivatives thereof, pyrene-formaldehyde condensates or derivatives thereof, polyvinylpyrene, polyvinylphenanthrene, oxazole derivatives, imidazole derivatives, triphenylamine derivatives or compounds represented by the Structural Formula (10).

Structural Formula (10)

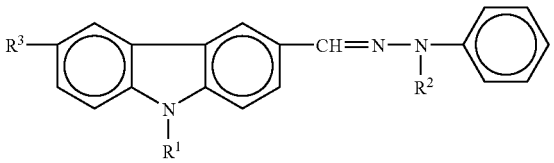

In the Structural Formula (10), $R^1$ represents a methyl group, an ethyl group, 2-hydroxyethyl group or 2-ethyl chloride group; $R^2$ represents a methyl group, an ethyl group, a benzyl group or a phenyl group; and $R^3$ represents a hydrogen atom, a chlorine atom, a bromine atom, an alkyl group having 1 to 4 carbon atoms, an alkoxy group having 1 to 4 carbon atoms, a dialkylamino group or a nitro group.

Examples of the compound represented by the Structural Formula (10) include 9-ethylcarbazole-3-carboaldehyde 1-methyl-1-phenylhydrazone, 9-ethylcarboazole-3-carboaldehyde 1-benzyl-1-phenyhydrazone, and 9-ethylcarbazole-3-carboaldehyde 1,1-diphenylhydrazone.

Structural Formula (11)

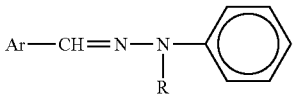

In the Structural Formula (11), Ar represents a naphthalene ring, an anthracene ring, a pyrene ring, or a substituent thereof, or a pyridine ring, or a thiophene ring; and R represents an alkyl group, a phenyl group, or a benzyl group.

Examples of the compound represented by the Structural Formula (11) include 4-diethylaminostyryl-β-carboaldehyde 1-methyl-1-phenylhydrazone, and 4-methoxynaphthalene-1-carboaldehyde 1-benzyl-1-phenylhydrazone.

Structural Formula (12)

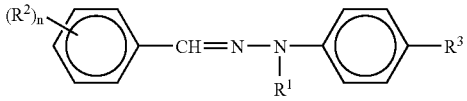

In the Structural Formula (12), $R^1$ represents an alkyl group, a benzyl group, a phenyl group or a naphthyl group; $R^2$ represents a hydrogen atom, an alkyl group having 1 to 3 carbon atoms, an alkoxy group having 1 to 3 carbon atoms, a dialkylamino group, a diaralkylamino group, or diarylamino group; "n" is an integer of 1 to 4, when "n" is 2 or more, the two or more of "$R^2$" may be same to each other or different from each other; and $R^3$ represents a hydrogen atom or a methoxy group.

Examples of the compound represented by the Structural Formula (12) include 4-methoxybenzaldehyde 1-methyl-1-phenylhydrazone, 2,4-dimethoxybenzaldehyde 1-benzyl-1-phenylhydrazone, 4-diethylaminobenzaldehyde 1,1-diphenylhydrazone, 4-methoxybenzaldehyde 1-(4-methoxy) phenylhydrazone, 4-diphenylaminobenzoaldehyde 1-benzyl-1-phenylhydrazone, and 4-dibenzylaminobenzaldehyde 1,1-diphenylhydrazone.

Structural Formula (13)

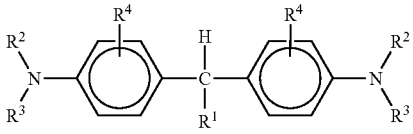

In the Structural Formula (13), $R^1$ represents an alkyl group having 1 to 11 carbon atoms, a phenyl group that may have a substituted group or a heterocyclic group; $R^2$ and $R^3$ may be same to each other or different from each other and respectively represent a hydrogen atom, an alkyl group having 1 to 4 carbon atoms, a hydroxylalkyl group, a chloralkyl group or an aralkyl group that may have a substituent group; $R^2$ and $R^3$ may be bound together to form a heterocyclic ring containing a nitrogen; and the two of $R^4$ may be same to each other or different from each other and respectively represent a hydrogen atom, an alkyl group having 1 to 4 carbon atoms, an alkoxy group or a halogen atom.

Examples of the compound represented by the Structural Formula (13) include 1,1-bis(4-dibenzylaminophenyl) propane, tris(4-diethylaminophenyl)methane, 1,1-bis(4-dibenzylaminophenyl) propane, and 2,2'-dimethyl-4,4'-bis(diethylamino)-triphenylmethane.

Structural Formula (14)

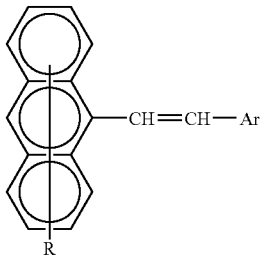

In the Structural Formula (14), R represents a hydrogen atom or a halogen atom; and Ar represents a phenyl group that may have a substituent group, a naphthyl group that may have a substituent group, an anthryl group that may have a substituent group, or a calbazolyl group that may have a substituent group.

Examples of the compound represented by the Structural Formula (14) include 9-(4-diethylaminostyryl) anthracene, and 9-burome-10-(4-diethylaminostyryl) anthracene.

Structural Formula (15)

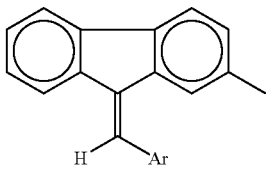

In the Structural Formula (15), $R^1$ represents a hydrogen atom, a halogen atom, a cyano group, an alkoxy group having 1 to 4 carbon atoms, or an alkyl group having 1 to 4 carbon atoms; and Ar is a group represented by the following Structural Formula (16) or Structural Formula (17).

Structural Formula (16)

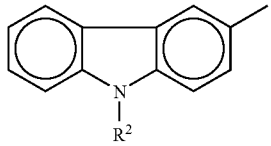

Structural Formula (17)

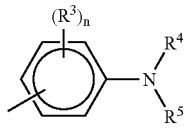

In the Structural Formulas (16) and (17), $R^2$ represents an alkyl group having 1 to 4 carbon atoms; $R^3$ represents a hydrogen atom, a halogen atom, an alkyl group having 1 to 4 carbon atoms, an alkoxy group having 1 to 4 carbon atoms, or a dialkylamino group; "n" is an integer of 1 or 2, when "n" is 2, the two of $R^3$ may be same to each other or different from each other; and $R^4$ and $R^5$ respectively represent a hydrogen atom, an alkyl group that may have a substituent group having 1 to 4 carbon atoms or a benzyl group that may have a substituent group.

Examples of the compound represented by the Structural Formula (15) include 9-(4-dimethylaminebenzylidene) fluorene, and 3-(9-fluorenylidene)-9-ethylcarbazole.

Structural Formula (18)

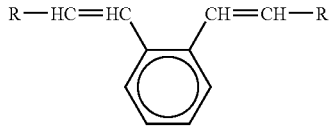

In the Structural Formula (18), R represents a calbazolyl group, a pyridyl group, a thienyl group, an indolyl group, a frill group, or an unsubstituted or a substituted dialkylamino group, an unsubstituted or a substituted alkyl group, an unsubstituted or a substituted alkoxy group, and an unsubstituted or a substituted carboxy group, or an anthryl group, and the substituted groups are respectively a group selected from the group consisting of dialkylamino group, alkyl group, alkoxy group, carboxy group or esters thereof, halogen atom, cyano group, aralkylamino group, N-alkyl-N-aralkylamino group, amino group, nitro group, and acetylamino group.

Examples of the compound represented by the Structural Formula (18) include 1,2-bis(4-diethylaminostyryl)benzene, and 1,2-bis(2,4-dimethoxystyryl)benzene.

Structural Formula (19)

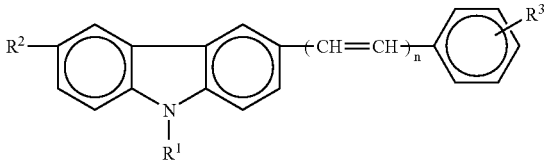

In the Structural Formula (19), $R^1$ represents a lower alkyl group, a phenyl group that may have a substituent group or a benzyl group that may have a substituent group; $R^2$ and $R^3$ respectively represent a hydrogen atom, a lower alkyl group, a lower alkoxy group, a halogen atom, a nitro group, an amino group or an amino group substituted by a lower alkyl group or a benzyl group, and "n" is an integer of 1 or 2.

Examples of the compound represented by the Structural Formula (19) include 3-styryl-9-ethylcarbazole, and 3-(4-methoxystyryl)-9-ethylcarbazole.

Structural Formula (20)

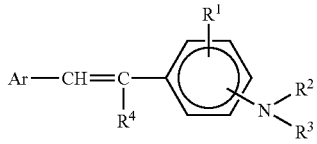

In the Structural Formula (20), $R^1$ represents a hydrogen atom, an alkyl group, an alkoxy group or a halogen atom; $R^2$ and $R^3$ may be same to each other or different from each other and respectively represent an aryl group that may have a substituent group; $R^4$ represents a hydrogen atom, a lower alkyl group or a phenyl group that may have a substituent group; and Ar represents a phenyl group that may have a substituent group or a naphthyl group that may have a substituent group.

Examples of the compound represented by the Structural Formula (20) include 4-diphenylaminostilbene, 4-dibenzylaminostilbene, 4-ditolylaminostilbene, 1-(4-diphenylaminostyryl) naphthalene, and 1-(4-diphenylaminostyryl) naphthalene.

Structural Formula (21)

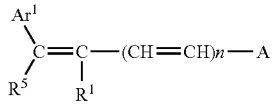

In the Structural Formula (21), "n" is an integer of 0 (zero) or 1; $R^1$ represents a hydrogen atom, an alkyl group or a phenyl group that may have a substituent group; $Ar^1$ represents an unsubstituted or a substituted aryl group; $R^5$ represents an alkyl group including a substituted alkyl group or an aryl group that may have a substituted group; "A" represents a group represented by the following Structural Formula (22), 9-anthryl group or a calbazolyl group that may have a substituent group; $R^2$ represents a hydrogen atom, an alkyl group, an alkoxy group, a halogen atom or a group represented by the following Structural Formula (23), when "m" is an integer of 2 or more, the two or more of $R^2$ may be same to each other or different from each other, and when "n" is zero, "A" and "$R^1$" may be bound together to form a ring.

Structural Formula (22)

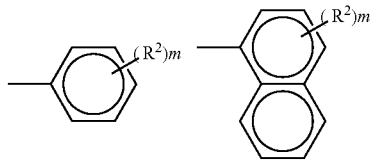

Structural Formula (23)

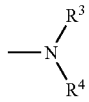

In the Structural Formula (23), $R^3$ and $R^4$ may be same to each other or different from each other and respectively represent an aryl group that may have a substituent group, and $R^3$ and $R^4$ may be bound together to form a ring.

Examples of the compound represented by the Structural Formula (21) include 4'-diphenylamino-α-phenylstilbene, and 4'-bis(4-methylphenyl)amino-α-phenylstilbene.

Structural Formula (24)

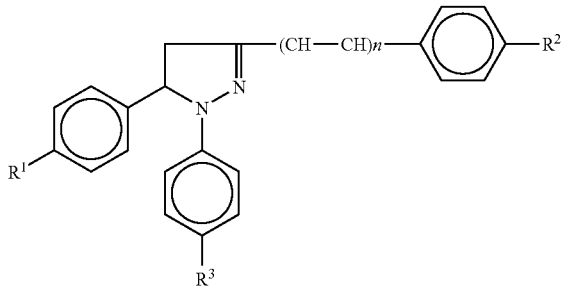

In the Structural Formula (24), $R^1$, $R^2$, and $R^3$ respectively represent a hydrocarbon atom, an alkyl group, an alkoxy group, a halogen atom, or a dialkylamino group; and "n" is an integer or 0 (zero) or 1.

Examples of the compound represented by the Structural Formula (24) include 1-phenyl-3-(4-diethylaminostiryl)-5-(4-diethyleminophenyl)pyrazoline.

Structural Formula (25)

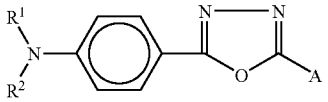

In the Structural Formula (25), $R^1$ and $R^2$ may be same to each other or different from each other and respectively represent an unsubstituted or a substituted alkyl group or an unsubstituted or a substituted aryl group; and "A" represents a substituted amino group, an unsubstituted or a substituted aryl group or an aryl group.

Examples of the compound represented by the Structural Formula (25) include 2,5-bis(4-diethylaminophenyl)-1,3,4-oxadiazole, 2-N,N-diphenylamino-5-(4-diethylaminophenyl)-1,3,4-oxadiazole, and 2-(4-dimethylaminophenyl)-5-(4-diethylaminophenyl)-1,3,4-oxadiazole.

Structural Formula (26)

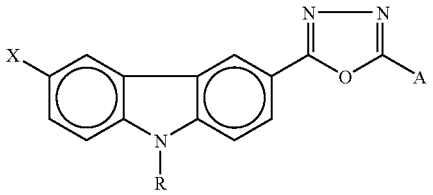

In the Structural Formula (26), X represents a hydrogen atom, an alkyl group or a halogen atom; R represents an alkyl group that may have a substituent group or an aryl group that may have a substituent group; and "A" represents an amino group that may have a substituent group or an aryl group that may have a substituent group.

Examples of the compound represented by the Structural Formula (26) include 2-N,N-diphenylamino-5-(N-ethylcarbazole-3-yl)-1,3,4-oxadiazole, 2-(4-diethylaminophenyl)-5-(N-ethylcarbazole-3-yl)-1,3,4-oxadiazole.

Structural Formula (27)

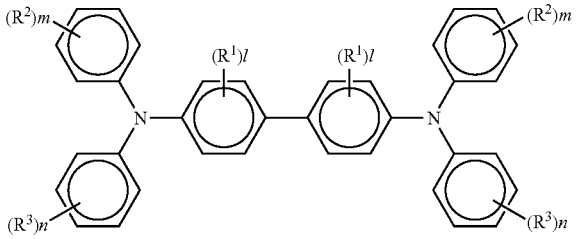

In the Structural Formula (27), $R^1$ represents an alkyl group, an alkoxy group or a halogen atom; $R^2$ and $R^3$ may be same to each other or different from each other and respectively represent a hydrogen atom, an alkyl group, an alkoxy group or a halogen atom; and "l", "m" and "n" are respectively an integer of 0 (zero) to 4.

Examples of a benzidine compound represented by the Structural Formula (27) include N,N'-diphenyl-N,N'-bis(3-methylphenyl)-[1,1'-biphenyl]-4,4'-diamine, 3,3'-dimethyl-N,N,N',N'-tetrakis(4-methylphenyl)-[1,1'-biphenyl]-4,4'-diamine.

Structural Formula (28)

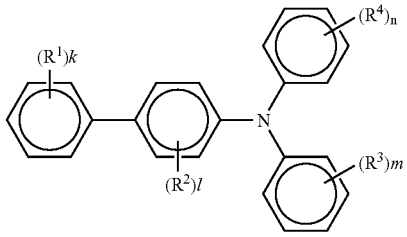

In the Structural Formula (28), $R^1$, $R^3$, and $R^4$ respectively represent a hydrogen atom, an amino group, an alkoxy group, a thioalkoxy group, an aryloxy group, a methylenedioxy group, an alkyl group that may have a substituent group, a halogen atom or an aryl group that may have a substituent group; $R^2$ represents a hydrogen atom, an alkoxy group, an alkyl group that may have a substituent group or a halogen atom, however, the groups mentioned above are excluded in case that all the $R^1$, $R^2$, $R^3$ and $R^4$ are respectively a hydrogen atom; "k", "l", "m" and "n" respectively an integer of 1, 2, 3, or 4, and when each of these is an integer of 2, 3, or 4, the $R^1$, $R^2$, $R^3$, and $R^4$ may be same to each other or different from each other.

Examples of a biphenylamine compound represented by the Structural Formula (28) include 4'-methoxy-N,N-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, N,N-bis(3,4-dimethylphenyl)-[1,1'-biphenyl]-4-amine.

Structural Formula (29)

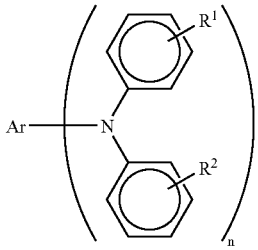

In the Structural Formula (29), Ar represents a condensed polycyclic hydrocarbon group having 18 or less carbon atoms; $R^1$ and $R^2$ may be same to each other or different from each other and respectively represent a hydrogen atom, a halogen atom, an alkyl group that may have a substituent group, an alkoxy group, or a phenyl group that may have a substituent group; and "n" is an integer of 1 or 2.

Examples of the triarylamine compound represented by the Structural Formula (29) include N,N-diphenyl-pyrene-1-amine, N,N-di-p-tolyl-pyrene-1-amine, N,N-di-p-tolyl-1-naphthylamine, N,N-di(p-tolyl)-1-phenantolylamine, 9,9-dimethyl-2-(di-p-tolylamino) fluorene, N,N,N',N'-tetrakis(4-methylphenyl)-phenanthrene-9,10-diamine, and N,N,N',N'-tetrakis(3-methylphenyl)-m-phenylenediamine.

A-CH═CH—Ar—CH═CH-A Structural Formula (30)

In the Structural Formula (30), Ar represents an aromatic hydrocarbon group that may have a substituent group; and "A" is a group represented by the following Structural Formula (31).

Structural Formula (31)

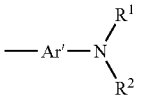

In the Structural Formula (31), Ar' represents an aromatic hydrocarbon group that may have a substituent group; $R^1$ and $R^2$ may be same to each other or different from each other and respectively represent an alkyl group that may have a substituent group or an aryl group that may have a substituent group.

Examples of a diolefin aromatic compound represented by the Structural Formula (3) include 1,4-bis(4-diphenylaminostyryl)benzene, and 1,4-bis[4-di(p-tolyl)aminostyryl]benzene.

Structural Formula (32)

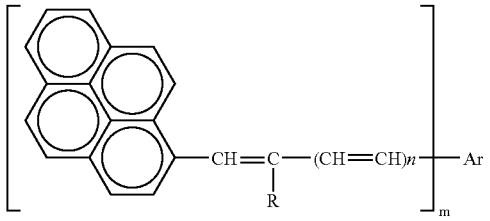

In the Structural Formula (32), Ar represents an aromatic hydrocarbon group that may have a substituent group; R represents a hydrogen atom, an alkyl group that may have a substituent group or an aryl group that may have a substituent group; "n" is an integer of 0 (zero) or 1, "m" is an integer of 1 or 2, and when "n" is equal to zero and "m" is equal to 1, Ar and R may be bound together to form a ring.

Examples of a styrylpyrene compound represented by the Structural Formula (32) include 1-(4-diphenylaminostyryl) pyrene, and 1-(N,N-di-p-tolyl-4-aminostyryl)pyrene.

Examples of other electron-transporting materials include chloranil, bromanil, tetracyanoethylene, tetracyanoquinodimethane, 2,4,7-trinitro-9-fluorene, 2,4,5,7-tetranitro-9-gluorene, 2,4,5,7-tetranitroxanthone, 2,4,8-trinitrothioxanthone, 2,6,8-trinitro-indeno-4H-indeno[1,2-b]thiophene-4-one, and 1,3,7-trinitrodibenzothiophene-5,5-dioxide. Further, electron-transporting materials represented by the following Structural Formula (33), Structural Formula (34), Structural Formula (35) or Structural Formula (36) may be preferably used.

Structural Formula (33)

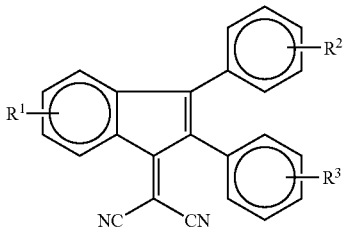

In the Structural Formula (33), $R^1$, $R^2$, and $R^3$ may be same to each other or different from each other and respectively represent a hydrogen atom, a halogen atom, an alkyl group that may have a substituted group, an alkoxy group, or a phenyl group that may have a substituent group.

Structural Formula (34)

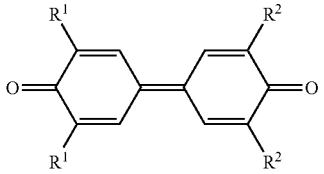

In the Structural Formula (34), $R^1$ and $R^2$ may be same to each other or different from each other and respectively represent a hydrogen atom, an alkyl group that may have a substituent group, or a phenyl group that may have a substituent group.

Structural Formula (35)

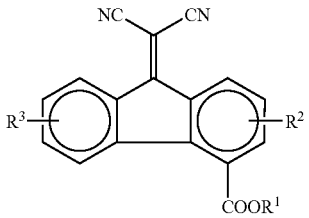

In the Structural Formula (35), $R^1$, $R^2$, and $R^3$ may be same to each other or different from each other and respectively represent a hydrogen atom, a halogen atom, an alkyl group that may have a substituent group, an alkoxy group, or a phenyl group that may have a substituent group.

Structural Formula (36)

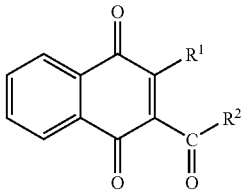

In the Structural Formula (36), $R^1$ represents an alkyl group that may have a substituent group or an aryl group that may have a substituent group; $R^2$ represents an alkyl group that may have a substituent group, an aryl group that may have a substituent group or —O—$R^3$ ($R^3$ represents an alkyl group that may have a substituent group or an aryl group that may have a substituent group).

Among the above-noted specific examples of charge-transporting materials in the chain-polymerizable charge-transporting compound composed of the (B) component, charge-transporting materials represented by the Structural Formula (21), charge-transporting materials represented by the Structural Formula (27), and charge-transporting materials represented by the Structural Formula (28) are more preferable from the perspective of electric properties.

For the chain-polymerizable charge-transporting compound composed of the (B) component, compounds represented by the following Structural Formula (i) and compounds represented by the following Structural Formula (ii) are particularly preferable from the perspective of electric properties.

Structural Formula (i)

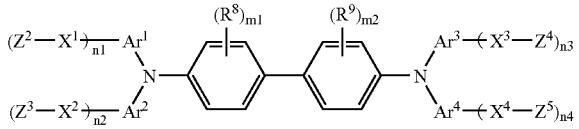

In the Structural Formula (i), $Ar^1$ to $Ar^4$ may be same to each other or different from each other and respectively represent an alkylene group that may have a substituent group or an arylene group that may have a substituent group; $R^8$ and $R^9$ respectively represent an alkyl group, an alkoxy group or a halogen atom; $X^1$ to $X^4$ respectively represent an oxygen atom, a sulfur atom, an alkylene group that may have a substituent group, an allylene group that may have a substituent group or a divalent group that is a combination thereof; $Z^2$ to $Z^5$ respectively represent a chain-polymerizable functional group; "m1" and "m2" are an integer of 0 (zero) to 4; "n1" to "n4" are respectively an integer of 0 (zero) to 5, and at least one of them is an integer of 1 or more.

Structural Formula (ii)

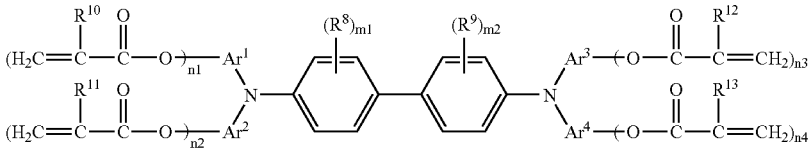

In the Structural Formula (ii), $Ar^1$ to $Ar^4$, $R^8$ to $R^9$, m1 and m2, and n1 to n4 are respectively same ones as those mentioned in the Structural Formula (i); and $R^{10}$ to $R^{13}$ respectively represent a methyl group or a hydrogen atom.

In the Structural Formulas (i) and (ii), the same alkylene group, alkyl group, allylene group, and chain-polymerizable functional group as mentioned in the Structural Formula (1) can be used.

Hereinafter, specific examples of compounds represented by the Structural Formula (i) or (ii) are shown below. The chain-polymerizable charge-transporting compound composed of the (B) component is not limited to the ones disclosed below.

No. 67

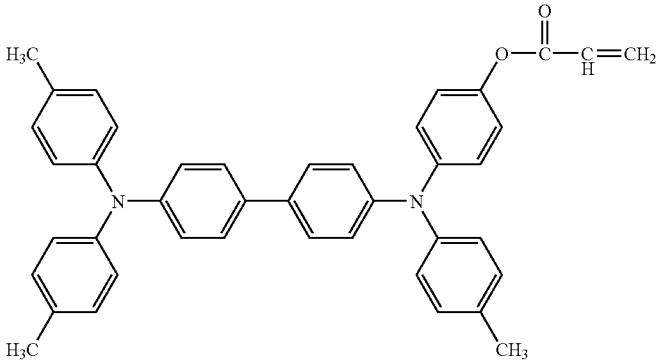

-continued
No. 68
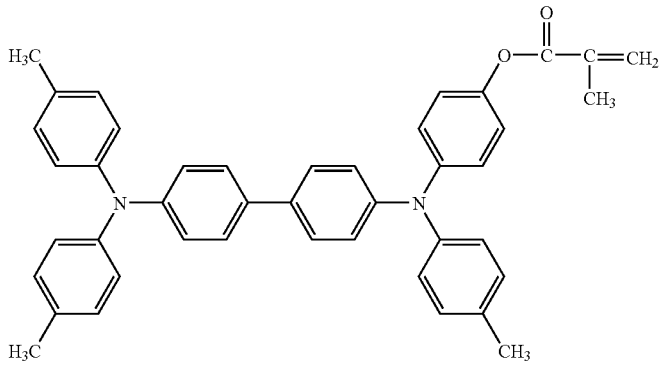
No. 69
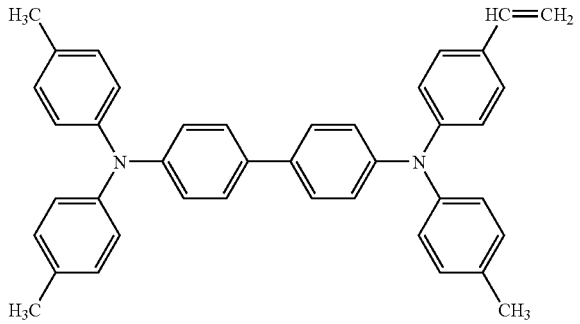
No. 70
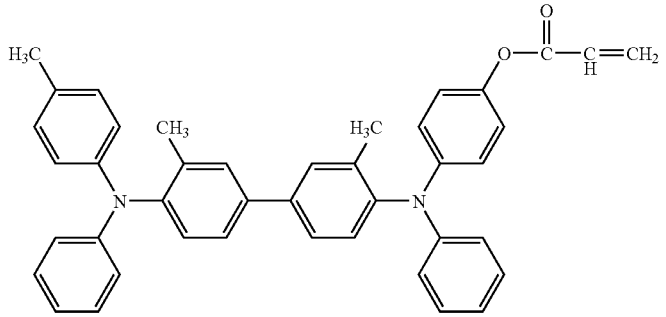
No. 71
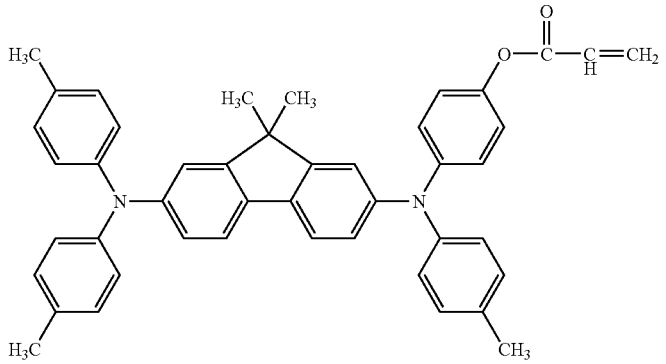

-continued

No. 72

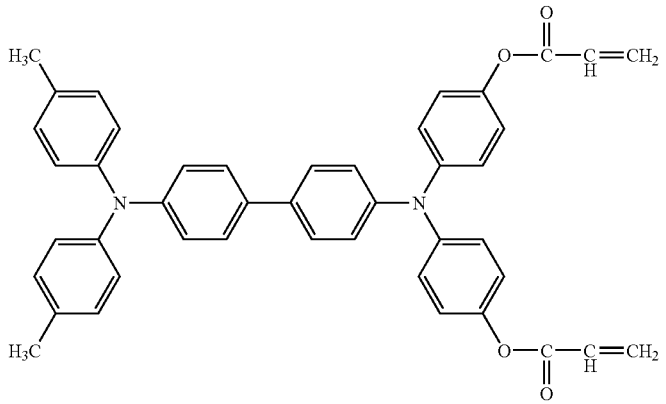

No. 73

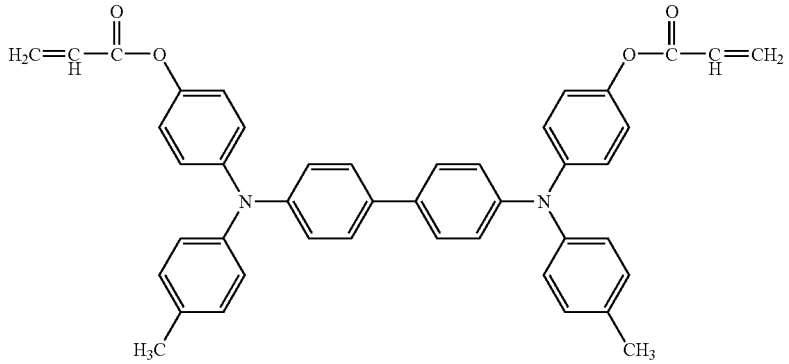

No. 74

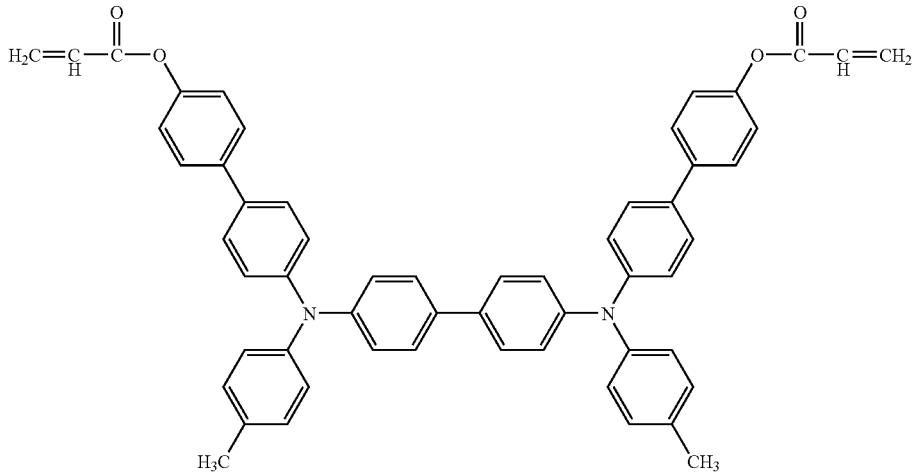

For the chain-polymerizable charge-transporting compound composed of the (B) component, the chain-polymerizable compounds each having a charge-transporting structure described in Japanese Patent Application Laid-Open (JP-A) Nos. 2005-227761, 2004-212959, 2004-258346, and 2001-175016.

The content of the chain-polymerizable charge-transporting compound composed of the (B) component in the hardened material is preferably 20% by mass to 80% by mass, and more preferably 30% by mass to 70% by mass. When the content of the chain-polymerizable charge-transporting compound is less than 20% by mass, the effect of the electrophotographic properties of the chain-polymerizable charge-transporting compound may be reduced to cause degradation in electric properties such as degradation in photosensitivity and increases in residual electric potential due to repetitive use. In contrast, when the content is more than 80% by mass, the content of components other than the (B) component may be reduced to cause a reduction in crosslinking bond density and affect the abrasion resistance, resulting in that high-abrasion resistance cannot be exerted.

-Trifunctional or More Chain-Polymerizable Compound as (C) Component-

The trifunctional or more chain-polymerizable compound composed of the (C) component means monomers having three or more chain-polymerizable functional groups, however, the monomers do not have an electron transporting structure or a group having an electron-transporting structure such as electron hole-transporting structures like triarylamine, hydrozone, pyrazoline, and carbazole, and electron-absorbing aromatic rings like condensed polycyclic quinone, diphenoquinone, or a group indicating an electron-transporting structure like cyano group, and nitro group.

For the chain-polymerizable functional group in the compound composed of the (C) component, the same ones as described in the tertiary amine compound composed of the (A) component can be used.

The trifunctional or more chain-polymerizable compound composed of the (C) component is not particularly limited and may be suitably selected in accordance with the intended use. Examples thereof include trimethylolpropane triacrylate (TMPTA), trimethylolpropane methacrylate trimethylolpropane alkylene-modified triacrylate, trimethylolpropaneethyleneoxy-modified (hereinafter, may be referred to as EO-modified) triacrylate, trimethylolpropane propyleneoxy-modified (hereinafter, may be referred to as "PO-modified") triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified (hereinafter, may be referred to as "ECH-modified") triacrylate, glycerol EO-modified triacrylate, glycerol PO-modified triacrylate, tris(acryloxyethyl) isocyanurate, dipentaerythritol hexaacrylate (DPHA), dipentaerythritol hexaacrylate (DPHA), dipentaerythritol caprolactone-modified hexaacrylate, dipentaerythritol hydroxypentaacrylate, dipentaerythritol caprolactone-modified hexaacrylate, dipentaerythritol hydroxy pentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritol ethoxytetraacrylate, phosphoric acid EO-modified triacrylate, 2,2,5,5-tetrahydroxymethyl cyclopentanone tetraacrylate. Each of these trifunctional or more chain-polymerizable compounds may be used alone or in combination with two or more.

In the present invention, by adding the compound composed of the (C) component to materials of the hardened layer, the three-dimensionally crosslinking bond density of a layer containing the hardened material is further increased. With the use of the compound composed of the (C) component, a photoconductor which is further excellent in abrasion resistance can be obtained. For the (C) component, in order to form a dense crosslinking bond in the layer containing the hardened material, the ratio of the molecular mass relative to the number of functional groups in the monomer (molecular mass/the number of functional groups) is preferably 250 or less. When the ratio is more than 250, the outermost surface layer is soft and the abrasion resistance slightly may sometimes degrade. Therefore, among the monomers exemplified above, for the monomers having an EO-modified group, a PO-modified group, a caprolactone-modified group or the like, it is not preferable to use the monomer having an extremely long modified group singularly.

The content of the (C) component used for the layer cannot be uniformly defined because the required electric properties and abrasion resistance differ depending on the used process, however, the content of the (C) component is preferably 20% by mass to 80% by mass, and more preferably 30% by mass to 70% by mass relative to the total component of a composition used for the hardened material. Virtually, the content of the (C) component depends on the ratio of the (C) component in the solid content of the coating solution. When the content of the (C) component is less than 20% by mass, the effect of adding the (C) component is small, and when the content of the (C) component is greater than 80% by mass, the content of the charge transporting compound is reduced to cause degradation in electric properties. In consideration of balance of both properties, i.e., the balance of the abrasive resistance and the electrostatic properties, and effects thereof, it is most preferable to set the content of the (C) component in a range of 30% by mass to 70% by mass.

-Photopolymerization Initiator as (D) Component-

The photopolymerization initiator composed of the (D) component is not particularly limited and may be suitably selected in accordance with the intended use. Examples thereof include acetophenone photopolymerization initiators, ketal photopolymerization initiators, benzoin-ether photopolymerization initiators, benzophenone photopolymerization initiators, thioxanthone photopolymerization initiators and other photopolymerization initiators. Each of these photopolymerization initiators may be used alone or in combination with two or more.

Specific examples of the acetophenone photopolymerization initiators or ketal photopolymerization initiators include diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1,2-hydroxy-2-methyl-1-phenylpropane-1-one, 2-methyl-2-morpholino (4-methylthiophenyl) propane-1-one, and 1-phenyl-1,2-propanedione-2-(o-ethoxycarbonyl) oxime.

Specific examples of the benzoin ether photopolymerization initiators include benzoins, benzoin methyl ethers, benzoin ethyl ethers, benzoin isobutyl ethers, and benzoin isopropyl ethers.

Specific examples of the benzophenone photopolymerization initiators include benzophenone, 4-hydroxybenzophenone, o-methyl benzoyl benzoate, 2-benzoylnephthalene, 4-benzoylbiphenyl, 4-benzoylphenylehter, acrylated benzophenone, and 1,4-benzoylbenzene.

Examples of the thioxanthone photopolymerization initiators include 2-isopropylthioxanthone, 2-chlorothioxanthone, 2,4-dimethylthioxanthone, 2,4-diethylthioxanthone, and 2,4-dichlorothioxanthone.

Examples of the other photopolymerization initiators include ethylanthraquinone, 2,4,6-trimethylbenzoyldiphenylphosphine oxide, 2,4,6-trimethylbenzoylphenylethoxyphosphine oxide, bis (2,4,6-trimethylbenzoyl)phenylphosphine oxide, bis(2,4-dimethoxybenzoyl)-2,4,4-trimethylpentylphosphine oxide, methylphenyl glyoxyester, 9,10-phenanthrene, acridine compounds, triazine compounds, and imidazole compounds.

Also, a compound having photopolymerization accelerating effect can be used alone or in combination with the above-noted photopolymerization initiator. For example, triethanol amine, methyldiethanol amine, 4-ethyl dimethylamino benzoate, 4-isoamyl dimethylamino benzoate, ethyl (2-dimethylamino) benzoate, and 4,4'-dimethylaminobenzophenone are exemplified.

In the present invention, by adding the (D) component to materials of the hardened layer, chain polymerization reaction uniformly proceeds over the entire film when forming the hardened material, and then a photoconductor having a small surface roughness can be obtained.

The content of the photopolymerization initiator composed of the (D) component is preferably 0.5% by mass to 40% by mass and more preferably 1% by mass to 20% by mass relative to the total content of the chain-polymerizable compound. When the content of the (D) component is less than 0.5% by mass, the layer containing the hardened material is not uniformly formed, and abrasion resistance degrades locally. When the content of the (D) component is more than 40% by mass, the electric properties may sometimes degrade.

-Method of Forming a Layer Containing the Hardened Material-

The method of forming a layer containing the hardened material will be described below.

The hardened material used in the present invention can be formed by preparing a coating solution containing a chain-polymerizable tertiary amine compound composed of the (A) component, i.e., a chain-polymerizable group-containing tertiary amine compound in which at least one alkyl group is bound to a nitrogen atom constituting an amine structure, and applying the coating solution over the surface of a photoconductor, and then applying a light beam to the photoconductor surface to polymerize the photoconductor surface.

The coating solution is diluted with a solvent where necessary and then applied over the surface of a photoconductor. Examples of the solvent used here include alcohols such as methanol, ethanol, propanol, and butanol; ketones such as acetone, methylethylketone, methylisobutylketone, and cyclohexanone; esters such as ethyl acetate and butyl acetate; halogens such as dichloromethane, dichloroethane, trichloroethane, and chlorobenzene; aromatics such as benzene, toluene, and xylene; and cellosolves such as methylcellosolve, ethyl cellosolve, and cellosolve acetate. Each of these solvents may be used alone or in combination with two or more. The dilution rate of the coating solution with the use of the solvent differs depending on the solubility of the composition, the coating method, and an intended thickness of a layer to be formed, and the dilution rate can be arbitrarily determined. When a coating solution is prepared and any one of the (A) component, the (B) component, the (C) component, and the (C) component is a liquid, it is also possible to dissolve the other components in the liquid component and apply the solution over the photoconductor surface.

For the coating solution, it is possible to use a monofunctional and a bifunctional chain-polymerizable monomer and a chain-polymerizable oligomer in combination with the (A), (B), (C), and (D) components for the purpose of giving functions such as control of the viscosity of the coating solution at the time of coating the photoconductor surface, alleviation of stress applied on the outermost surface layer, and lowering the surface energy, and reduction in the abrasion coefficient. For the chain-polymerizable monomer and oligomer, those known in the art can be utilized, and examples thereof include monofunctional radical monomers, bifunctional chain-polymerizable monomers, functional monomers, and chain-polymerizable oligomers.

Examples of the monofunctional radical monomer include 2-ethylhexyl acrylates, 2-hydroxyethyl acrylates, 2-hydroxypropyl acrylates, tetrahydroflufrill acrylates, 2-ethylhexylcarbitol acrylates, 3-methoxybutyl acrylates, benzyl acrylates, cyclohexyl acrylates, isoamyl acrylates, isobutyl acrylates, methoxy triethylene glycol acrylates, phenoxytetraethylene glycol acrylates, cetyl acrylates, isostearyl acrylates, stearyl acrylates, and styrene monomers.

Examples of the bifunctional chain-polymerizable monomer include 1,3-butanedioldiacrylates, 1,4-butanedioldiacrylates, 1,4-butandioldimethacrylates, 1,6-hexanedioldiacrylates, 1,6-hexanedioldimethacrylates, diethyleneglycoldiacrylates, neopentyl glycol diacrylates bisphenol A-EO-modified diacrylates, bisphenol F-EO-modified diacrylates, and neopentyl glycol diacrylates.

Examples of the functional monomer include fluorine atom-substituents such as octafluoropentyl acrylates, 2-perfluorooctyl ethyl acrylates, and 2-perfluoroisononyl ethyl acrylate; vinyl monomers each having a polysiloxane group with a repeating unit of 20 to 70 described in Japanese Patent Application Publication (JP-B) Nos. 5-60503 and 6-45770 such as acryloyl polydimethylsiloxane ethyl, methacryloyl polydimethylsiloxane ethyl, acryloyl polydimethylsiloxane propyl, acryloyl polydimethylsiloxane butyl, and diacryloyl polydimethylsiloxane diethyl; acrylates, and methacrylates.

Examples of the chain-polymerizable oligomers include epoxyacrylates oligomers, urethane acrylate oligomers, polyester acrylate oligomers.

When a monofunctional and/or a bifunctional chain-polymerizable monomer and/or a chain-polymerizable oligomer are contained in a large amount, the three-dimensional crosslinking density of the hardened material may be substantially reduced to cause degradation in properties. Therefore, the content of the monomer and/or the oligomer is 50% by mass or less and more preferably 30% by mass or less relative to the content of the (C) component.

Further, various plasticizers (to alleviate stress and to improve adhesiveness) and additives such as a leveling agent, and low-molecular weight charge transporting materials having no radical reactivity can be contained in the coating solution for the layer containing a hardened material in accordance with the necessity. For these additives, those known in the art can be used.

For the plasticizer, plasticizers that are used in typical resins such as dibutylphthalate, and dioctylphthalate can be utilized, and the content of the plasticizer is preferably 20% by mass or less and more preferably 10% by mass or less relative to the total solid content of the coating solution.

For the leveling agent, a silicone oil such as dimethyl silicone oil, methylphenyl silicone oil; and a polymer or an oligomer having a perfluoroalkyl group in their side chains can be utilized. The appropriate content of the leveling agent is 3% by mass or less relative to the total solid content of the coating solution.

After applying the coating solution over the photoconductor surface, in some situations, a drying step is included in the forming process, and then the photoconductor surface is hardened by irradiating the photoconductor surface with a light beam. For the irradiation of the photoconductor surface with a light beam, typically, a high-pressure mercury lamp having an emission wavelength region of ultraviolet ray and a UV irradiation light source such as metal halide lamp can be utilized, however, it is also possible to select a light source for visible light in accordance with the absorption wavelength of the chain-polymerizable material and the photopolymerization initiator. The optical energy of the light beam irradiation is preferably 50 $mW/cm^2$ to 2,000 $mW/cm^2$. When the optical energy of the light beam irradiation is less than 50 $mW/cm^2$, it may take time to complete a hardening reaction. When the optical energy of the light beam irradiation is more than 2,000 $mW/cm^2$, the hardening reaction proceeds nonuniformly to cause local wrinkles on the outermost surface layer, and to cause a number of unreacted residues and reaction-stopped terminals on the layer. A rapid crosslinking reaction may increase the internal stress, resulting in a cause of cracks and film exfoliation. Further, when the photoconductor surface is irradiated with a light beam, a nitrogen substitution may be carried out to prevent polymerization inhibition by utilizing the effect of oxygen. The photoconductor surface may be irradiated with a light beam in succession or at intervals multiple times.

As a similar means to the light beam irradiation, it is also possible to use electron beam irradiation. However, it is preferable to use one utilizing light energy from the perspective of easy control of reaction rate and simple equipment. In the case of electron beam irradiation, the photopolymerization initiator is not necessarily used.

After the photoconductor surface with a coating solution applied thereon is hardened by light beam irradiation, the hardened layer is annealed at 80° C. to 150° C., and the photoconductor is used as an electrophotographic photoconductor. The annealing time is about 1 minute to 60 minutes.

The layer configuration of the electrophotographic photoconductor of the present invention is not particularly limited and may be suitably selected in accordance with the intended use, however, it is preferable that a layer containing the hardened material constitutes the outermost surface layer.

Examples of the outermost surface layer used in laminate-type photoconductors are a charge-transporting layer or a protective layer. For the outermost surface layer used in single layer-type photoconductors, a photosensitive layer or a protective layer is preferably exemplified.

Of these layers, the layer containing the hardened material is particularly preferably a protective layer because the limitations on the hardening reaction conditions are reduced.

The thickness of the protective layer is preferably 1 μm to 20 μm and more preferably 3 μm to 15 μm. When the thickness of the protective layer is more than 20 μm, cracks and film exfoliation easily occur, and chain-polymerization hardly occur in deep parts of the protective layer, and it is difficult to form a layer having high-crosslinking density. When chain polymerization reaction proceeds by radicals, the protective layer is susceptible to oxygen inhibition, and crosslinking reaction hardly proceeds due to effect of radical trap of the oxygen on the surface contacting air, and a film is easily uneven in thickness. The effect of radical trap of the oxygen is most obvious when the thickness of the protective layer is less than 1 μm, the protective layer easily suffers from degradation in abrasion resistance and nonuniform abrasion. For these reasons, the thickness of the protective layer is preferably 1 μm or more. A reduced thickness caused by abrasion in repetitive use easily leads to locally intensive chargeability and fluctuation in photosensitivity, and thus it is preferable to set the thickness of the protective layer to be 3 μm or more from the perspective of longer operating life.

Here, the layer configuration of the electrophotographic photoconductor of the present invention will be described with reference to the drawings. FIGS. 1 to 4 are respectively a schematic view exemplarily showing an electrophotographic photoconductor of the present invention.

In an aspect of a layer configuration shown in FIG. 1, a photosensitive layer 3 containing a charge generating material and a charge transporting material as the main component is formed on a substrate 1.

Figure 2:
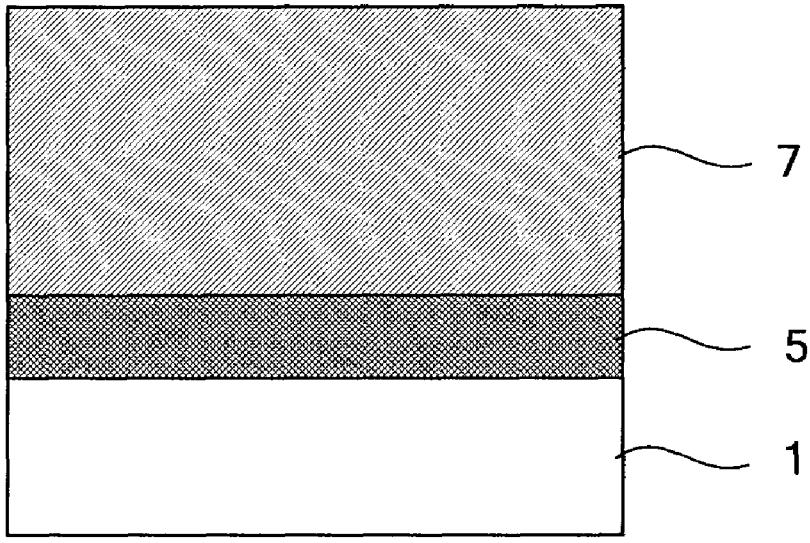
FIG. 2 is a schematic cross-sectional view exemplarily showing another layer configuration of a single layer electrophotographic photoconductor of the present invention.

In another aspect of a layer configuration shown in FIG. 2, a charge generating layer 5 containing a charge generating material as the main component, and a charge transporting layer 7 containing a charge-transporting material as the main component are formed in a laminate as a photosensitive layer on a substrate 1.

Figure 3:
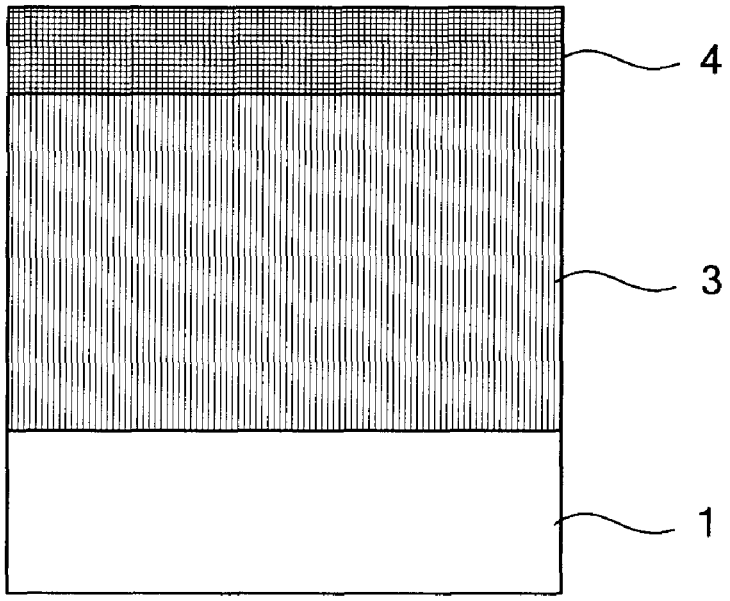
FIG. 3 is a schematic cross-sectional view exemplarily showing a layer configuration of a laminate type electrophotographic photoconductor of the preset invention.

In a still another aspect of a layer configuration shown in FIG. 3, a photosensitive layer 3 containing a charge generating material and a charge-transporting material as the main component is formed on a substrate 1, and a protective layer 4 is further formed on the photosensitive layer.

Figure 4:
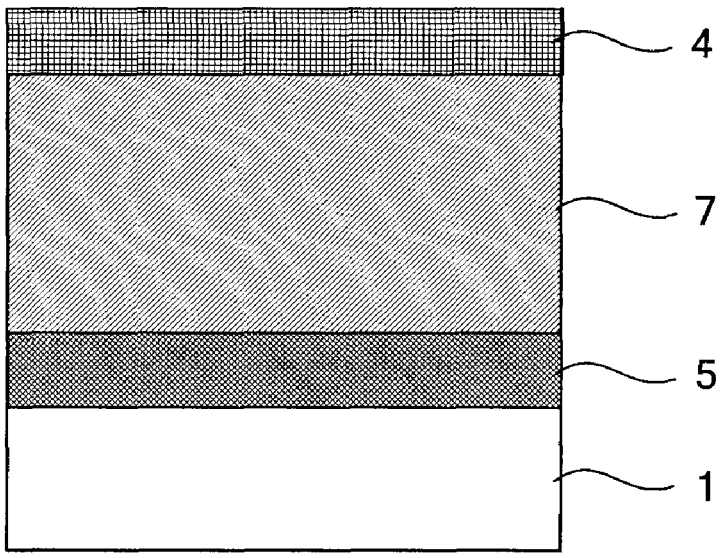
FIG. 4 is a schematic cross-sectional view exemplarily showing another layer configuration of a laminate type electrophotographic photoconductor of the preset invention.

In a still another aspect of a layer configuration shown in FIG. 4, a charge generating layer 5 containing a charge generating material as the main component and a charge transporting layer 7 containing a charge-transporting as the main component are formed in a laminate as a photosensitive layer on a substrate 1, and a protective layer 4 is further formed on the charge transporting layer 7.

-Substrate-

Material of the substrate is not particularly limited as long as it can exert conductivity of volume resistance of $10^{10}\Omega\cdot$cm or less, and may be suitably selected in accordance with the intended use. For example, it is possible to use the one that is prepared by a method in which a film-like or cylindrical plastic or paper is plated with a metal such as aluminum, nickel, chrome, copper, gold, silver and platinum; or a metal oxide such as tin oxide, and indium oxide by vapor deposition or sputtering, or a tube prepared by subjecting a plate such as aluminum, aluminum alloy, nickel, and stainless-steel to treatments such as extrusion and drawing to form a tube, and subjecting the tube to a surface treatment such as machined surface, superfinishing, and polishing. In addition, an endless nickel belt and an endless stainless-steal belt disclosed in Japanese Patent Application Laid-Open (JP-A) No. 52-36016 can also be used as the substrate.

Besides, a substrate prepared by the following method can be used as the substrate of the present invention in which a conductive powder is dispersed in a proper binder resin, and the dispersion is applied over a surface of the substrate.

Examples of the conductive powder include carbon black, acetylene black; metal powders such as aluminum, nickel, iron, nichrome, copper, zinc and silver; or metal oxide powders such as conductive tin oxide and ITO. Examples of the binder resin used together with the conductive powder include thermoplastic or thermosetting or photo-setting resins such as polystyrene resins, styrene-acrylonitrile copolymers, styrene-butadiene copolymers, styrene-maleic acid anhydride copolymers, polyester resins, polyvinyl chloride resins, vinyl-chloride-vinyl acetate copolymers, polyvinyl acetate resins, polyvinylidene chloride resins, polyacrylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole, acrylic resins, silicone resins, epoxy resins, melamine resins, urethane resins, phenol resins, and alkyd resins.

The conductive layer can be formed by dispersing the conductive powder and the binder resin in a proper solvent such as tetrahydrofuran, dichloromethane, methylethylketone, and toluene and applying the dispersion over the substrate surface.

Further, the conductive powder is contained in a material such as polyvinyl chloride, polypropylene, polyester, polystyrene, polyvinylidene chloride, polyethylene, chlorinated rubber, TEFLON, and the mixture is applied over the surface of a cylindrical base to thereby form a heat shrinkable tube having a conductive layer. Such a substrate prepared as described above can also be preferably used as the substrate of the present invention.

Next, the photosensitive layer will be described below. The photosensitive layer of the present invention contains the (A) component as the active component. The photosensitive layer may be formed in a single layer or a laminate. First, a case that a charge generating layer and a charge transporting layer are formed in a laminate which constitutes a photosensitive layer will be described below.

-Charge Generating Layer-

The charge generating layer contains at least a charge generating material and a binder resin, and may further contain other components in accordance with the intended use.

For the charge generating material, an inorganic material and an organic material can be used.

Examples of the inorganic material include crystal selenium, amorphous-selenium, selenium-tellurium, selenium-tellurium-halogen, selenium-arsenic compounds and amorphous-silicon. For the amorphous-silicon, the one that a dangling-bond is terminated with hydrogen atom or halogen atom, or a dangling-bond is doped with boron atom, phosphorus atom, etc is preferably used.

The organic material is not particularly limited and may be suitably selected from among those known in the art in accordance with the intended use. Examples thereof include phthalocyanine pigments such as metal phthalocyanine, metal-free phthalocyanine, azulenium salt pigments, squaric acid methine pigments, azo pigments each having a carbazole skeleton, azo pigments each having a triphenylamine skeleton, azo pigments each having a diphenylamine skeleton, azo pigments each having a dibenzothiophene skeleton, azo pigments each having a fluorenone skeleton, azo pigments each having an oxadiazole skeleton, azo pigments each having a bisstilbene skeleton, azo pigments each having a distyryloxadiazole skeleton, azo pigments each having a distyrylcarbazole skeleton, perylene pigments, anthraquinone or polycyclic quinone pigments, quinoneimine pigments, dipehnylmethane and triphenylmethane pigments, benzoquinone and naphthoquinone pigments, cyanine and azomethine pigments, indigoid pigments, and bisbenzimidazole pigments. Each of these organic materials may be used alone or in combination with two or more.

The binder resin is not particularly limited and may be suitably selected in accordance with the intended use. Examples thereof include polyamide resins, polyurethane resins, epoxy resins, polyketone resins, polycarbonate resins, silicone resins, acrylic resins, polyvinylbutyral resins, polyvinylformal resins, polyvinylketones resins, polystyrene resins, poly-N-vinyl carbazole resins, and polyacrylamide resins. Each of these binder resins may be used alone or in combination with two or more.

For the binder resin used for the charge generating layer, besides the binder resins set forth above, polymer charge transporting materials each having charge transportability such as (1) polymer materials such as polycarbonate, polyester, polyurethane, polyether, polysiloxane, and acrylic resin each having an arylamine skeleton, a benzidine skeleton, a hydrazone skeleton, a carbazole skeleton, a stilbene skeleton, a pyrazoline skeleton or the like, and (2) polymer materials each having a polysilane skeleton.

Specific examples of the polymer materials (1) include charge transporting polymer materials described in Japanese Patent Application Laid-Open (JP-A) Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-239049, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539.

Specific examples of the polymer materials (2) include polysilylene polymers described in Japanese Patent Application Laid-Open (JP-A) Nos. 63-285552, 05-19497, 05-70595, and 10-73944.

Further, in the charge generating layer, a low-molecular weight charge transporting material can be contained.

The low-molecular weight charge transporting materials are classified broadly into electron hole transporting materials and electron transporting materials.

Examples of the electron transporting material include chloranil, bromanil, tetracyano ethylene, tetracyano quinodimethane, 2,4,7-trinitro-9-fluolenone, 2,4,5,7-tetranitro-9-fluolenone, 2,4,5,7-tetranitroxanthone, 2,4,8-trinitrothioxanthone, 2,6,8-trinitro-4H-indeno[1,2-b]thiophene-4-one, 1,3,7-trinitrodibnezothiophene-5,5-dioxide, and diphenoquinone derivatives. Each of these electron transporting materials may be used alone or in combination with two or more.

Examples of the electron hole transporting materials include oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, and other conventional materials. Each of these electron hole transporting materials may be used alone or in combination with two or more.

For the method of forming the charge generating layer, vacuum thin-film forming method and casting method using a dispersion solution are roughly exemplified.

For the vacuum thin-film forming method, for example, vacuum evaporation method, glow discharge decomposition method, ion-plating method, sputtering method, reactive sputtering method, and CVD method can be used.

In the casting method, a charge generating layer can be formed by dispersing the inorganic or organic charge generating materials, and when necessary, the binder resin in a solvent such as tetrahydrofuran, dioxane, dioxolane, toluene, dichloromethane, monochlorobenzene, dichloroethane, cyclohexane, cyclopentanon, anisole, xylene, methylethylketone, acetone, ethyl acetate, butyl acetate using a ball mill, an attritor, a sand mill, or a bead mill and appropriately diluting the dispersion and applying the diluent over a surface of a substrate. In addition, in accordance with the necessity, leveling agents such as dimethyl silicone oil, methylphenyl silicone oil can be added to the dispersion. The substrate surface can be coated by immersion coating method, spray-coating method, bead-coating method, ring coating method, or the like.

The thickness of the charge generating layer is not particularly limited and may be suitably adjusted in accordance with the intended use, however, it is preferably 0.01 μm to 5 μm and more preferably 0.05 μm to 2 μm.

-Charge Transporting Layer-

The charge transporting layer is a layer to retain electrification charge and to transport electric charge generated and separated from the charge generating layer by means of exposure to thereby bind the electric charge with the electrification charge. To achieve the object to retain electrification charge, it requires high electric resistance. To achieve the object to obtain a high-surface electric potential with the use of the retained electrification charge, it requires a low-dielectric constant and excellent charge transportability.

The charge transporting layer contains at least a charge transporting material and a binder resin and further contains other components in accordance with the necessity.

Examples of the charge transporting material include electron hole transporting materials, electron transporting materials, and macromolecule charge transporting materials.

Examples of the electron transporting material (electron-accepting material) include chloranil, bromanil, tetracyanoethylene, tetracyanoquinodimethane, 2,4,7-trinitro-9-fluolenone, 2,4,5,7-tetranitro-9-fluolenone, 2,4,5,7-tetranitroxantone, 2,4,8-trinitrothioxantone, 2,6,8-trinitro-4H-indeno[1,2-b]thiophene-4-one, and 1,3,7-trinitrodibenzothiophene-5,5-dioxide. Each of these may be used alone or in combination with two or more.

Examples of the electron hole transporting material (electron-donating material) include oxazole derivatives, oxadiazole derivatives, imidazole derivatives, triphenylamine derivatives, 9-(p-diethylaminostyryl anthracene), 1,1-bis-(4-dibenzylaminophenyl) propane, styrylanthracene, styrylpyrazoline, styrylpyrazoline, phenylhydrazones, α-phenylstilbene derivatives, thiazole derivatives, triazole derivatives, phenazine derivatives, acridine derivatives, benzofuran derivatives, benzimidazole derivatives, and thiophene derivatives. Each of these may be used alone or in combination with two or more.

For the macromolecule charge transporting material, materials each having the following structure are exemplified.

With respect to (a) polymer having a carbazole ring, for example, poly-N-vinylcarbazole, and the compounds described in Japanese Patent Application Laid-Open (JP-A) Nos. 50-82056, 54-9632, 54-11737, 4-175337, 4-183719, and 6-234841 are exemplified.

With respect to (b) polymer having a hydrazone structure, for example, the compounds described in Japanese Patent Application Laid-Open (JP-A) Nos. 57-78402, 61-20953, 61-296358, 1-134456, 1-179164, 3-180851, 3-180852, 3-50555, 5-310904, and 6-234840 are exemplified.

With respect to (c) polysilylene polymer, for example, the compounds described in Japanese Patent Application Laid-Open (JP-A) Nos. 63-285552, 1-88461, 4-264130, 4-264131, 4-264132, 4-264133, and 4-289867 are exemplified.

With respect to (d) polymer having a triarylamine structure, for example, N,N-bis(4-methylphenyl)-4-aminopolystyrene, and the compounds described in Japanese Patent Application Laid-Open (JP-A) Nos. 1-134457, 2-282264, 2-304456, 4-133065, 4-133066, 5-40350, and 5-202135 are exemplified.

With respect to (e) other polymers, for example, nitropyrene-formaldehyde condensed polymers, and the compounds described in Japanese Patent Application Laid-Open (JP-A) Nos. 51-73888, 56-150749, 6-234836, and 6-234837 are exemplified.

For the macromolecule charge transporting material, besides those described above, polycarbonate resins each having a triarylamine structure, polyurethane resins each having a triarylamine structure, polyester resins each having a triarylamine structure, and polyether resins each having a triarylamine structure are exemplified. Specific examples of the macromolecule charge transporting material include the compounds described in Japanese Patent Application Laid-Open (JP-A) Nos. 64-1728, 64-13061, 64-19049, 4-11627, 4-225014, 4-230767, 4-320420, 5-232727, 7-56374, 9-127713, 9-222740, 9-265197, 9-211877, and 9-304956.

For the polymer having an electron-donating group, not only the polymers described above but also conventional copolymers each of which is polymerized with a monomer, block polymers, graft polymers, and star polymers, and for example, the crosslinked polymers each having an electron-donating group as disclosed in Japanese Patent Application Laid-Open (JP-A) No. 3-109406, and the like can be used.

Examples of the binder resin include polycarbonate resins, polyester resins, methacrylic resins, acrylic resins, polyethylene resins, polyvinyl chloride resins, polyvinyl acetate resins, polystyrene resins, phenol resins, epoxy resins, polyurethane resins, polyvinylidene chloride resins, alkyd resins, silicone resins, polyvinyl carbazole resins, polyvinyl butyral resins, polyvinylformal resins, polyacrylate resins, polyacrylamide resins, and phenoxy resins. Each of these binder resins may be used alone or in combination with two or more.

The charge transporting layer may contain a copolymer between a crosslinkable binder resin and a crosslinkable charge transporting material.

The charge transporting layer can be formed by dissolving or dispersing the charge transporting material and the binder resin in a proper solvent, applying the dispersion over a surface of a substrate, and drying the substrate surface. The charge transporting layer may contain additives such as a plasticizer, an antioxidant, and a leveling agent in an appropriate amount in accordance with the necessity, besides the charge transporting material and the binder resin.

For the solvent used for applying the dispersion for a charge transporting layer, the same solvent as used for the charge generating layer can be used, however, a solvent capable of dissolving the charge transporting material and the binder resin well is suitably utilized. Each of these solvents may be used alone or in combination with two or more. The charge transporting layer can be formed by a similar coating method to that used in the formation of the charge generating layer 35.

Further, a plasticizer and a leveling agent can be added to the dissolution used for forming a charge transporting layer.

For the plasticizer, for example, plasticizers typically used for resins such as dibutylphthalate and dioctylphthalate can be directly used, and the used amount of the plasticizer is typically 0 (zero) parts by mass to 30 parts by mass relative to 100 parts by mass of the binder resin.

For the leveling agent, oils such as dimethyl silicone oil, and methylphenyl silicone oil; polymers or oligomers each having a perfluoroalkyl group in the side chains thereof can be used, and the used amount of the leveling agent is 0 (zero) parts by mass to 1 part by mass relative to 100 parts by mass of the binder resin.

The thickness of the charge transporting layer is not particularly limited and may be suitably adjusted in accordance with the intended use, however, it is preferably 5 μm to 40 μm and more preferably 10 μm to 30 μm.

Next, a case that the photosensitive layer is formed in a single layer will be described below. A photoconductor in which the above-noted charge generating material is dispersed in a binder resin can be used. The photosensitive layer can be formed by dissolving or dispersing a charge generating material, a charge transporting material, and a binder resin in a proper solvent, applying the dispersion over a surface of a substrate, and drying the substrate surface. Further, a plasticizer, a leveling agent, an antioxidant, and the like can be added where necessary to the dispersion used for forming a photosensitive layer.

For the binder resin, besides the binder resins mentioned above for the charge generating layer, the binder resins exemplarily mentioned for the charge transporting layer may be used. The macromolecule charge transporting materials set forth above can also be preferably used. The content of the charge generating material is preferably 5 parts by mass to 40 parts by mass, more preferably 0 (zero) parts by mass to 190 parts by mass, and still more preferably 50 parts by mass to 150 parts by mass relative to 100 parts by mass of the binder resin.

The photosensitive layer can be formed by dispersing a charge generating material, a binder resin, and a charge transporting material in a solvent such as tetrahydrofuran, dioxane, dichloroethane, and cyclohexane using a dispersing device to prepare a coating solution, and applying the coating solution over a surface of a substrate by immersion coating, spray-coating, bead-coating, ring-coating, or the like.

The thickness of the single-layered photosensitive layer is not particularly limited and may be suitably adjusted in accordance with the intended use, however, it is preferably 5 μm to 35 μm.

In the electrophotographic photoconductor of the present invention an intermediate layer may be formed between the charge transporting layer and the protective layer or between the photosensitive layer and the protective layer to prevent the components of the charge transporting layer from being mixed in the protective layer or to improve adhesiveness of the two layers.

For the intermediate layer, a layer which is insoluble in or hardly soluble in a coating solution for a protective layer is suitable. Generally, the intermediate layer is primarily composed of a binder. Examples of such a resin include polyamides, alcohol-soluble nylons, water-soluble polyvinyl butyrals, polyvinyl butyrals, and polyvinyl alcohols. For the method of forming an intermediate layer, a typically used coating method is employed, as mentioned above. The thickness of the intermediate layer is preferably 0.05 μm to 2 μm.

In the electrophotographic photoconductor of the present invention, an undercoat layer may be formed between the substrate and the photosensitive layer. Generally, the undercoat layer is primarily composed of a resin, however, in consideration of applying a solvent for a photosensitive layer to the resin, it is desired that the resin be a resin having high resistance to typically used organic solvents. Examples of the resin include water-soluble resins such as polyvinyl alcohol, casein, and sodium polyacrylate; alcohol-soluble resins such as copolymerizable nylons, methoxymethylated nylons; and curable resins forming a three-dimensional network structure such as polyurethane, melamine resins, phenol resins, alkyd-melamine resins, and epoxy resins. To the undercoat layer, a fine powder pigment of a metal oxide such as titanium oxide, silica, alumina, zirconium oxide, tin oxide, and indium oxide may be further added to the undercoat layer to prevent moiré and to reduce residual electric potential.

For the undercoat layer, a layer formed by anodic oxidizing $Al_2O_3$, and a layer formed by vacuum thin-layer forming method using an organic material such as polyparaxylylene (parylene) or an inorganic material such as $SiO_2$, $SnO_2$, $TiO_2$, ITO, and $CeO_2$ can be preferably used. Besides, those known in the art can also be used.

The undercoat layer can be formed by a proper coating method using a proper solvent, as described in the photosensitive layer. Further, for the undercoat layer used in the present invention, a silane coupling agent, a titanium coupling agent, a chrome coupling agent and the like can be used.

The thickness of the undercoat layer is not particularly limited and may be suitably adjusted in accordance with the intended use, however, it is preferably 0 (zero) μm to 5 μm.

In the electrophotographic photoconductor of the present invention, an antioxidant can be added to respective layers such as the photosensitive layer, the protective layer, the charge transporting layer, the charge generating layer, the undercoat layer, and the intermediate layer in order to improve resistance to environment, particularly in order to prevent a reduction in photosensitivity and an increase in residual electric potential.

Examples of the antioxidant include phenol compounds, paraphenylenediamines, hydroquinones, organic sulfur compounds, and organic phosphorous compounds. Each of these antioxidants may be used alone or in combination with two or more.

Examples of the phenol compound include 2,6-di-t-butyl-p-cresol, butylated hydroxyanisole, 2,6-di-t-butyl-4-ethylphenol, stearyl-β-(3,5-di-t-butyl-4-hydroxyphenyl) propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl) butane, 1,3,5-trimethyl-2,4,6-tris(3,5-di-t-butyl-4-hydroxybenzyl)benzene, tetrakis-[methylene-3-(3'5'-di-t-butyl-4'-hydroxyphenyl)propionate]methane, bis [3,3'-bis(4'-hydroxy-3'-t-butylphenyl) butylic acid]clycol ester, and tocopherols.

Examples of the paraphenylenediamines include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinones include 2,5-di-t-octylhydroquine, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methyl hydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorous compounds include triphenylphosphine, tri(nonylphenyl) phosphine, tri(dinonylphenyl) phosphine, and tri(2,4-dibutylphenoxy) phosphine.

These compounds are know as antioxidants for rubbers, plastics, and fats and fatty oils, and commercial products thereof can be readily available.

The added amount of the antioxidant is not particularly limited and may be suitably adjusted in accordance with the intended use, however, the added amount of the antioxidant is preferably 0.01% by mass to 10% by mass relative to the total mass of a layer to which the antioxidant is to be added.

(Image Forming Method and Image Forming Apparatus)

The image forming apparatus of the present invention is provided with at least an electrophotographic photoconductor, a latent electrostatic image forming unit, a developing unit, a transferring unit, and a fixing unit and further provided with other units suitably selected in accordance with the intended use, for example, a cleaning unit, a charge-eliminating unit, a recycling unit, and a controlling unit.

The image forming method of the present invention includes at least a latent electrostatic image forming step, a developing step, a transferring step, and a fixing step and further includes other steps suitably selected in accordance with the necessity, for example, a cleaning step, a charge elimination step, a recycling step, and a controlling step.

The image forming method of the present invention can be preferably carried out by means of the image forming apparatus of the present invention. The latent electrostatic image forming step can be carried out by means of the latent electrostatic image forming unit; the developing step can be carried out by means of the developing unit; the transferring step can be carried out by means of the transferring unit; the fixing step can be carried out by means of the fixing unit; and the other steps can be carried out by means of the other units.

-Latent Electrostatic Image Forming Step and Latent Electrostatic Image Forming Unit- The latent electrostatic image forming step is a step in which a latent electrostatic image is formed on an electrophotographic photoconductor.

The electrophotographic photoconductor is not particularly limited as to the material, shape, structure, size, etc. and may be suitably selected from among conventional electrophotographic photoconductors, however, for the shape, a drum shape is preferably exemplified.

For the electrophotographic photoconductor, the electrophotographic photoconductor of the present invention can be used.

The latent electrostatic image can be formed, for example, by charging the surface of the electrophotographic photoconductor uniformly and then exposing the surface thereof imagewisely by means of the latent electrostatic image forming unit. The latent electrostatic image forming unit is provided with, for example, at least a charger configured to uniformly charge the surface of the electrophotographic photoconductor, and an exposer configured to expose the surface of the electrophotographic photoconductor imagewisely.

The surface of the electrophotographic photoconductor can be charged by applying a voltage to the surface of the electrophotographic photoconductor through the use of, for example, the charger.

The charger is not particularly limited, may be suitably selected in accordance with the intended use, and examples thereof include contact chargers known in the art, for example, which are equipped with a conductive or semi-conductive roller, a brush, a film, a rubber blade or the like, and non-contact chargers utilizing corona discharge such as corotoron and scorotoron.

The surface of the electrophotographic photoconductor can be exposed, for example, by exposing the photoconductor surface imagewisely using the exposer.

The exposer is not particularly limited, provided that the surface of the electrophotographic photoconductor which has been charged by the charger can be exposed imagewisely, may be suitably selected in accordance with the intended use, and examples thereof include various types of exposers such as reproducing optical systems, rod lens array systems, laser optical systems, and liquid crystal shutter optical systems.

In the present invention, the back light method may be employed in which exposing is performed imagewisely from the back 10 side of the electrophotographic photoconductor.

When an image forming apparatus is used as a copier or a printer, the photoconductor surface is irradiated with a reflected laser beam or a transmitted light beam from a document script or by reading a document script by means of a sensor to convert it to signals and to make the laser beam scan the photoconductor surface, make a LED array driven or a liquid crystal shutter array driven based on the signals to thereby irradiate the electrophotographic photoconductor with a laser beam.

-Developing and Developing Unit-

The developing step is a step in which the latent electrostatic image is developed using the developer of the present invention to form a visible image.

The visible image can be formed by developing the latent electrostatic image using, for example, the developer in the developing unit.

The developing unit is not particularly limited, as long as a latent electrostatic image can be developed using the developer of the present invention, may be suitably selected from those known in the art, and preferred examples thereof include the one having at least an image developing apparatus which houses the developer of the present invention therein and enables supplying the developer to the latent electrostatic image in a contact or a non-contact state.

The toner is not particularly limited and may be suitably selected in accordance with the intended use, however, a toner having fine particles is preferable, and the volume average particle diameter of the toner is preferably 3 μm to 10 μm, and the average circularity of the toner is preferably 0.90 to 0.99.

For the image developing apparatus, a dry-developing process or a wet-developing process may be employed. It may be a monochrome color image developing apparatus or a multicolor image developing apparatus. Preferred examples thereof include the one having a stirrer by which the developer is frictionally stirred to be charged, and a rotatable magnet roller.

In the image developing apparatus, for example, a toner and the carrier are mixed and stirred, the toner is charged by frictional force at that time to be held in a state where the toner is standing on the surface of the rotating magnet roller to thereby form a magnetic brush. Since the magnet roller is located near the electrophotographic photoconductor, a part of the toner constituting the magnetic brush formed on the surface of the magnet roller moves to the surface of the electrophotographic photoconductor by electric attraction force. As the result, the latent electrostatic image is developed using the toner to form a visible toner image on the surface of the electrophotographic photoconductor.

A developer to be housed in the developing apparatus is a developer containing a toner, however, the developer may be a one-component developer or a two-component developer. For the toner, a generally used toner can be used.

-Transferring and Transferring Unit-

In the transferring step, the visible image is transferred onto a recording medium, and it is preferably an aspect in which an intermediate transfer member is used, the visible image is primarily transferred to the intermediate transfer member and then the visible image is secondarily transferred onto the recording medium. An aspect of the transferring step is more preferable in which two or more color toners are used, an aspect of the transferring is still more preferably in which a full-color toner is used, and the aspect includes a primary transferring in which the visible image is transferred to an intermediate transfer member to form a composite transfer image thereon, and a secondary transferring in which the composite transfer image is transferred onto a recording medium.

The transferring can be performed, for example, by charging a visible image formed on the surface of the electrophotographic photoconductor using a transfer-charger to transfer the visible image, and this is enabled by means of the transferring unit. For the transferring unit, it is preferably an aspect which includes a primary transferring unit configured to transfer the visible image to an intermediate transfer member to form a composite transfer image, and a secondary transferring unit configured to transfer the composite transfer image onto a recording medium.

The intermediate transfer member is not particularly limited, may be suitably selected from among those known in the art in accordance with the intended use, and preferred examples thereof include transferring belts.

The transferring unit (the primary transferring unit and the secondary transferring unit) preferably includes at least an image-transferer configured to exfoliate and charge the visible image formed on the electrophotographic photoconductor to transfer the visible image onto the recording medium. For the transferring unit, there may be one transferring unit or two or more transferring units.

Examples of the image transferer include corona image transferers using corona discharge, transferring belts, transfer rollers, pressure transfer rollers, and adhesion image transfer units.

The recording medium is not particularly limited as long as it is typically a regular paper, and a developed but unfixed image can be transferred thereto, and may be suitably selected in accordance with the intended use. PET (polyethylene terephthalate)-based ones used for OHP can also be used for the recording medium.

-Fixing and Fixing Unit-

The fixing step is a step in which a visible image which has been transferred onto a recording medium is fixed using a fixing apparatus, and the image fixing may be performed every time each color toner is transferred onto the recording medium or at a time so that each of individual color toners are superimposed at a time.

The fixing apparatus is not particularly limited, may be suitably selected in accordance with the intended use, and heat-pressurizing units known in the art are preferably used. Examples of the heat-pressurizing units include a combination of a heat roller and a pressurizing roller, and a combination of a heat roller, a pressurizing roller, and an endless belt.

The heating temperature in the heat-pressurizing unit is preferably 80° C. to 200° C.

In the present invention, for example, an optical fixing apparatus known in the art may be used in the fixing step and the fixing unit or instead of the fixing unit.

-Cleaning and Cleaning Unit-

The cleaning step is a step in which a residual electrographic toner remaining on the electrophotographic photoconductor is removed, and the cleaning can be preferably performed using a cleaning unit.

The cleaning unit is not particularly limited, provided that the residual electrophotographic toner remaining on the electrophotographic photoconductor can be removed, and may be suitably selected from among those known in the art. Examples of the cleaning unit include magnetic brush cleaners, electrostatic brush cleaners, magnetic roller cleaners, blade cleaners, brush cleaners, and web cleaners.

-Charge Elimination and Charge Elimination Unit-

The charge elimination step is a step in which charge is eliminated by applying a charge-eliminating bias to the electrophotographic photoconductor, and it can be suitably performed by means of a charge-eliminating unit.

The charge-eliminating unit is not particularly limited as long as a charge-eliminating bias can be applied to the latent electrostatic image bearing member, and may be suitably selected from among charge-eliminating units known in the art. For example, a charge-eliminating lamp or the like is preferably used.

The recycling step is a step in which the toner that had been eliminated in the cleaning is recycled in the developing, and the recycling can be suitably performed by means of a recycling unit.

The recycling unit is not particularly limited, and examples thereof include carrying units known in the art.

The controlling step is a step in which the respective steps are controlled, and the controlling step can be preferably carried out by means of a controlling unit.

The controlling unit is not particularly limited as long as the controlling unit can control the operations of the respective units, and examples thereof include equipment such as sequencers, and computers.

Figure 5:
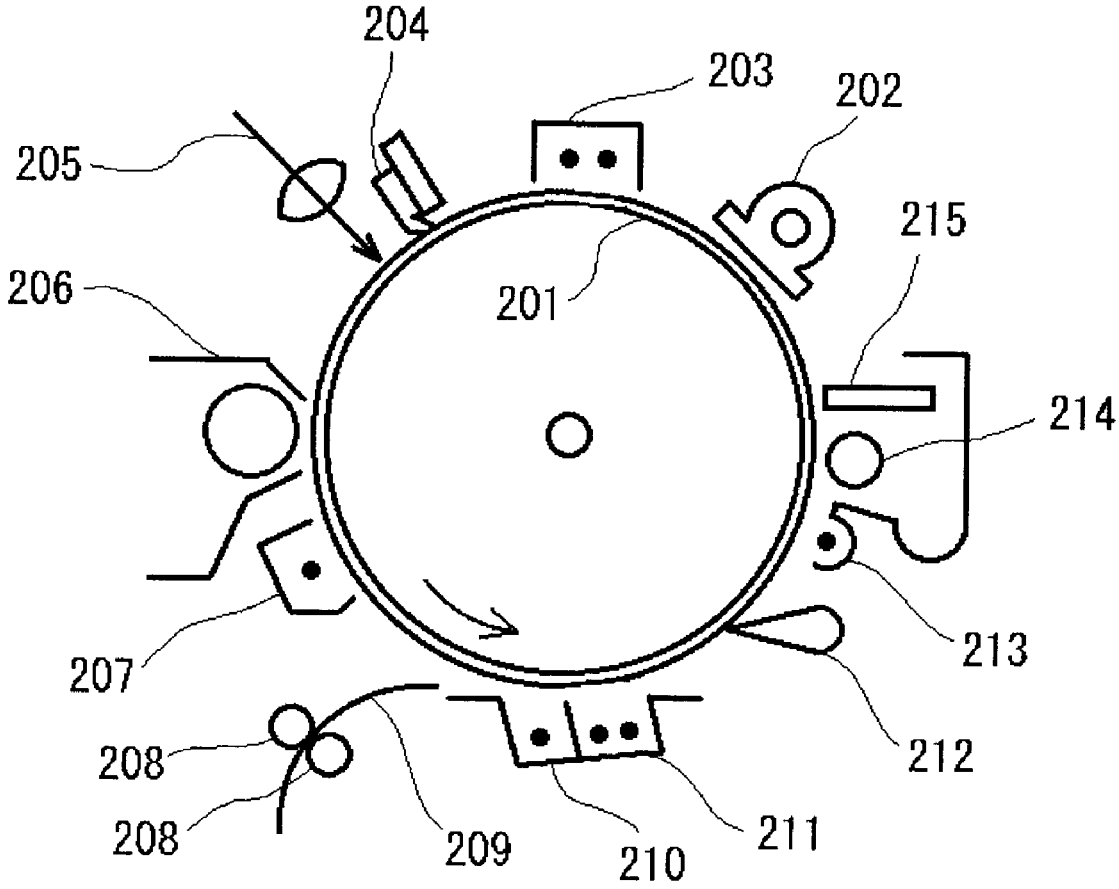
FIG. 5 is a schematic view exemplarity showing an image forming apparatus of the present invention.

Hereinafter, an aspect of the image forming apparatus of the present invention will be described referring to FIG. 5. The present invention is intended to cover various modifications and equivalent arrangements, and an aspect as described below is also included within the spirit and scope of the present invention.

An electrophotographic photoconductor 201 has a photosensitive layer in which a charge generating layer, a charge transporting layer, and a protective layer are formed in this order on a substrate. The electrophotographic photoconductor 201 is formed in a drum shape, however, it may be formed in a sheet-like shape or in an endless belt. In FIG. 5, the reference numeral 204 represents an eraser.

As a charging unit for charging the electrophotographic photoconductor 201 uniformly, the charging charger 203 is used. For the charging unit, a conventional unit, such as a corotron device, a scorotron device, a solid discharging element, a needle electrode device, a roller charging device, an electrically-conductive brush device, or the like can be used, and various systems known in the art are usable.

The configuration of the present invention is particularly effective when a charging unit that the photoconductor composition is dissolved by proximity discharging from charging unit such as contact charging system or non-contact proximity placement charging system is used. The term "the contact charging system" means the charging system in which a charged roller, a charged brush, a charged blade, directly touches the photoconductor. On the other hand, proximity charging system is the one that the charged roller is proximity placed with non-contact state having air gap of 200 μm or less between the photoconductor surface and the charging unit for instance. When this air gap is too large, charging tends to be unstable, whereas when this air gap is too small, in case that the residual toner exist the photoconductor, a charging member surface may be contaminated. Consequently, the air gap is preferably 10 μm to 200 μm, and more preferably 10 μm to 100 μm.

Next, for forming an electrostatic latent image in the photoconductor 201 charged uniformly, the image exposing unit 205 is used. Examples of the light source of the image exposing unit 205 include general illuminants, such as a fluorescent light, a tungsten lamp, a halogen lamp, a mercury vapor lamp, a sodium lamp, a light emitting diode (LED), a laser diode (LD) and an electro luminescence (EL). For exposing a light having only a desired wavelength, various filters, such as a sharp cut filter, a band pass filter, a near-infrared cutting filter, a dichroic filter, an interference filter and a color conversion filter can be used.

Next, for visualizing an electrostatic latent image formed on the photoconductor 201, the developing unit 206 is used. Examples of the developing method include a one-component developing and a two-component developing using a dry toner and a wet developing using a wet toner. By charging the photoconductor 201 positively (negatively) and by exposing the image in the photoconductor 201, a positive (negative) electrostatic latent image is formed on the surface of the photoconductor 201. Further, by developing the formed latent image with a negative (positive) toner (voltage-detecting fine particles), a positive image can be obtained and by developing the formed latent image with a positive (negative) toner, a negative image can be obtained.

Next, for transferring the visualized toner image onto the recording medium 209 in the photoconductor 1, the transferring charger 210 is used. For transferring the toner image more advantageously, the transferring pre-charger 207 may be also used. Examples of the transferring method include an electrostatic transferring method using a transferring charger and a bias roller; a mechanical transferring method, such as an adhesion transferring method and a pressing transferring method; and a magnetic transferring method. The electrostatic transferring method can use the charging unit.

Next, as an unit for peeling the recording medium 209 from the photoconductor 201, the peeling charger 211 and the peeling blade 212 can be used. Examples of the other peeling units include an electrostatic adsorption inducing peeling unit, a side belt peeling unit, a top grip conveying unit and a curvature peeling unit. As the peeling charger 211, the charging unit can be used.

Next, for cleaning a residual toner on the photoconductor 201 after the transferring, the fur brush 214 and the cleaning blade 215 are used. For cleaning the residual toner more effectively, the cleaning pre-charger 213 may be also used. Examples of the other cleaning units include a web cleaning unit and a magnetic brush cleaning unit. These cleaning units may be used individually or in combination. Next, optionally for removing the latent image formed in the photoconductor 201, a charge-eliminating unit is used.

Examples of the charge-eliminating unit include the charge-eliminating lamp 202 and a charge eliminating charger. For the charge-eliminating lamp 202 and the charge-eliminating charger respectively, the exposing light source and charging unit can be used respectively. Besides, a document reading unit, a paper feeding unit, a fixing unit and a paper discharging unit each of which is arranged distantly from the photoconductor 201, and conventional units may be used.

Next, an aspect of carrying out the image forming method of the present invention using the image forming apparatus of the present invention will be described below while referring to FIG. 6. An image forming apparatus 100 shown in FIG. 6 includes a photoconductor drum 10 (hereinafter, may be referred to as "photoconductor 10") as the latent electrostatic image bearing member, a charge roller 20 as the charging unit, an exposer 30 as the exposing unit, a developing apparatus 40 as the developing unit, an intermediate transferring member 50, a cleaning apparatus 60 as a cleaning unit having a cleaning blade, and a charge eliminating lamp 70 as the charge eliminating unit.

Figure 6:
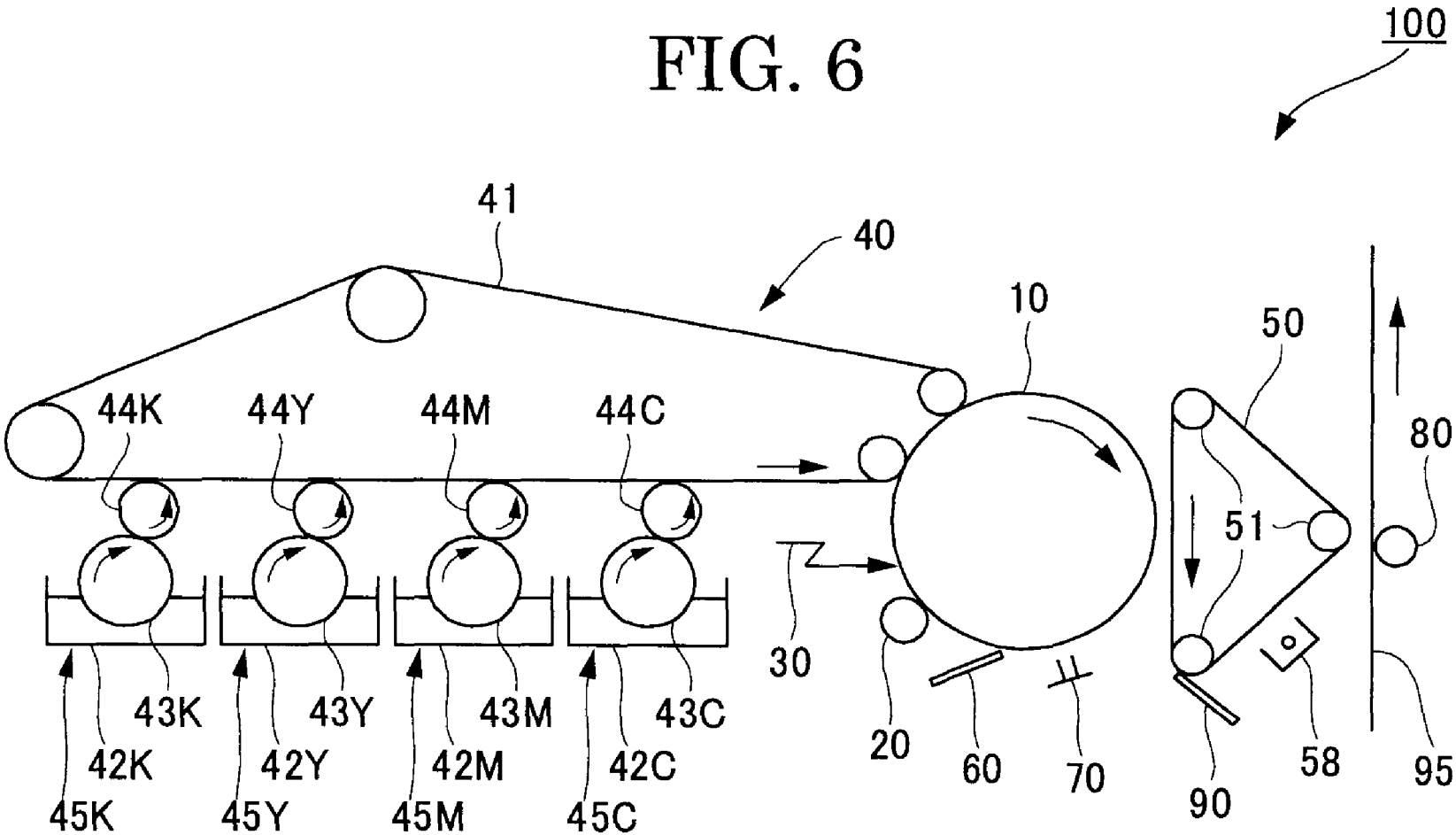
FIG. 6 is a schematic illustration showing one example of carrying out the image forming method of the present invention using an image forming apparatus of the present invention.

The intermediate transfer member 50 is an endless belt, and designed such that the intermediate transfer member is spanned over three rollers 51 disposed inside thereof and driven in the direction indicated by the arrow shown in FIG. 6. One of the three rollers 51 also serves as a bias roller capable of applying a given bias for image transferring, i.e. primary transfer bias to the intermediate transfer member 50. A cleaner 90 having a cleaning blade for cleaning the intermediate transfer member 50 is arranged in the vicinity of the intermediate transfer member 50. A transferring roller 80 as the transferring unit faces a transferring sheet 95 and is capable of applying a bias for image transfer for transferring or secondary transferring of a developed image, i.e. toner image to the a transferring sheet 95 serving as a final transferring member. A corona charger 58 for applying charges onto the developed image on the intermediate transfer member 50 is arranged around the intermediate transfer member 50. The corona charger 58 is disposed between a contact area of the photoconductor 10 and the intermediate transfer member 50 and another contact area of the intermediate transfer member 50 and the transferring sheet 95 in the direction of rotation of the intermediate transfer member 50.

The developing apparatus 40 is provided with a developing belt 41 as a developer bearing member, a black developing unit 45K, a yellow developing unit 45Y, a magenta developing unit 45M, and a cyan developing unit 45C disposed around the developing belt 41. The black developing unit 45K includes a developer housing section 42K, a developer supplying roller 43K, and a developing roller 44K. The yellow developing unit 45Y is provided with a developer housing section 42Y, a developer supplying roller 43Y, and a developing roller 44Y. The magenta developing unit 45M includes a developer housing section 42M, a developer supplying roller 43M, and a developing roller 44M. The cyan developing unit 45C is provided with a developer housing section 42C, a developer supplying roller 43C, and the developing roller 44C. The developing belt 41 is an endless belt, and is rotatably stretched around a plurality of belt rollers. A part of the developing belt 41 is in contact with the photoconductor 10.

In the image forming apparatus 100 shown in FIG. 6, for example, the charge roller 20 charges the photoconductor drum 10 uniformly. The exposer 30 imagewisely exposes the photoconductor drum 10 and forms a latent electrostatic image. The latent electrostatic image formed on the photoconductor drum 10 is developed by supplying the toner from the developing apparatus 40, and a toner image is formed. The toner image is transferred to the intermediate transferring member 50 (primary transfer) by a pressure applied by the rollers 51, and further transferred to the transferring sheet 95 (secondary transfer). As a result of this, a transfer image is formed on the transferring sheet 95. The toner remained on the photoconductor 10 is removed by the cleaning apparatus 60, and the charging of the photoconductor is eliminated once by the charge eliminating lamp 70.

Figure 7:
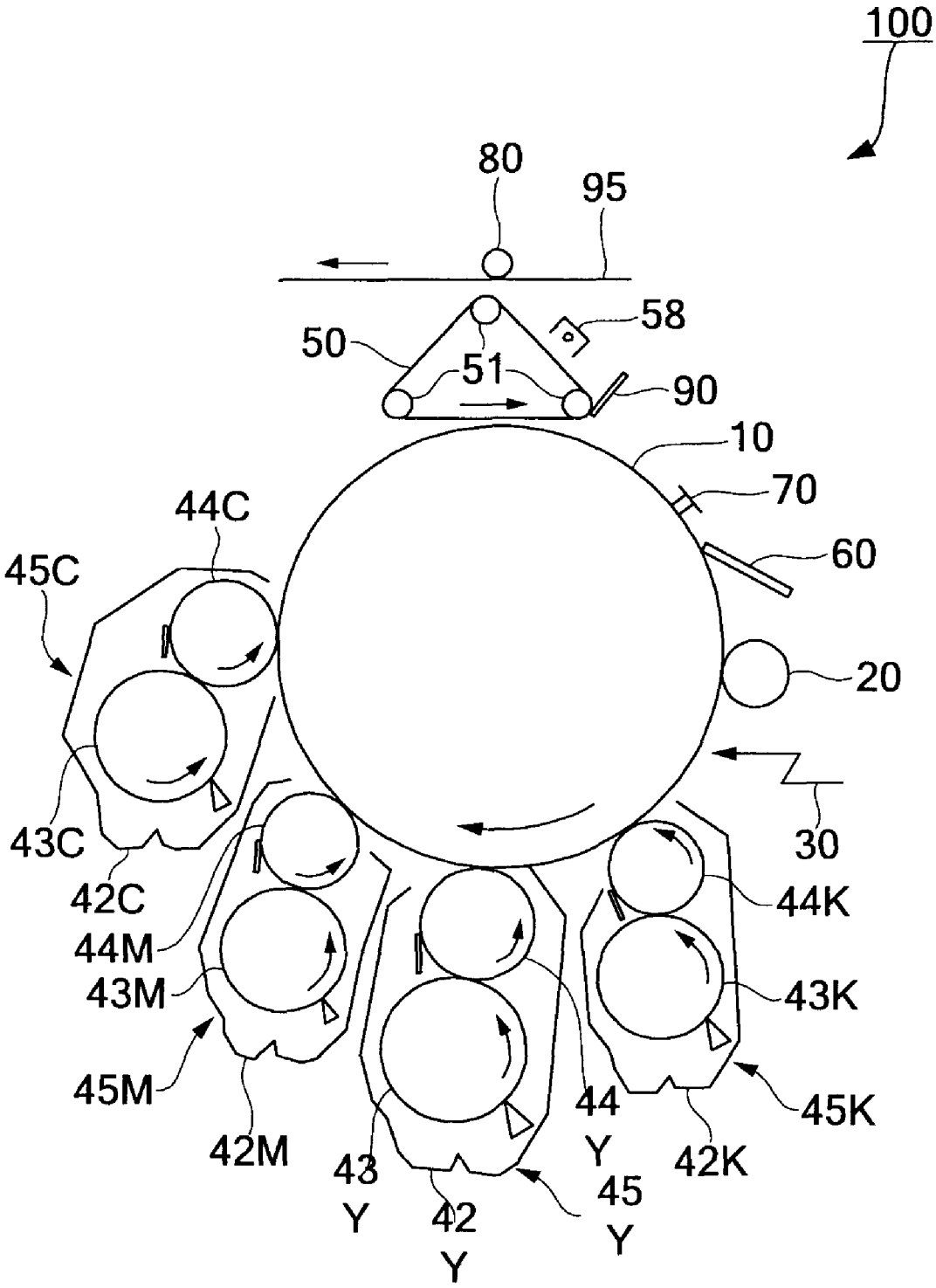
FIG. 7 is a schematic illustration showing another example of carrying out the image forming method of the present invention using an image forming apparatus of the present invention.

Another aspect of carrying out the image forming method of the present invention using the image forming apparatus of the present invention will be described below while referring to FIG. 7. An image forming apparatus 100 shown in FIG. 7 has a structure similar to a structure of the image forming apparatus 100 shown in FIG. 6 except for points that the developing belt 41 is not provided, and that the black developing unit 45K, the yellow developing unit 45Y, the magenta developing unit 45M, and the cyan developing unit 45C are disposed to face to each other, around the photoconductor 10, and have similar actions and effect as the image forming apparatus 100 shown in FIG. 6. In FIG. 7, same reference numerals are assigned to components which are same as in FIG. 6.

Figure 8:
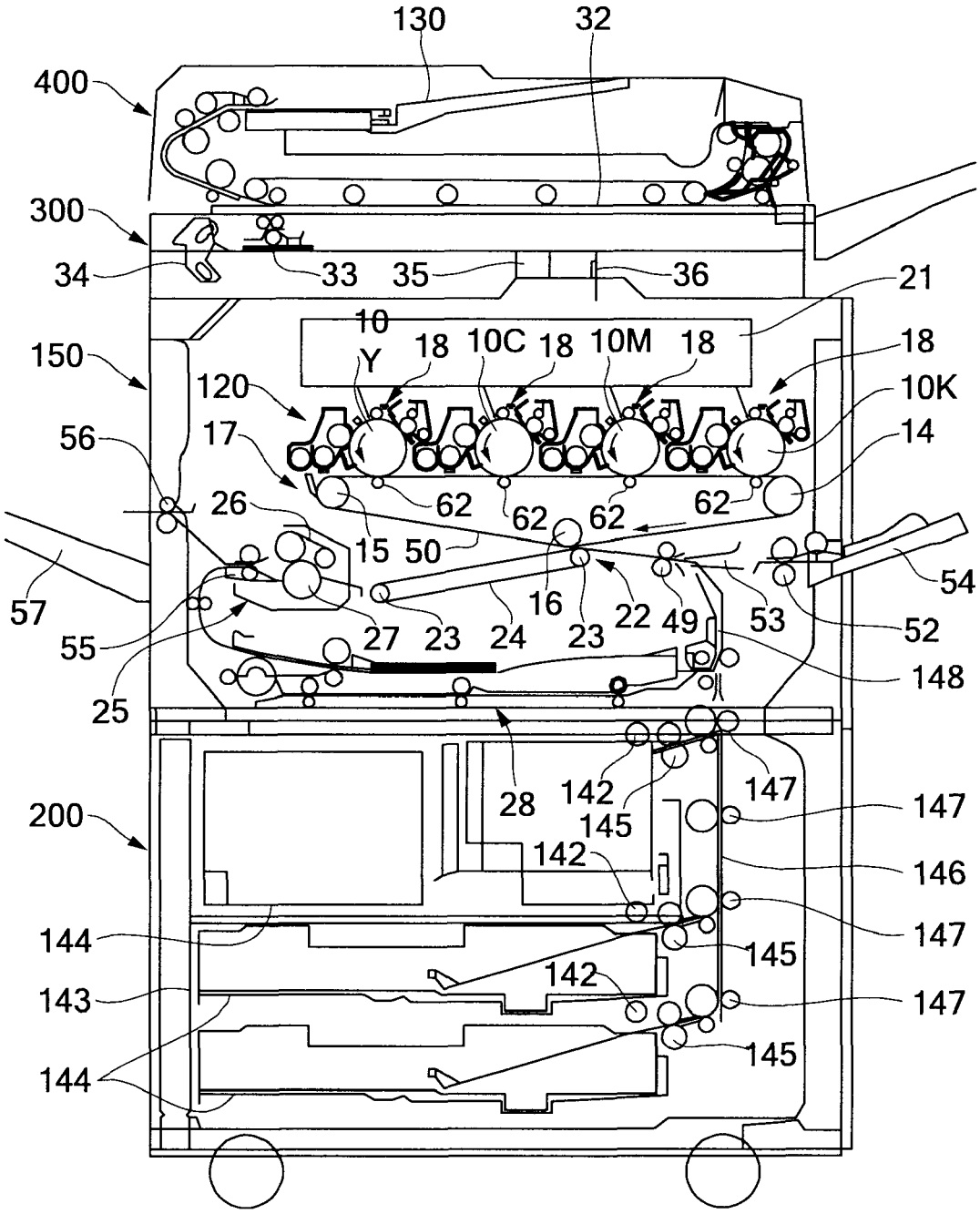
FIG. 8 is a schematic illustration showing one example of carrying out the image forming method of the present invention using an image forming apparatus (tandem type color image forming apparatus) of the present invention.

Another aspect for carrying out the image forming method of the present invention using the image forming apparatus of the present invention will be described below while referring to FIG. 8. A tandem image forming apparatus shown in FIG. 8 is a tandem color image forming apparatus. The tandem image forming apparatus is provided with a copier main body 150, a sheet feeder table 200, a scanner 300, and automatic document feeder (ADF) 400.

The copier main body 150 is provided with an endless belt intermediate transfer member 50 at its center part. The intermediate transfer member 50 is spanned over three support rollers 14, 15, and 16 and is capable of rotating and moving in a clockwise direction in FIG. 8. An intermediate image-transfer member cleaner 17 is capable of removing residual toner from the intermediate transfer member 50 after the transferring and is arranged in the vicinity of the support roller 15. Above the intermediate transfer member 50 spanned between the support rollers of 14 and 15, yellow, cyan, magenta, and black image forming devices 18, namely four image forming devices are arrayed in parallel in a moving direction of the intermediate transfer member 50 to thereby constitute the tandem image developing apparatus 120. An exposer 21 is arranged in the vicinity of the tandem image developing apparatus 120. A secondary image transferer 22 faces the tandem image developing apparatus 120 with the interposition of the intermediate transfer member 50. The secondary image transferer 22 is provided with an endless belt serving as a secondary transferring belt 24 spanned over a pair of rollers 23. The transferring sheet transported in the vicinity of the secondary transferring belt 24 is capable of being in contact with the intermediate transfer member 50. An image fixing apparatus 25 is arranged on the side of the secondary image-transferer 22. The image fixing apparatus 25 is provided with an endless belt serving as a fixing belt 26 and pressure roller 27 arranged to be pressed by the fixing belt 26.

In the tandem image forming apparatus, a sheet reverser 28 is arranged in the vicinity of the secondary image-transferer 22 and the image fixing apparatus 25. The sheet reverser 28 is capable of reversing the transferring sheet so as to form images on both sides of the transferring sheet.

Hereinafter, the way a full-color image, i.e. color copy is formed by using the tandem image forming apparatus will be described. Initially, a document is placed on a document platen 130 of the automatic document feeder (ADF) 400. Alternatively, the automatic document feeder (ADF) 400 is opened, a document is placed on a contact glass 32 of the scanner 300, and the automatic document feeder (ADF) 400 is closed to press the document.

When pushing a starting switch (not shown), the document placed on the automatic document feeder 400 is transported onto the contact glass 32. When the document is initially place on the contact glass 32, the scanner 300 is immediately driven to operate a first carriage 33 and a second carriage 34. A light is applied from a light source to the document by action of the first carriage 33, and the reflected secondary light from the document is further reflected toward the second carriage 34. The reflected light is further reflected by a mirror of the second carriage 34 and passes through image-forming lens 35 into a read sensor 36 to thereby read the color document, i.e. color image and to produce black, yellow, magenta, and cyan image information.

Figure 9:
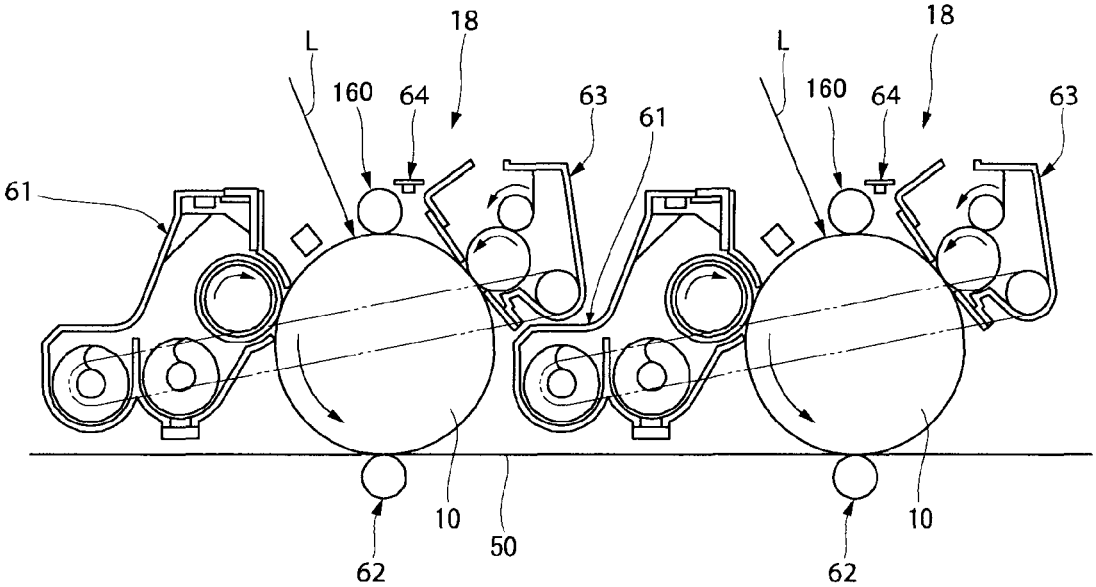
FIG. 9 is a partially enlarged schematic illustration in the image forming apparatus shown in FIG. 8.

Each of the black, yellow, magenta, and cyan image information is transmitted to each of the image forming devices 18, i.e. black, yellow, magenta, and cyan image forming devices in the tandem image forming apparatus 120 to thereby form black, yellow, magenta, and cyan toner image therein. Specifically, each of the image forming devices 18, i.e. black, yellow, magenta, and cyan image forming devices in the tandem image forming apparatus is provided with, as shown in FIG. 9, a photoconductors 10, i.e. a black photoconductor 10K, a yellow photoconductor 10Y, a magenta photoconductor 10M, and a cyan photoconductor 10C; a charger 160 configured to charge the photoconductor uniformly; an exposer configured to expose the photoconductor image-wisely corresponding to each color image based on each color image information, which is represented by L in FIG. 9, to form a latent electrostatic image corresponding to each of the color images on the photoconductor; an image developing apparatus 61 configured to develop the latent electrostatic image using each color toners, i.e. black toner, yellow toner, magenta toner, and cyan toner to form a toner image which contains each of these color toners; a transferring charger 62 used for transferring the toner image onto the intermediate transfer member 50; a cleaner 63 for cleaning the photoconductor, and a charge-eliminator 64 to thereby respectively form a monochrome image, i.e. a black image, a yellow image, a magenta image, and a cyan image based on the respective color image information. The black image, the yellow image, the magenta image, and the cyan image formed as above, i.e. the black image formed on the black photoconductor 10K, the yellow image formed on the yellow photoconductor 10Y, the magenta image formed on the magenta photoconductor 10M, and the cyan image formed on the cyan photoconductor 10C are sequentially transferred (primary transferring) onto the intermediate transfer member 50 which is rotated and shifted by the support rollers 14, 15, and 16. Then, the black image, the yellow image, the magenta image, and the cyan image are superimposed on the intermediate transfer member 50 to thereby form a composite color image, i.e. a transferred color image.

One of feeder rollers 142 of the feeder table 200 is selectively rotated, sheets or recording papers are ejected from one of multiple feeder cassettes 144 in paper bank 143 and are separated by a separation roller 145 one by one into a feeder path 146, and are transported by a transport roller 147 into a feeder path 148 in the copier main body 150 and are bumped against a resist roller 49 and stopped. Alternatively, the feeder roller 142 is rotated to eject sheets or recording papers on a manual bypass tray 54, the sheets are separated one by one by the separation roller 145 into a manual bypass feeder path 53 and are bumped against the resist roller 49 and stopped. The resist roller 49 is generally grounded, however, may be used under the application of a bias to remove paper dust of sheets.

The resist roller 49 is rotated in synchronization with the movement of the composite color image, i.e. transferred color image on the intermediate transfer member 50 to transport the sheet or recording paper into between the intermediate transfer member 50 and the secondary image-transferer 22, and the composite color image, i.e. transferred color image is transferred onto the sheet by action of the secondary image-transferer 22 (secondary transferring) to thereby transfer the color image to the sheet or recording paper. Separately, the intermediate transfer member cleaner 17 removes residual toner remaining on the intermediate transfer member 50 after the transferring.

The sheet or recording paper bearing the transferred color image is transported by the secondary image-transferer 22 into the image fixing apparatus 25, is applied with heat and pressure in the image fixing apparatus 25 to fix the composite color image, i.e. transferred color image on the sheet or recording paper. The sheet then changes its direction by action of a switch blade 55 and ejected by an ejecting roller 56 to be stacked on an output tray 57. Alternatively, the sheet changes its direction by action of the switch blade 55 into the sheet reverser 28, turns therein, is transported again to the transfer position, followed by image formation on the backside of the sheet. The sheet bearing images on both sides thereof is ejected through the ejecting roller 56 and then stacked onto the output tray 57.

(Process Cartridge)

The process cartridge of the present invention is provided with at least the electrophotographic photoconductor of the present invention, a developing unit configured to develop a latent electrostatic image formed on the electrophotographic photoconductor using a toner to form a visible image and is further provided with other units such as a charging unit, a transferring unit, a cleaning unit, a charge-eliminating unit in accordance with the necessity.

The developing unit is provided with at least a developer container to house a toner and/or a developer, a developer carrier to carry and convey the toner and/or the developer and may be further provided with a layer thickness controlling member to control the thickness of a toner layer to be carried.

The process cartridge of the present invention can be detachably mounted to various image forming apparatuses and is preferably mounted detachably to the above-noted image forming apparatus of the present invention.

Figure 10:
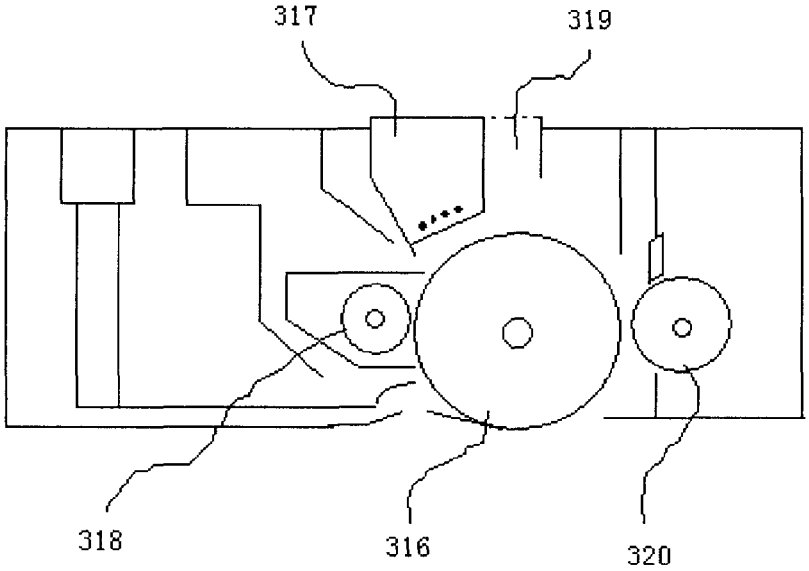
FIG. 10 is a schematic view exemplarily showing a process cartridge of the present invention.

Here, the process cartridge incorporates, as shown in FIG. 10, a photoconductor 316, is provided with a charging unit 317, an exposing unit 319, a developing unit 320, a cleaning unit 318, a transferring unit (not shown), a charge-eliminating unit (not shown), and is further provided with other units in accordance with the necessity.

Next, an image forming method using a process cartridge shown in FIG. 10 will be described below. A photoconductor 316 is charged by a charging unit 317 and exposed by an exposing unit 319 while rotating in the direction indicated by the arrow in FIG. 10 to thereby form a latent electrostatic image corresponding to the exposed image on the surface of the photoconductor 316. The latent electrostatic image is developed by a developing unit 320 using a toner, and the toner image is transferred onto a recording medium by a transferring unit (not shown) and then printed out. Next, the photoconductor surface after transferring the toner image is cleaned by a cleaning unit 318, and further, the charging on the photoconductor surface is removed by a charge-eliminating unit (not shown), followed by repeating the above-noted operations.

In the image forming apparatus of the present invention, the electrophotographic photoconductor may be combined with components such as an image developing apparatus, a cleaning device to be integrally formed in a unit as a process cartridge, and the unit may be detachably mounted on the main body of the image forming apparatus. Further, at least one selected from a charger, an image exposer, a developing apparatus, a transfer separator, and a cleaning apparatus is integrated with the electrophotographic photoconductor to be supported in a single unit which can be detachably mounted on the main body of the image forming apparatus using a guide unit such as a rail laid in the main body of the image forming apparatus.

The image forming method, the image forming apparatus, and the process cartridge can be utilized not only in electrophotographic copiers but also can be widely used in the area of electrophotographic application such as laser beam printers, CRT printers, LED printers, liquid crystal display printers, and laser photoengraving.

The present invention can solve conventional problems and can provide an electrophotographic photoconductor which is capable of stably forming images with improved durability and without reducing resolution even when repeatedly used over a long period of time and without substantially causing abnormal images such as background smear and toner-filming. The present invention can also provide an image forming method and an image forming apparatus as well as a process cartridge each having a longer operating life and high-performance.

EXAMPLES

Hereinafter, the present invention will be further described in detail referring to specific Examples and Comparative Examples, however, the present invention is not limited to the disclosed Examples.

Production Example 1

-Synthesis of Exemplified Compound No. 21-

(1) Synthesis of p-diethylaminophenethyl alcohol

In a four-aperture flask, 9.6 g (70 mmol) of p-aminophenethyl alcohol, 38.7 g (280 mmol) of potassium carbonate, and 100 mL of monochlorobenzene were poured, and the mixture was heated at 120° C. under an argon atmosphere with stirring. Then, 32.8 g (210 mmol) of ethyl iodide was delivered by drops into the mixture for 5 hours. Upon completion of the dripping, the mixture was further heated with stirring for 5 hours. The reaction solution was cooled to the room temperature and then diluted with dichloromethane, followed by washing with water three times. The dichloromethane solution was dried with anhydrous magnesium sulfate, the solvent was distilled away to purify the dichloromethane solution by silica gel chromatography using a mixture solvent of toluene/ethyl acetate (2/1) as an eluent to thereby synthesize 12.1 g (yield: 89% by mass) of p-diethylaminophenethyl alcohol.

(2) Synthesis of p-diethylaminophenethyl acrylate

In a three-aperture flask, 5.43 g (28.1 mmol) of p-diethylaminophenethyl alcohol, 6.26 g (61.8 mmol) of triethylamine, and 30 mL of dehydrated tetrahydrofuran were poured, and the mixture was stirred under an argon atmosphere and an ice-cooling condition. Then, 5.09 g (56.2 mmol) of chloride acrylate was delivered by drops into the reaction solution for 30 minutes. Upon completion of the dripping, the reaction solution was further stirred for 5 hours. The reaction solution was poured to 100 mL of water and then an extract was obtained therefrom by using toluene, followed by washing with water three times. The toluene solution was dried with anhydrous magnesium sulfate, and then the solvent was distilled away to purify the toluene solution by silica gel chromatography using a mixture solvent of hexane/ethyl acetate (9/1) as an eluent to thereby synthesize 3.17 g (yield: 46% by mass) of p-diethylaminophenethyl acrylate of the exemplified compound No. 21 represented by the following structural formula.

No. 21

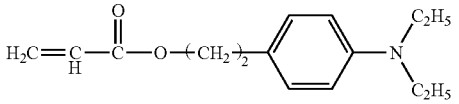

Production Example 2

-Synthesis of Exemplified Compound No. 22-

(1) Synthesis of p-benzyl-ethylaminophenethyl alcohol

In a four-aperture flask, 9.6 g (70 mmol) of p-aminophenethyl alcohol, 38.7 g (280 mmol) of potassium carbonate, and 50 mL of dehydrated toluene were poured, and the mixture was heated at 100° C. under an argon atmosphere with stirring. Then, 10.9 g (70 mmol) of ethyl iodide was delivered by drops into the reaction solution for 3 hours. Upon completion of the dripping, the reaction solution was further heated with stirring for 1 hour. Into the reaction solution, 10.9 g (70 mmol) of benzyl chloride was delivered by drops for 30 minutes. Upon completion of the dripping, the reaction solution was further heated with stirring for 3 hours. The reaction solution was cooled to the room temperature and then diluted with toluene, followed by washing with water five times. The toluene solution was dried with anhydrous magnesium sulfate, and then the solvent was distilled away to purify the toluene solution by silica gel chromatography using a mixture solvent of toluene/ethyl acetate (10/1) as an eluent to synthesize 6.69 g (yield: 37% by mass) of p-benzyl-ethylaminophenethyl alcohol.

(2) Synthesis of p-benzyl-ethylaminophenethyl acrylate

In a three-aperture flask, 6.64 g (26 mmol) of p-benzyl-ethylaminophenethyl alcohol, 5.79 g (57.2 mmol) of triethylamine, and 50 mL of dehydrated tetrahydrofuran were poured, and the mixture was stirred under an argon atmosphere and an ice-cooling condition. Then, 4.70 g (52 mmol) of chloride acrylate was delivered by drops into the reaction solution for 30 minutes. Upon completion of the dripping, the reaction solution was further stirred for 3 hours. The reaction solution was poured to 100 mL of water and then an extract was obtained therefrom by using toluene, followed by washing with water three times. The toluene solution was dried with anhydrous magnesium sulfate, and then the solvent was distilled away to purify the toluene solution by silica gel chromatography using a mixture solvent of hexane/ethyl acetate (5/1) as an eluent to thereby synthesize 3.21 g (yield: 40% by mass) of p-benzyl-ethylaminophenethyl acrylate of the exemplified compound No. 22 represented by the following structural formula.

No. 22

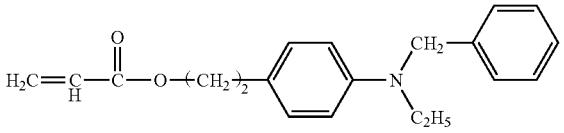

Production Example 3

-Synthesis of Exemplified Compound No. 23-

(1) Synthesis of p-dibenzyl-aminophenethyl alcohol

In a four-aperture flask, 5.49 g (40 mmol) of p-aminophenethyl alcohol, 21.1 g (160 mmol) of potassium carbonate, and 20.3 g (160 mmol) of benzyl chloride were poured, and the mixture was heated at 135° C. under an argon atmosphere with stirring for 7 hours. Then, the reaction solution was cooled to the room temperature and then diluted with toluene, followed by washing with water three times. The toluene solution was dried with anhydrous magnesium sulfate, and then the solvent was distilled away to purify the toluene solution by silica gel chromatography using a mixture solvent of toluene/ethyl acetate (7/1) as an eluent to thereby synthesize 11.0 g (yield: 87% by mass) of p-dibenzyl-aminophenethyl alcohol.

(2) Synthesis of p-dibenzyl-aminophenethyl acrylate

In a three-aperture flask, 10.5 g (33 mmol) of p-dibenzyl-aminophenethyl alcohol, 9.51 g (132 mmol) of acrylic acid, 0.56 g (3.3 mmol) of p-toluene sulfonate, and 30 mL of dehydrated toluene were poured, and the mixture was heated at 80° C. under an argon atmosphere with stirring. To the reaction solution, 3.8 g (18.2 mmol) of dicyclohexylcarbodimide and 2.5 g (16.5 mmol) of 4-pyrrolidinopyridine were added, and the reaction solution was further heated with stirring for 5 hours. The reaction solution was cooled to the room temperature and then diluted with toluene, followed by washing with water three times. The toluene solution was dried with anhydrous magnesium sulfate, and then the solvent was distilled away to purify the toluene solution by silica gel chromatography using a mixture solvent of hexane/ethyl acetate (4/1) as an eluent to thereby synthesize 4.05 g (yield: 33% by mass) of p-dibenzyl-aminophenethyl acrylate of the exemplified compound No. 23 represented by the following structural formula.

No. 23

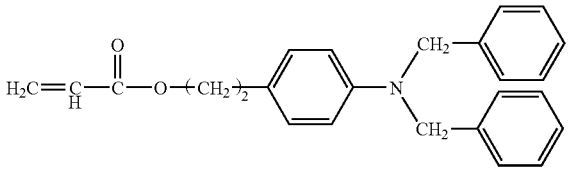

Example 1

-Preparation of Electrophotographic Photoconductor No. 1-

Over the surface of an aluminum cylinder having a diameter of 30 mm, an undercoat layer coating solution containing the following composition, a charge generating layer coating solution containing the following composition, and a charge transporting layer coating solution containing the following composition were respectively applied, and the surface of the cylinder coated with these coating solutions was sequentially dried to thereby form an undercoat layer having a thickness of 3.5 μm, a charge generating layer having a thickness of 0.2 μm, and a charge transporting layer having a thickness of 18 μm, respectively on the cylinder surface.

| [Composition of Undercoat Layer Coating Solution] | |
|---|---|
| Alkyd resin (BECKOZOLE 1307-60-EL, manufactured by Dainippon Ink and Chemicals, Inc.) | 6 parts by mass |
| Melamine resin (SUPER BECKAMINE G-821-60, manufactured by Dainippon Ink and Chemicals, Inc.) | 4 parts by mass |
| Titanium oxide | 40 parts by mass |
| Methylethylketone | 50 parts by mass |
| [Composition of Charge Generating Layer Coating Solution] | |
| Polyvinylbutyral (XYHL, manufactured by UCC) | 0.5 parts by mass |
| Cyclohexanone | 200 parts by mass |
| Methylethylketone | 80 parts by mass |
| Bisazo pigment represented by the following Structural Formula (i) | 2.4 parts by mass |

Structural Formula (i)

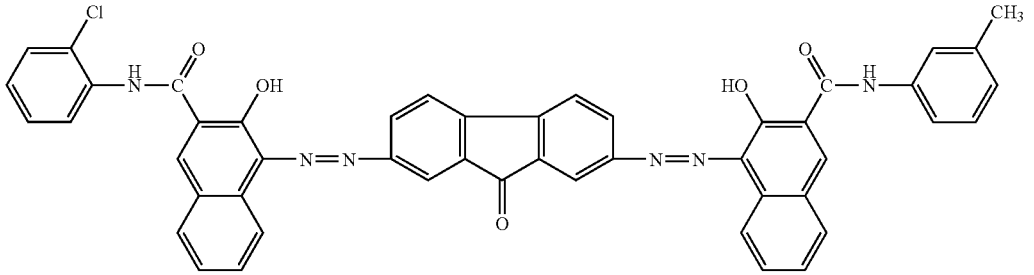

| [Composition of Charge Transporting Layer Coating Solution] | |
|---|---|
| Bisphenol Z polycarbonate (PANLIGHT TS-2050, manufactured by Teijin Chemicals, Ltd.) | 10 parts by mass |
| Tetrahydrofuran | 100 parts by mass |
| 1% by mass silicone oil-tetrahydrofuran solution (KF50-100CS, manufactured by Shin-Etsu Chemical Co., Ltd.) | 0.2 parts by mass |
| Low-molecule weight charge transporting material represented by the following Structural Formula (ii) | 7 parts by mass |

Structural Formula (ii)

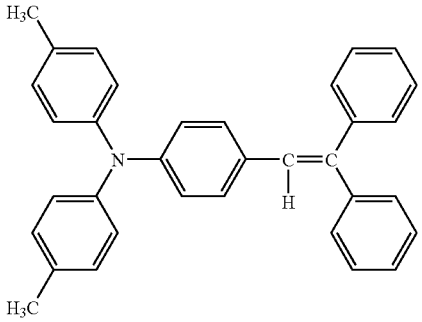

Next, the obtained charge transporting layer was coated with a protective layer coating solution containing the following composition by spray-coating, and the cylinder surface with the protective layer coating solution applied thereon was naturally dried for 20 minutes and then irradiated with a light under the conditions of metal halide lamp: 160 W/cm, distance of irradiation: 110 mm, intensity of irradiation: 750 mW/cm$^2$, and irradiation time: 240 seconds to thereby harden the cylinder surface. The cylinder surface was further dried at 130° C. for 20 minutes to form a protective layer having a thickness of 5.0 μm. Through the above-noted process, an electrophotographic photoconductor No. 1 was prepared.

| [Composition of Protective Layer Coating Solution] | |
|---|---|
| Chain-polymerizable tertiary amine compound as (A) component (Exemplified Compound No. 12) represented by the following structural formula | 1 part by mass |

No. 12

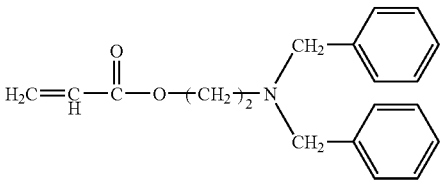

| | |
|---|---|
| Compound as (B) component represented by the following Structural Formula (iii) | 10 parts by mass |

Structural Formula (iii)

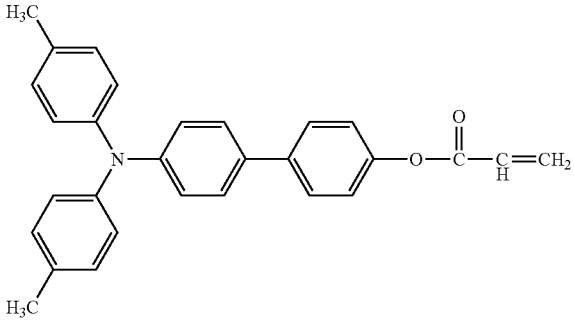

| | |
|---|---|
| Tetrahydrofuran | 62 parts by mass |

Example 2

-Preparation of Electrophotographic Photoconductor No. 2-

An electrophotographic photoconductor No. 2 was prepared in the same manner as in Example 1 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

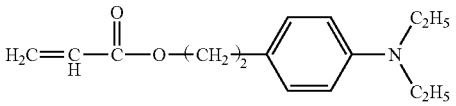

Example 3

-Preparation of Electrophotographic Photoconductor No. 3-

An electrophotographic photoconductor No. 3 was prepared in the same manner as in Example 1 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

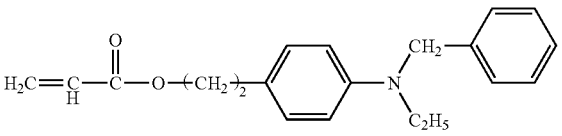

Example 4

-Preparation of Electrophotographic Photoconductor No. 4-

An electrophotographic photoconductor No. 4 was prepared in the same manner as in Example 1 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

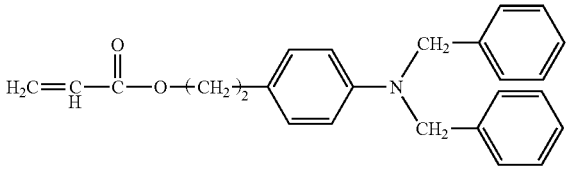

Example 5

-Preparation of Electrophotographic Photoconductor No. 5-

An electrophotographic photoconductor No. 5 was prepared in the same manner as in Example 1 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

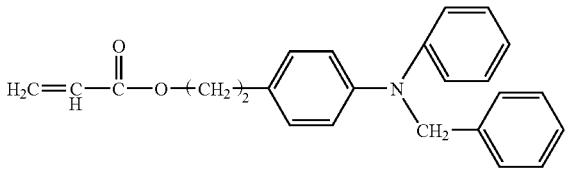

Example 6

-Preparation of Electrophotographic Photoconductor No. 6-

An electrophotographic photoconductor No. 6 was prepared in the same manner as in Example 1 except that the protective layer coating solution was changed to a protective layer coating solution containing the following composition.

[Composition of Protective Layer Coating Solution]

| | |
|---|---|
| Chain-polymerizable tertiary amine compound as (A) component (Exemplified Compound No. 12) represented by the following structural formula | 1 part by mass |

No. 12

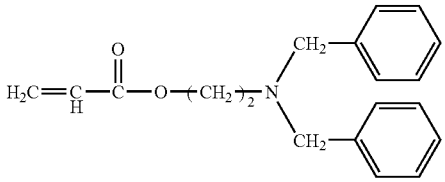

-continued

| | |
|---|---|
| Compound as (B) component represented by the following Structural Formula (iii) | 10 parts by mass |

Structural Formula (iii)

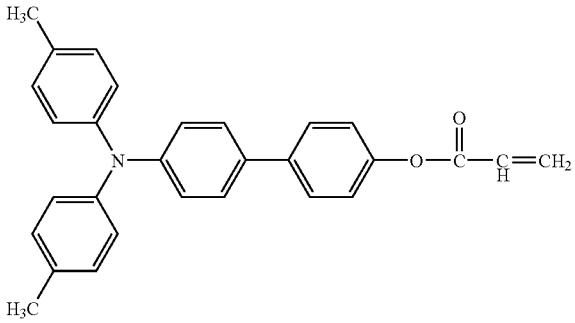

| | |
|---|---|
| Trimethylol propane triacrylate as (C) component (KAYARAD TMPTA, manufactured by Nippon Kayaku Co., Ltd.; molecular mass = 296; the number of functional groups = trifunctional; molecular weight/the number of functional groups = 99) | 10 parts by mass |
| Tetrahydrofuran | 119 parts by mass |

Example 7

-Preparation of Electrophotographic Photoconductor No. 7-

An electrophotographic photoconductor No. 7 was prepared in the same manner as in Example 6 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

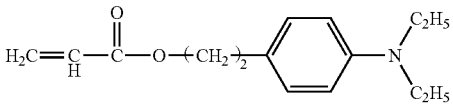

Example 8

-Preparation of Electrophotographic Photoconductor No. 8-

An electrophotographic photoconductor No. 8 was prepared in the same manner as in Example 6 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

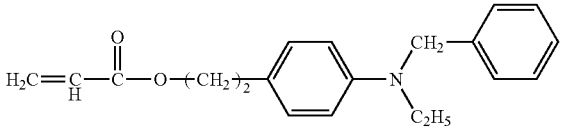

Example 9

-Preparation of Electrophotographic Photoconductor No. 9-

An electrophotographic photoconductor No. 9 was prepared in the same manner as in Example 6 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

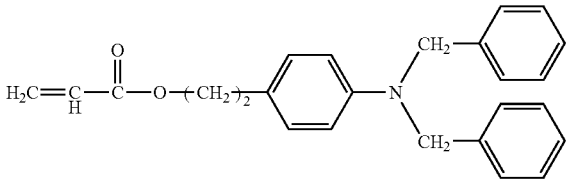

Example 10

-Preparation of Electrophotographic Photoconductor No. 10-

An electrophotographic photoconductor No. 10 was prepared in the same manner as in Example 6 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

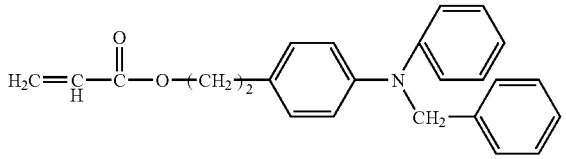

Example 11

-Preparation of Electrophotographic Photoconductor No. 11-

An electrophotographic photoconductor No. 11 was prepared in the same manner as in Example 1 except that the protective layer coating solution was changed to a protective layer coating solution containing the following composition.

| [Composition of Protective Layer Coating Solution] | |
|---|---|
| Chain-polymerizable tertiary amine compound as (A) component (Exemplified Compound No. 12) represented by the following structural formula | 1 part by mass |

No. 12

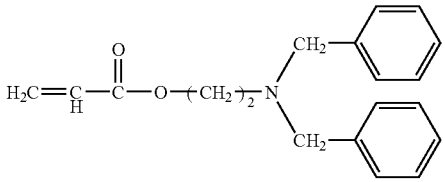

| | |
|---|---|
| Compound as (B) component represented by the following Structural Formula (iii) | 10 parts by mass |

Structural Formula (iii)

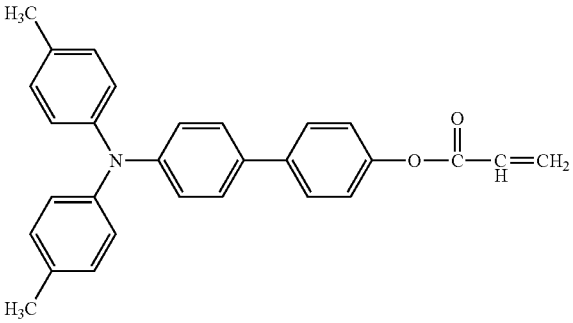

| | |
|---|---|
| Trimethylol propane triacrylate as (C) component (KAYARAD TMPTA, manufactured by Nippon Kayaku Co., Ltd.; molecular mass = 296; the number of functional groups = trifunctional; molecular weight/the number of functional groups = 99) | 10 parts by mass |
| 1-hydroxy-cyclohexyl-phenyl-ketone as (D) component (IRGACURE 184, manufactured by Chiba Specialty Chemicals K.K.) | 1 part by mass |
| Tetrahydrofuran | 124 parts by mass |

Example 12

-Preparation of Electrophotographic Photoconductor No. 12-

An electrophotographic photoconductor No. 12 was prepared in the same manner as in Example 11 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

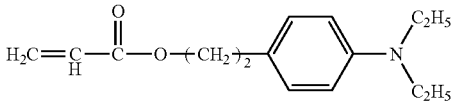

Example 13

-Preparation of Electrophotographic Photoconductor No. 13-

An electrophotographic photoconductor No. 13 was prepared in the same manner as in Example 11 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

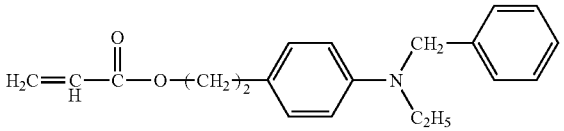

Example 14

-Preparation of Electrophotographic Photoconductor No. 14-

An electrophotographic photoconductor No. 14 was prepared in the same manner as in Example 11 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

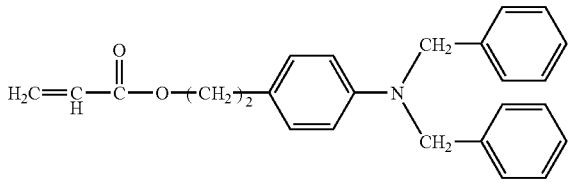

Example 15

-Preparation of Electrophotographic Photoconductor No. 15-

An electrophotographic photoconductor No. 15 was prepared in the same manner as in Example 11 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

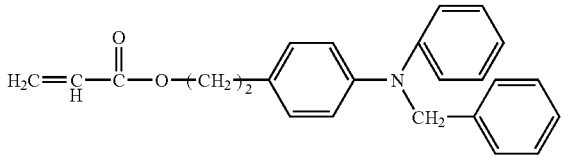

Example 16

-Preparation of Electrophotographic Photoconductor No. 16-

Over the surface of an aluminum cylinder having a diameter of 30 mm, an undercoat layer coating solution containing the following composition was applied, and the surface of the cylinder coated with the undercoat layer coating solution applied thereon was dried to form an undercoat layer having a thickness of 3.5 μm.

[Composition of Undercoat Layer Coating Solution]

| [Composition of Undercoat Layer Coating Solution] | |
|---|---|
| Alkyd resin (BECKOZOLE 1307-60-EL, manufactured by Dainippon Ink and Chemicals, Inc.) | 6 parts by mass |
| Melamine resin (SUPER BECKAMINE G-821-60, manufactured by Dainippon Ink and Chemicals, Inc.) | 4 parts by mass |
| Titanium oxide | 40 parts by mass |
| Methylethylketone | 50 parts by mass |

Next, over the surface of the obtained undercoat layer, a photosensitive layer coating solution containing the following composition was applied, and the surface was naturally dried for 20 minutes and then irradiated with a light under the conditions of metal halide lamp: 160 W/cm, distance of irradiation: 110 mm, intensity of irradiation: 750 mW/cm$^2$, and irradiation time: 240 seconds to thereby harden the cylinder surface. The cylinder surface was further dried at 130° C. for 20 minutes to form a photosensitive layer having a thickness of 33 μm. Through the above-noted process, an electrophotographic photoconductor No. 16 was prepared.

| [Composition of Photosensitive Layer Coating Solution] | |
|---|---|
| X-type metal-free phthalocyanine (FASTOGEN BLUE 8120B, manufactured by Dainippon Ink and Chemicals, Inc.) | 2 parts by mass |
| Charge transporting material represented by the following structural formula | 30 parts by mass |

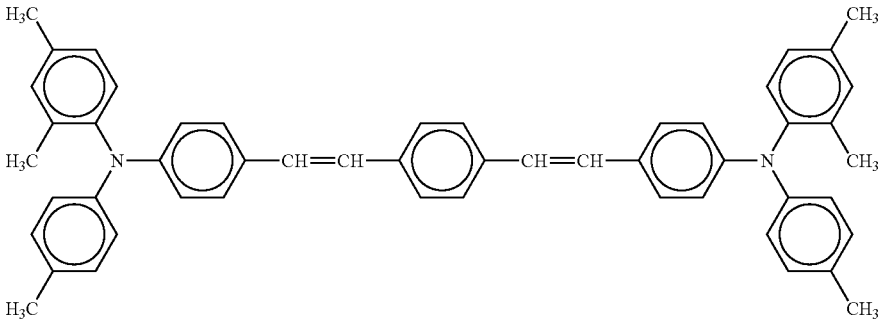

-continued

| [Composition of Photosensitive Layer Coating Solution] | |
|---|---|
| Charge transporting material represented by the following structural formula | 18 parts by mass |

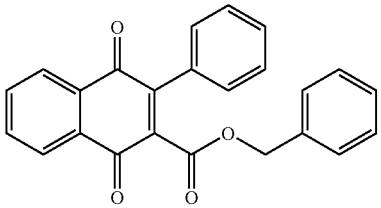

| | |
|---|---|
| Charge transporting material represented by the following structural formula | 2 parts by mass |

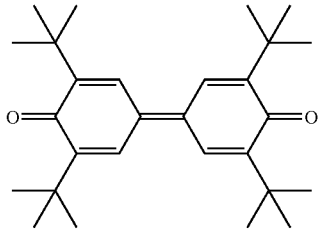

| | |
|---|---|
| Chain-polymerizable tertiary amine compound as (A) component (Exemplified Compound No. 12) represented by the following structural formula | 5 parts by mass |

No. 12

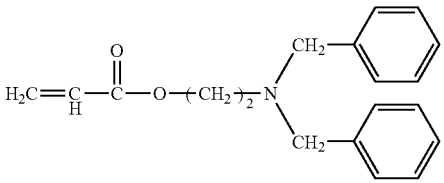

| | |
|---|---|
| Compound as (B) component represented by the following Structural Formula (iii) | 50 parts by mass |

Structural Formula (iii)

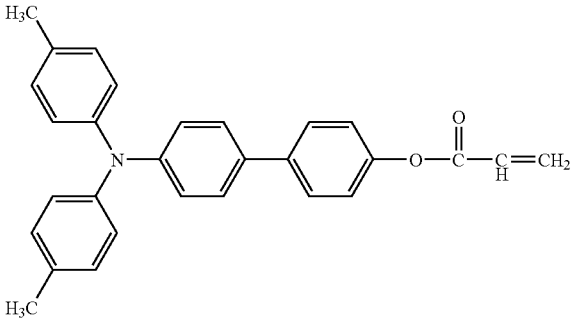

| | |
|---|---|
| Trimethylol propane triacrylate as (C) component (KAYARAD TMPTA, manufactured by Nippon Kayaku Co., Ltd.; molecular mass = 296; the number of functional groups = trifunctional; molecular weight/the number of functional groups = 99) | 50 parts by mass |
| 1-hydrocy-cyclohexyl-phenyl-ketone as (D) component (IRGACURE 184, manufactured by Chiba Specialty Chemicals K.K.) | 5 parts by mass |
| Tetrahydrofuran | 648 parts by mass |

Example 17

-Preparation of Electrophotographic Photoconductor No. 17-

An electrophotographic photoconductor No. 17 was prepared in the same manner as in Example 16 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

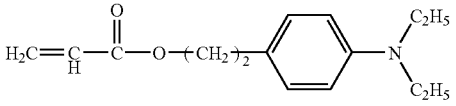

Example 18

-Preparation of Electrophotographic Photoconductor No. 18-

An electrophotographic photoconductor No. 18 was prepared in the same manner as in Example 16 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

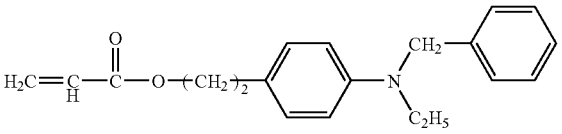

Example 19

-Preparation of Electrophotographic Photoconductor No. 19-

An electrophotographic photoconductor No. 19 was prepared in the same manner as in Example 16 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

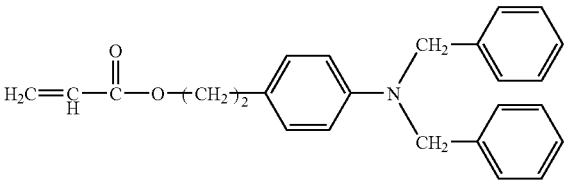

Example 20

-Preparation of Electrophotographic Photoconductor No. 20-

An electrophotographic photoconductor No. 20 was prepared in the same manner as in Example 16 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

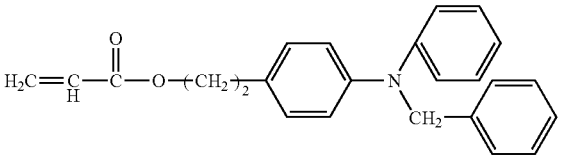

Example 21

-Preparation of Electrophotographic Photoconductor No. 21-

Over the surface of an aluminum cylinder having a diameter of 30 mm, an undercoat layer coating solution containing the following composition and a charge generating layer coating solution containing the following composition were respectively applied, and the surface of the cylinder coated with these coating solutions was sequentially dried to thereby form an undercoat layer having a thickness of 3.5 μm and a charge generating layer having a thickness of 0.2 μm respectively on the cylinder surface.

| [Composition of Undercoat Layer Coating Solution] | |
|---|---|
| Alkyd resin (BECKOZOLE 1307-60-EL, manufactured by Dainippon Ink and Chemicals, Inc.) | 6 parts by mass |
| Melamine resin (SUPER BECKAMINE G-821-60, manufactured by Dainippon Ink and Chemicals, Inc.) | 4 parts by mass |
| Titanium oxide | 40 parts by mass |
| Methylethylketone | 50 parts by mass |
| [Composition of Charge Generating Layer Coating Solution] | |
| Polyvinylbutyral (XYHL, manufactured by UCC) | 0.5 parts by mass |
| Cyclohexanone | 200 parts by mass |
| Methylethylketone | 80 parts by mass |

-continued

| | |
|---|---|
| Bisazo pigment represented by the following Structural Formula (i) | 2.4 parts by mass |

Structural Formula (i)

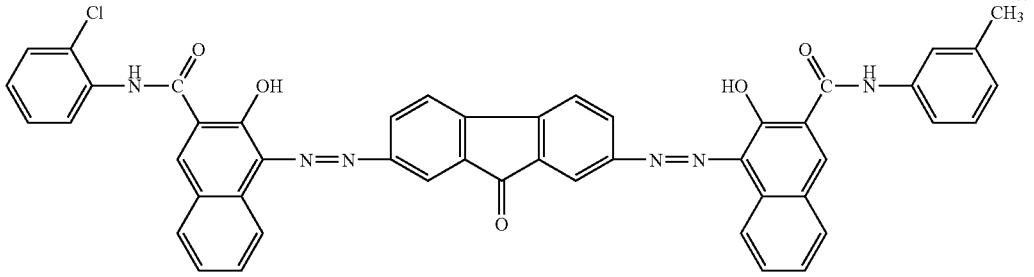

Next, the obtained charge generating layer was coated with a charge transporting layer coating solution containing the following composition by spray-coating, and the cylinder surface with the charge transporting layer coating solution applied thereon was naturally dried for 20 minutes and then irradiated with a light under the conditions of metal halide lamp: 160 W/cm, distance of irradiation: 110 mm, intensity of irradiation: 750 mW/cm$^2$, and irradiation time: 240 seconds to thereby harden the cylinder surface. The cylinder surface was further dried at 130° C. for 20 minutes to form a charge transporting layer having a thickness of 23 μm. Through the above-noted process, an electrophotographic photoconductor No. 21 was prepared.

| [Composition of Charge Transporting Layer Coating Solution] | |
|---|---|
| Low-molecular weight charge transporting material represented by the following Structural Formula (ii) | 7 parts by mass |

Structural Formula (ii)

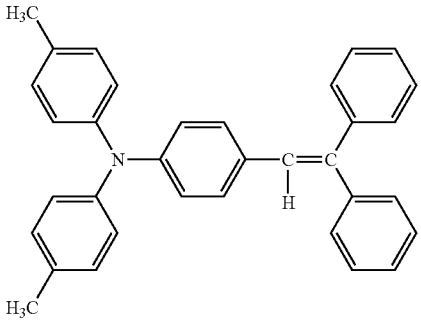

| | |
|---|---|
| Chain-polymerizable tertiary amine compound as (A) component (Exemplified Compound No. 12) represented by the following structural formula | 1 part by mass |

No. 12

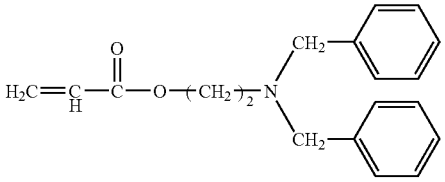

-continued

| [Composition of Charge Transporting Layer Coating Solution] | |
|---|---|
| Compound as (B) component represented by the following Structural Formula (iii) | 10 parts by mass |

Structural Formula (iii)

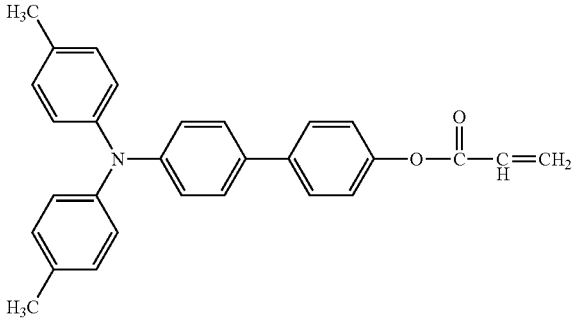

| | |
|---|---|
| Trimethylol propane triacrylate as (C) component (KAYARAD TMPTA, manufactured by Nippon Kayaku Co., Ltd.; molecular mass = 296; the number of functional groups = trifunctional; molecular weight/the number of functional groups = 99) | 10 parts by mass |
| 1-hydroxy-cyclohexyl-phenyl-ketone as (D) component (IRGACURE 184, manufactured by Chiba Specialty Chemicals K.K.) | 1 part by mass |
| Tetrahydrofuran | 116 parts by mass |

Example 22

-Preparation of Electrophotographic Photoconductor No. 22-

An electrophotographic photoconductor No. 22 was prepared in the same manner as in Example 21 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

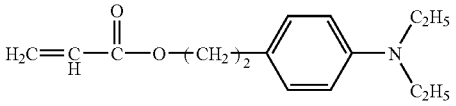

Example 23

-Preparation of Electrophotographic Photoconductor No. 23-

An electrophotographic photoconductor No. 23 was prepared in the same manner as in Example 21 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

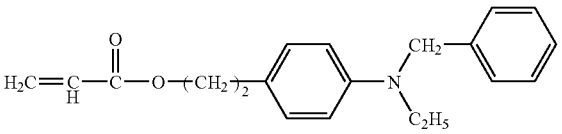

Example 24

-Preparation of Electrophotographic Photoconductor No. 24-

An electrophotographic photoconductor No. 24 was prepared in the same manner as in Example 21 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

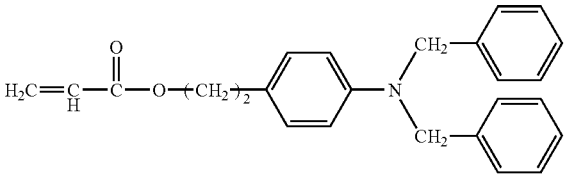

Example 25

-Preparation of Electrophotographic Photoconductor No. 25-

An electrophotographic photoconductor No. 25 was prepared in the same manner as in Example 21 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

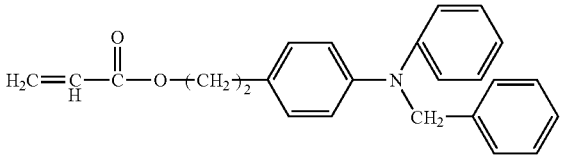

Example 26

-Preparation of Electrophotographic Photoconductor No. 26-

Over the surface of an aluminum cylinder having a diameter of 30 mm, an undercoat layer coating solution containing the following composition and a photosensitive layer coating solution containing the following composition were respectively applied, and the surface of the cylinder coated with these coating solutions was sequentially dried to thereby form an undercoat layer having a thickness of 3.5 μm and a photosensitive layer having a thickness of 28 μm respectively on the cylinder surface.

[Composition of Undercoat Layer Coating Solution]

| [Composition of Undercoat Layer Coating Solution] | |
|---|---|
| Alkyd resin (BECKOZOLE 1307-60-EL, manufactured by Dainippon Ink and Chemicals, Inc.) | 6 parts by mass |
| Melamine resin (SUPER BECKAMINE G-821-60, manufactured by Dainippon Ink and Chemicals, Inc.) | 4 parts by mass |
| Titanium oxide | 40 parts by mass |
| Methylethylketone | 50 parts by mass |
| [Composition of Photosensitive Layer Coating Solution] | |
| X-type metal-free phthalocyanine (FASTOGEN BLUE 8120B, manufactured by Dainippon Ink and Chemicals, Inc.) | 2 parts by mass |
| Charge transporting material represented by the following structural formula | 30 parts by mass |

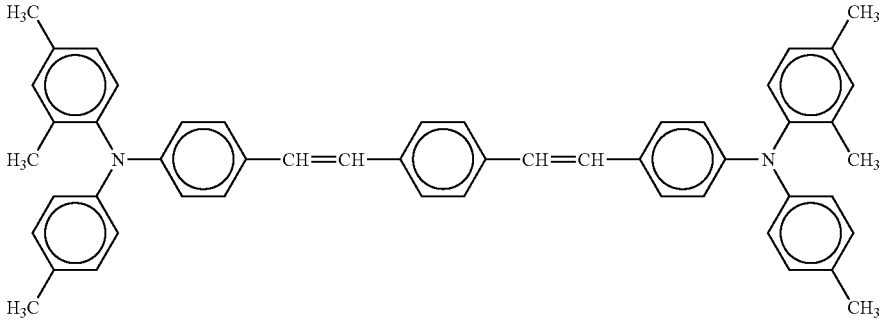

| | |
|---|---|
| Charge transporting material represented by the following structural formula | 18 parts by mass |

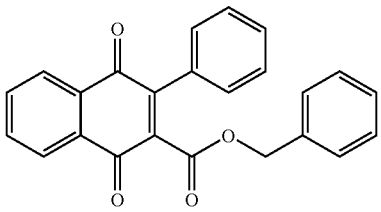

| | |
|---|---|
| Charge transporting material represented by the following structural formula | 2 parts by mass |

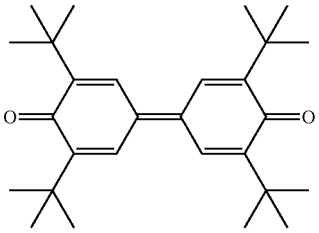

-continued

| [Composition of Undercoat Layer Coating Solution] | |
|---|---|
| Bisphenol Z polycarbonate (PANLIGHT TS-2050, manufactured by Teijin Chemicals, Ltd.) | 50 parts by mass |
| Tetrahydrofuran | 500 parts by mass |

Next, the obtained photosensitive layer was coated with a protective layer coating solution containing the following composition by spray-coating, and the cylinder surface with the protective layer coating solution applied thereon was naturally dried for 20 minutes and then irradiated with a light under the conditions of metal halide lamp: 160 W/cm, distance of irradiation: 110 mm, intensity of irradiation: 750 mW/cm$^2$, and irradiation time: 240 seconds to thereby harden the cylinder surface. The cylinder surface was further dried at 130° C. for 20 minutes to form a protective layer having a thickness of 5.0 μm. Through the above-noted process, an electrophotographic photoconductor No. 26 was prepared.

Example 27

-Preparation of Electrophotographic Photoconductor No. 27-

An electrophotographic photoconductor No. 27 was prepared in the same manner as in Example 26 except that the chain-polymerizable tertiary amine compound composed of the (A) component (Exemplified Compound No. 12) was changed to a chain-polymerizable tertiary amine compound (Exemplified Compound No. 21) represented by the following structural formula.

| [Composition of Protective Layer Coating Solution] | |
|---|---|
| Chain-polymerizable tertiary amine compound as (A) component (Exemplified Compound No. 12) represented by the following structural formula | 1 part by mass |

No. 12

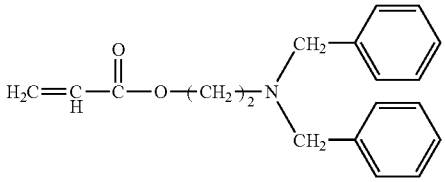

| | |
|---|---|
| Compound as (B) component represented by the following Structural Formula (iii) | 10 parts by mass |

Structural Formula (iii)

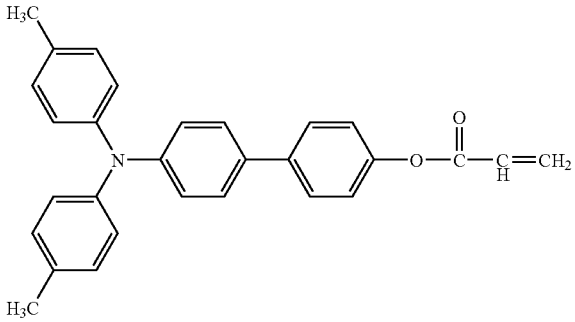

| | |
|---|---|
| Trimethylol propane triacrylate as (C) component (KAYARAD TMPTA, manufactured by Nippon Kayaku Co., Ltd.; molecular mass = 296; the number of functional groups = trifunctional; molecular weight/the number of functional groups = 99) | 10 parts by mass |
| 1-hydroxy-cyclohexyl-phenyl-ketone as (D) component (IRGACURE 184, manufactured by Chiba Specialty Chemicals K.K.) | 1 part by mass |
| Tetrahydrofuran | 124 parts by mass |

No. 21

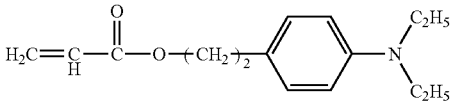

Example 28

-Preparation of Electrophotographic Photoconductor No. 28-

An electrophotographic photoconductor No. 28 was prepared in the same manner as in Example 26 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

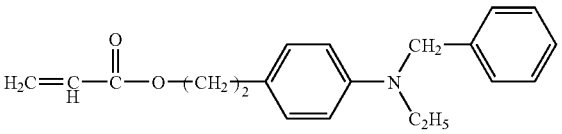

Example 29

-Preparation of Electrophotographic Photoconductor No. 29-

An electrophotographic photoconductor No. 29 was prepared in the same manner as in Example 26 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

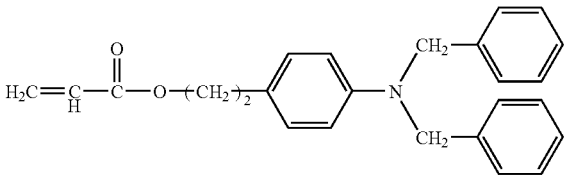

Example 30

-Preparation of Electrophotographic Photoconductor No. 30-

An electrophotographic photoconductor No. 30 was prepared in the same manner as in Example 26 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

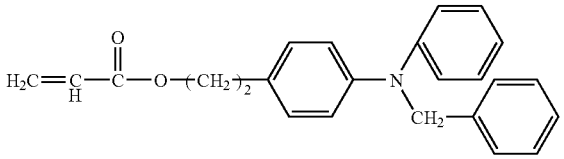

Example 31

-Preparation of Electrophotographic Photoconductor No. 31-

An electrophotographic photoconductor No. 31 was prepared in the same manner as in Example 11 except that the compound composed of the (B) component represented by the Structural Formula (iii) was changed to a compound represented by the following Structural Formula (Iv).

Structural Formula (iv)

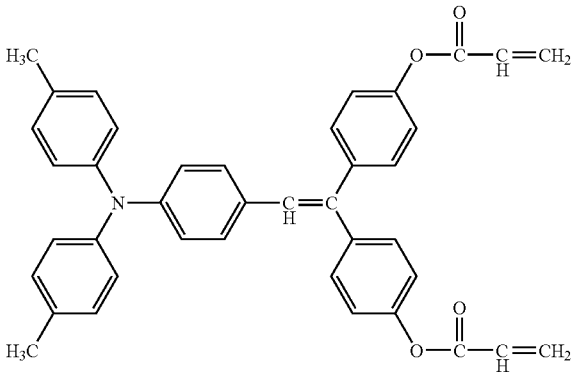

Example 32

-Preparation of Electrophotographic Photoconductor No. 32-

An electrophotographic photoconductor No. 32 was prepared in the same manner as in Example 31 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

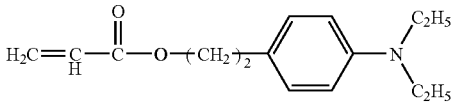

Example 33

-Preparation of Electrophotographic Photoconductor No. 33-

An electrophotographic photoconductor No. 33 was prepared in the same manner as in Example 31 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

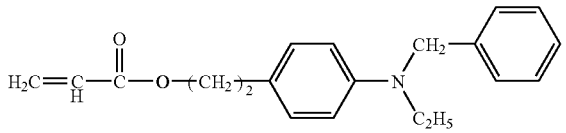

Example 34

-Preparation of Electrophotographic Photoconductor No. 34-

An electrophotographic photoconductor No. 34 was prepared in the same manner as in Example 31 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

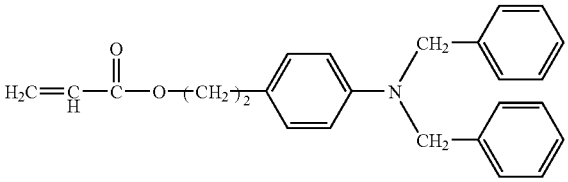

Example 35

-Preparation of Electrophotographic Photoconductor No. 35-

An electrophotographic photoconductor No. 35 was prepared in the same manner as in Example 31 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

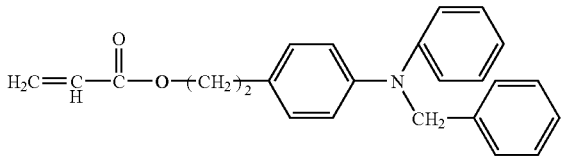

Example 36

-Preparation of Electrophotographic Photoconductor No. 36-

An electrophotographic photoconductor No. 36 was prepared in the same manner as in Example 1 except that the protective layer coating solution was changed to a protective layer coating solution represented by the following structural formula.

| [Composition of Protective Layer Coating Solution] | |
|---|---|
| Chain-polymerizable tertiary amine compound as (A) component (Exemplified Compound No. 54) represented by the following structural formula | 1 part by mass |

No. 54

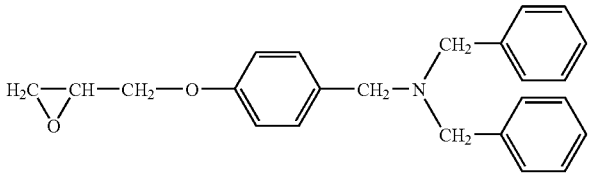

| | |
|---|---|
| Compound as (B) component represented by the following structural formula (vi) | 10 parts by mass |

Structural Formula (vi)

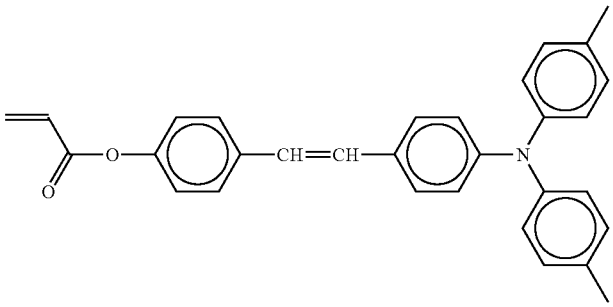

| | |
|---|---|
| Diethylene glycol | 2 parts by mass |
| $(C_6H_5)_3SAsF_6$ | 1 part by mass |
| Tetrahydrofuran | 100 parts by mass |

Example 37

-Preparation of Electrophotographic Photoconductor No. 37-

An electrophotographic photoconductor No. 37 was prepared in the same manner as in Example 11 except that the compound composed of the (B) component represented by the Structural Formula (iii) was changed to a chain-polymerizable charge transporting compound (Exemplified Compound No. 67) represented by the following structural formula.

No. 67

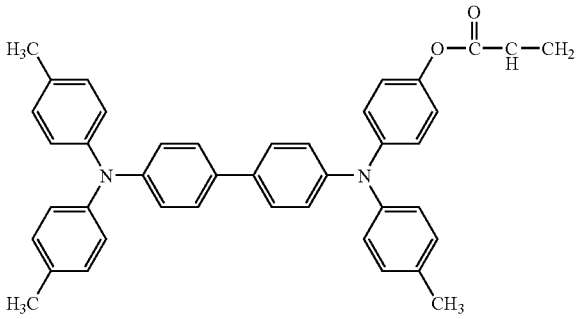

Example 38

-Preparation of Electrophotographic Photoconductor No. 38-

An electrophotographic photoconductor No. 38 was prepared in the same manner as in Example 37 except that the chain-polymerizable tertiary amine compound composed of the (A) component (Exemplified Compound No. 12) was changed to a chain-polymerizable tertiary amine compound (Exemplified Compound No. 21) represented by the following structural formula.

No. 21

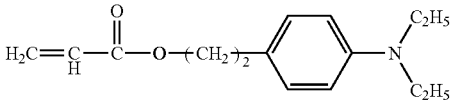

Example 39

-Preparation of Electrophotographic Photoconductor No. 39-

An electrophotographic photoconductor No. 39 was prepared in the same manner as in Example 37 except that the chain-polymerizable tertiary amine compound composed of the (A) component (Exemplified Compound No. 12) was changed to a chain-polymerizable tertiary amine compound (Exemplified Compound No. 22) represented by the following structural formula.

No. 22

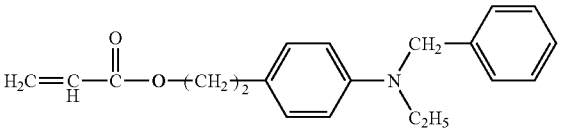

Example 40

-Preparation of Electrophotographic Photoconductor No. 40-

An electrophotographic photoconductor No. 40 was prepared in the same manner as in Example 31 except that the chain-polymerizable tertiary amine compound composed of the (A) component (Exemplified Compound No. 12) was changed to a chain-polymerizable tertiary amine compound (Exemplified Compound No. 23) represented by the following structural formula.

No. 23

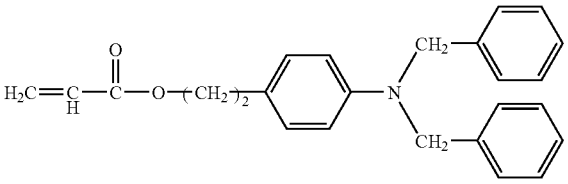

Example 41

-Preparation of Electrophotographic Photoconductor No. 41-

An electrophotographic photoconductor No. 41 was prepared in the same manner as in Example 37 except that the chain-polymerizable tertiary amine compound composed of the (A) component (Exemplified Compound No. 12) was changed to a chain-polymerizable tertiary amine compound (Exemplified Compound No. 26) represented by the following structural formula.

No. 26

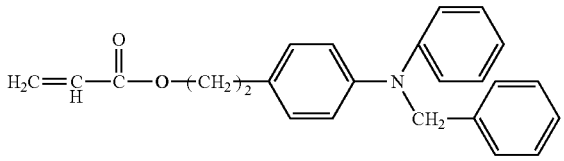

Comparative Example 1

-Preparation of Comparison Electrophotographic Photoconductor No. 1-

A comparison electrophotographic photoconductor No. 1 was prepared in the same manner as in Example 11 except that the chain-polymerizable tertiary amine compound composed of the (A) component (Exemplified Compound No. 12) was not added, and the content of tetrahydrofuran used in the protective layer coating solution was changed to 119 parts by mass.

Comparative Example 2

-Preparation of Comparison Electrophotographic Photoconductor No. 2-

A comparison electrophotographic photoconductor No. 2 was prepared in the same manner as in Example 11 except that the chain-polymerizable tertiary amine compound composed of the (A) component (Exemplified Compound No. 12) was changed to a compound represented by the following Structural Formula (v) (the tertiary amine compound described in Japanese Patent Application Laid-Open (JP-A) No. 2004-102080).

Structural Formula (v)

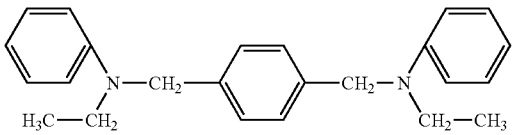

Comparative Example 3

-Preparation of Comparison Electrophotographic Photoconductor No. 3-

A comparison electrophotographic photoconductor No. 3 was prepared in the same manner as in Example 16 except that the chain-polymerizable tertiary amine compound composed of the (A) component (Exemplified Compound No. 12) was not added, and the content of tetrahydrofuran used in the photosensitive layer coating solution was changed to 628 parts by mass.

Comparative Example 4

-Preparation of Comparison Electrophotographic Photoconductor No. 4-

A comparison electrophotographic photoconductor No. 4 was prepared in the same manner as in Example 16 except that the chain-polymerizable tertiary amine compound composed of the (A) component (Exemplified Compound No. 12) was changed to a compound represented by the following Structural Formula (v) (the tertiary amine compound described in Japanese Patent Application Laid-Open (JP-A) No. 2004-102080).

Structural Formula (v)

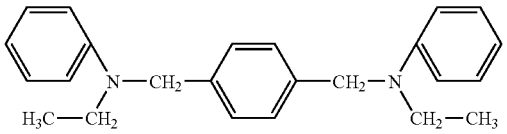

Comparative Example 5

-Preparation of Comparison Electrophotographic Photoconductor No. 5-

A comparison electrophotographic photoconductor No. 5 was prepared in the same manner as in Example 21 except that the chain-polymerizable tertiary amine compound composed of the (A) component (Exemplified Compound No. 12) was not added, and the content of tetrahydrofuran used in the charge transporting layer coating solution was changed to 112 parts by mass.

Comparative Example 6

-Preparation of Comparison Electrophotographic Photoconductor No. 6-

A comparison electrophotographic photoconductor No. 6 was prepared in the same manner as in Example 21 except that the chain-polymerizable tertiary amine compound composed of the (A) component (Exemplified Compound No. 12) was changed to a compound represented by the following Structural Formula (v) (the tertiary amine compound described in Japanese Patent Application Laid-Open (JP-A) No. 2004-102080).

Structural Formula (v)

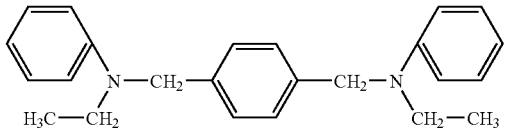

Comparative Example 7

-Preparation of Comparison Electrophotographic Photoconductor No. 7-

A comparison electrophotographic photoconductor No. 7 was prepared in the same manner as in Example 26 except that the chain-polymerizable tertiary amine compound composed of the (A) component (Exemplified Compound No. 12) was not added, and the content of tetrahydrofuran used in the protective layer coating solution was changed to 119 parts by mass.

Comparative Example 8

-Preparation of Comparison Electrophotographic Photoconductor No. 8-

A comparison electrophotographic photoconductor No. 8 was prepared in the same manner as in Example 26 except that the chain-polymerizable tertiary amine compound composed of the (A) component (Exemplified Compound No. 12) was changed to a compound represented by the following Structural Formula (v) (the tertiary amine compound described in Japanese Patent Application Laid-Open (JP-A) No. 2004-102080).

Structural Formula (v)

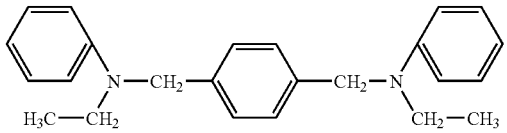

<Image Formation and Evaluation>

The thus prepared electrophotographic photoconductors of Examples 1 to 41 and Comparative Examples 1 to 8 were respectively mounted to a process cartridge and set in a remodeled image forming apparatus (IMAGIO MF2200, manufactured by Ricoh Company Ltd.) based on a digital method using a semiconductor laser (LD) having a wavelength of 655 nm as an image exposing light source with an electric potential in dark condition set to 800 (−V) and then 100,000 sheets in total were successively printed out to perform repeat tests.

-Evaluation on Image Quality and Electric Potential Change in Bright Condition-

Images output in early stage of the repeat test and images output after printing out 100,000 sheets were visually checked, and the prepared photoconductors were evaluated as to the image quality. Table 1-A, Table 1-B, and Table 2 show the evaluation results.

The electric potential in bright condition in the early stage of the repeat test and the electric potential in bright condition after the repeat test of outputting 100,000 sheets were measured, and a change in electric potential was calculated. Table 1-A, Table 1-B, and Table 2 show the calculation results.

-Surface Roughness of Photoconductor-

The surface roughness of the each of the photoconductors after the repeat test of outputting 100,000 sheets was measured. Specifically, the surface wave parameter Sm (JIS-1082 Standard, average length of concavoconvex) was measured using a needle surface roughness measurement apparatus (Surfcom, manufactured by Tokyo Seimitsu Co., Ltd. equipped with a pick-up of E-DT-SO2A, manufactured by Tokyo Seimitsu Co., Ltd.). Tables 1-A, 1-B, and Table 2 show the measurement results. A greater surface wave parameter (Sm) indicates a smoother photoconductive surface. Specifically, the photoconductor surface is preferably in a condition that the surface wave parameter (Sm) is 400 μm or more.

-Image Blur (Reduction in Dot Resolution)-

After the repeat test of outputting 100,000 sheets, 10 sheets of a dot-image with image density of 5% image-area ratio chart of 600 dpi×600 dpi were successively printed out to evaluate the respective photoconductors as to image blur (reduction in dot resolution). Specifically, the dot configurations of the printed ten sheets were observed using a stereoscopic microscope, and the sharpness level of the outline of the dot configurations was classified into 5 levels based on the following criteria (level 5: excellent, level 1: poor) to thereby evaluate the respective photoconductors. Table 1-A, Table 1B, and Table 2 show the evaluation results.

[Dot-image Evaluation Criteria]

5: The outline of the dot configuration was clear and excellent.

4: A very slight amount of outline-blur was observed, however, the outline was excellent.

3: A slight amount of outline-blur was observed, however, the outline was substantially excellent.

2: Outline-blur portions were observed, which may cause a problem depending on the type of image.

1: It was impossible to make a sharp distinction on a dot image.

TABLE 1-A

| | | | After printing out 100,000 sheets | | | | |
|---|---|---|---|---|---|---|---|
| | Photoconductor No. | Image quality in early stage | Image quality | Electric potential change in bright condition (-V) | Evaluation on image blur (Rank) | Reduced film thickness (μm) | Sm (μm) |
| Ex. 1 | Photoconductor No. 1 | excellent | excellent | 20 | 4 | 3.7 | 60 |
| Ex. 2 | Photoconductor No. 2 | excellent | excellent | 10 | 4 | 4.0 | 70 |
| Ex. 3 | Photoconductor No. 3 | excellent | excellent | 10 | 4 | 4.2 | 70 |
| Ex. 4 | Photoconductor No. 4 | excellent | excellent | 10 | 4 | 4.3 | 70 |
| Ex. 5 | Photoconductor No. 5 | excellent | excellent | 10 | 3 | 3.8 | 80 |
| Ex. 6 | Photoconductor No. 6 | excellent | excellent | 20 | 4 | 3.1 | 100 |
| Ex. 7 | Photoconductor No.7 | excellent | excellent | 15 | 4 | 3.3 | 110 |
| Ex. 8 | Photoconductor No.8 | excellent | excellent | 10 | 4 | 3.3 | 110 |
| Ex. 9 | Photoconductor No. 9 | excellent | excellent | 10 | 4 | 3.3 | 120 |
| Ex. 10 | Photoconductor No. 10 | excellent | excellent | 10 | 3 | 3.2 | 120 |
| Ex. 11 | Photoconductor No. 11 | excellent | excellent | 20 | 4 | 2.7 | 410 |
| Ex. 12 | Photoconductor No. 12 | excellent | excellent | 15 | 4 | 3.0 | 450 |
| Ex. 13 | Photoconductor No. 13 | excellent | excellent | 10 | 4 | 3.0 | 420 |
| Ex. 14 | Photoconductor No. 14 | excellent | excellent | 10 | 4 | 2.9 | 440 |
| Ex. 15 | Photoconductor No. 15 | excellent | excellent | 10 | 3 | 2.8 | 460 |
| Ex. 16 | Photoconductor No. 16 | excellent | excellent | 60 | 4 | 19.3 | 110 |
| Ex. 17 | Photoconductor No. 17 | excellent | excellent | 40 | 3 | 19.9 | 120 |
| Ex. 18 | Photoconductor No. 18 | excellent | excellent | 30 | 3 | 20.3 | 120 |
| Ex. 19 | Photoconductor No. 19 | excellent | excellent | 30 | 3 | 20.8 | 120 |
| Ex. 20 | Photoconductor No. 20 | excellent | excellent | 40 | 3 | 19.7 | 130 |

TABLE 1-B

| | Photoconductor No. | Image quality in early stage | After printing out 100,000 sheets: Image quality | Electric potential change in bright condition (-V) | Evaluation on image blur (rank) | Reduced film thickness (μm) | Sm (μm) |
|---|---|---|---|---|---|---|---|
| Ex. 21 | Photoconductor No. 21 | excellent | excellent | 30 | 4 | 14.2 | 140 |
| Ex. 22 | Photoconductor No. 22 | excellent | excellent | 10 | 4 | 14.1 | 150 |
| Ex. 23 | Photoconductor No. 23 | excellent | excellent | 20 | 3 | 14.5 | 150 |
| Ex. 24 | Photoconductor No. 24 | excellent | excellent | 20 | 3 | 15.2 | 160 |
| Ex. 25 | Photoconductor No. 25 | excellent | excellent | 40 | 3 | 14.8 | 160 |
| Ex. 26 | Photoconductor No. 26 | excellent | excellent | 50 | 4 | 2.7 | 410 |
| Ex. 27 | Photoconductor No. 27 | excellent | excellent | 30 | 4 | 3.0 | 450 |
| Ex. 28 | Photoconductor No. 28 | excellent | excellent | 30 | 4 | 3.0 | 420 |
| Ex. 29 | Photoconductor No. 29 | excellent | excellent | 30 | 4 | 2.9 | 440 |
| Ex. 30 | Photoconductor No. 30 | excellent | excellent | 20 | 3 | 2.8 | 460 |
| Ex. 31 | Photoconductor No. 31 | excellent | excellent | 20 | 4 | 2.8 | 420 |
| Ex. 32 | Photoconductor No. 32 | excellent | excellent | 15 | 4 | 2.9 | 440 |
| Ex. 33 | Photoconductor No. 33 | excellent | excellent | 10 | 4 | 3.0 | 430 |
| Ex. 34 | Photoconductor No. 34 | excellent | excellent | 10 | 4 | 3.0 | 440 |
| Ex. 35 | Photoconductor No. 35 | excellent | excellent | 10 | 3 | 3.0 | 460 |
| Ex. 36 | Photoconductor No. 36 | excellent | excellent | 30 | 4 | 2.6 | 110 |
| Ex. 37 | Photoconductor No. 37 | excellent | excellent | 15 | 5 | 2.2 | 460 |
| Ex. 38 | Photoconductor No. 38 | excellent | excellent | 10 | 5 | 2.5 | 480 |
| Ex. 39 | Photoconductor No. 39 | excellent | excellent | 10 | 5 | 2.4 | 480 |
| Ex. 40 | Photoconductor No. 40 | excellent | excellent | 10 | 5 | 2.3 | 480 |
| Ex. 41 | Photoconductor No. 41 | excellent | excellent | 10 | 4 | 2.4 | 490 |

TABLE 2

| | Photoconductor No. | Image quality in an early stage | After printing out 100,000 sheets: Quality of image | Electric potential change in bright condition (−V) | Evaluation on image blur (rank) | Reduced film thickness (μm) | Sm (μm)) |
|---|---|---|---|---|---|---|---|
| Compara. Ex. 1 | Comparison photoconductor No. 1 | excellent | Image density was reduced | 90 | 1 | 2.1 | 500 |
| Compara. Ex. 2 | Comparison photoconductor No. 2 | excellent | Background smear occurred | 20 | 3 | 14.2 | 390 |
| Compara. Ex. 3 | Comparison photoconductor No. 3 | excellent | Image density was reduced | 90 | 1 | 18.9 | 130 |
| Compara. Ex. 4 | Comparison photoconductor No. 4 | excellent | Background smear occurred | 60 | 3 | 27.2 | 80 |

TABLE 2-continued

| | Photoconductor No. | Image quality in an early stage | Quality of image | After printing out 100,000 sheets: Electric potential change in bright condition (−V) | Evaluation on image blur (rank) | Reduced film thickness (μm) | Sm (μm)) |
|---|---|---|---|---|---|---|---|
| Compara. Ex. 5 | Comparison photoconductor No. 5 | excellent | Image density was reduced | 90 | 1 | 14.0 | 140 |
| Compara. Ex. 6 | Comparison photoconductor No. 6 | excellent | Background smear occurred | 30 | 3 | 18.5 | 100 |
| Compara. Ex. 7 | Comparison photoconductor No. 7 | excellent | Image density was reduced | 90 | 1 | 2.6 | 500 |
| Compara. Ex. 8 | Comparison photoconductor No. 8 | excellent | Background smear occurred | 50 | 3 | 14.5 | 390 |

The results shown in Tables 1-A, 1-B, and 2A demonstrated that the photoconductors 1 to 41 showed excellent quality of images even after printing out 100,000 sheets and had excellent evaluation results on image blur (reduction in dot resolution) as compared to the photoconductors of Comparative Examples 1 to 8. It was verified that reductions in resolution can be significantly prevented by adding a chain-polymerizable group-containing tertiary amine compound composed of the (A) component in which at least one alkyl group was bound to a nitrogen atom constituting an amine structure.

In contrast, the photoconductor of Comparative Example 1 was excellent in abrasion resistance, however, after printing out 100,000 sheets, a reduction in image density and a reduction in dot resolution were caused. The photoconductors of Comparative Examples 3, 5, and 7 also had similar results to the results of the photoconductor of Comparative Example 1.

For the photoconductor of Comparative Example 2, the reduction in resolution after repetitive use, i.e., the reduction in resolution after printing out 100,000 sheets was small, however, the abrasion reached to the charge transporting layer disposed under the protective layer, and the abrasion resistance of the photoconductor after repetitive use was very low. As the result, background smear occurred which was seemed to be attributable to reduction in electric potential in dark condition. The photoconductors of Comparative Examples 4, 6, and 8 also had similar results to the results of the photoconductor of Comparative Example 2.

The photoconductors of Examples 11 to 15, 26 to 35, and 37 to 41 respectively had a small reduction in film thickness even after printing out 100,000 sheets, however, had a large surface wave parameter Sm indicating surface roughness. Here, a larger surface wave parameter (Sm) indicates a smoother surface. Specifically, a photoconductor is preferably in a condition that the surface wave parameter (Sm) is 40 μm or more. Summarizing the above, it was verified that the electrophotographic photoconductor of the present invention containing a hardened material that can be obtained by polymerizing a mixture of (A), (B), (C), and (D) components through chain polymerization is excellent in abrasion resistance and has a smooth surface with low-surface roughness.

From the test results of the photoconductors of Examples 37 to 41, it was verified that a photoconductor prepared by using a chain-polymerizable charge transporting compound composed of the (B) component represented by the Exemplified Compound No. 67 showed particularly excellent results in evaluations on image quality and image blur (reduction in dot resolution) even after printing out 100,000 sheets.

Examples 42 to 46 and Comparative Example 9

The electrophotographic photoconductors prepared in Examples 11 to 15 and Comparative Example 1 (Photoconductor Nos. 11 to 15 and Comparison Photoconductor No. 1) were left intact in a desiccator in which a nitrogen oxide (NOx) gas concentration was adjusted to 50 ppm for four days, and the quality of images before/after leaving the photoconductors in the desiccator was evaluated in the same manner as in Examples 1 to 41. Table 3 shows the evaluation results.

TABLE 3

| | Photoconductor No. | Image quality in early stage | After leaving photoconductor in the desiccator: Image quality | Evaluation on image blur (rank) |
|---|---|---|---|---|
| Ex. 42 | Photoconductor No. 11 | excellent | excellent | 4 |
| Ex. 43 | Photoconductor No. 12 | excellent | excellent | 4 |
| Ex. 44 | Photoconductor No. 13 | excellent | excellent | 4 |
| Ex. 45 | Photoconductor No. 14 | excellent | excellent | 3 |
| Ex. 46 | Photoconductor No. 15 | excellent | excellent | 2 |
| Compara. Ex. 9 | Comparison photoconductor No. 1 | excellent | Image density was reduced | 1 |

The results shown in Table 3 demonstrated that in the photoconductors of Examples 42 to 46, the resistance to oxidized gas, i.e., the effect of preventing occurrences of image blur (reduction in dot resolution) could be drastically improved by adding a chain-polymerizable group-containing tertiary amine compound composed of the (A) component in which at least one alkyl group was bound to a nitrogen atom constituting an amine structure.

In contrast, it was recognized that the photoconductor of Comparative Example 9 containing no chain-polymerizable tertiary amine compound composed of the (A) component showed excellent image quality in the early stage of the repeat test, however, a significant reduction in resolution occurred due to oxidized gas.

Further, the results shown in Table 3 demonstrated that with the use of the photoconductor prepared by using a chain-polymerizable group-containing tertiary amine compound in which two alkyl groups were bound to a nitrogen atom constituting an amine structure (Examples 43 to 45), and with the use of the photoconductor prepared by using a chain-polymerizable group-containing tertiary amine compound in which three alkyl groups were bound to a nitrogen atom constituting an amine structure (Example 42), the evaluation results on image blur (reduction in dot resolution) tended to be excellent as compared to when a photoconductor prepared by using a chain-polymerizable group-containing tertiary amine compound in which only one alkyl group was bound to a nitrogen atom constituting an amine structure (Example 46) was used. In other words, it was demonstrated that a photoconductor having more excellent electric properties can be prepared by using a chain-polymerizable group-containing tertiary amine compound in which two or more alkyl groups were bound to a nitrogen atom constituting an amine structure.

With the use of an image forming method using the electrophotographic photoconductor of the present invention, and an image forming apparatus using the electrophotographic photoconductor of the present invention, and a process cartridge using the electrophotographic photoconductor of the present invention, images can be stably formed with improved durability and without reducing resolution even when repeatedly used over a long period of time and without substantially causing abnormal images such as background smear and toner-filming. The electrophotographic photoconductor of the present invention can be widely used in full-color copiers, full-color laser printers, and full-color regular paper facsimiles, etc. each using a direct or an indirect electrophotographic multicolor image developing process.

What is claimed is:

1. An electrophotographic photoconductor, comprising:

a layer containing a hardened material, wherein the hardened material is prepared by polymerizing (A) a chain-polymerizable group-containing tertiary amine compound in which at least one alkyl group is bound to a nitrogen atom constituting an amine structure through chain polymerization;

wherein the chain-polymerizable group-containing tertiary amine compound in which at least one alkyl group is bound to a nitrogen atom constituting an amine structure is a compound represented by any one of the Structural Formulas (2) and (2'), Structural Formula (2)

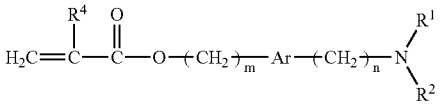

Structural Formula (2')

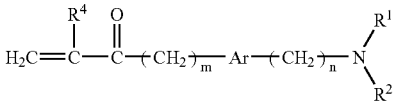

where $R^1$ and $R^2$ may be same to each other or different from each other and respectively represent any one of an alkyl group that may have a substituent group, an aromatic hydrocarbon group that may have a substituent group, a group represented by the following Structural Formula (1-1), and a group represented by the following Structural Formula (1-2), Structural Formula (1-1)

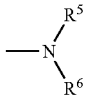

Structural Formula (1-2)

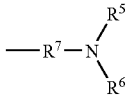

$R^1$ and $R^2$ may be bound together to form a heterocyclic ring, and the heterocyclic ring may be further substituted by a substituent group; $R^4$ represents any one of a hydrogen atom and a methyl group; Ar represents an aromatic hydrocarbon divalent group that may have a substituent group; "m" and "n" are respectively an integer of 0 to 6, and when "n" is equal to zero, any one of $R^1$ and $R^2$ represents the alkyl group that may have a substituent group or the group represented by the Structural Formula (1-2), where $R^5$ and $R^6$ may be same to each other or different from each other and respectively represent any one of an alkyl group that may have a substituent group and an aromatic hydrocarbon group that may have a substituent group; and $R^7$ represents any one of an alkylene group that may have a substituent group, an aromatic hydrocarbon divalent group that may have a substituent group, and a divalent group that is a combination thereof.

2. The electrophotographic photoconductor according to claim 1, wherein the hardened material is prepared by polymerizing (A) the chain-polymerizable tertiary amine compound in which at least one alkyl group is bound to a nitrogen atom constituting an amine structure and (B) a chain-polymerizable charge transporting compound through chain polymerization.

3. The electrophotographic photoconductor according to claim 2, wherein the hardened material is prepared by polymerizing (A) the chain-polymerizable tertiary amine compound in which at least one alkyl group is bound to a nitrogen atom constituting an amine structure, (B) the chain-polymerizable charge transporting compound, and (C) a trifunctional or more chain-polymerizable compound through chain polymerization.

4. The electrophotographic photoconductor according to claim 3, wherein the hardened material is prepared by polymerizing (A) the chain-polymerizable tertiary amine compound in which at least one alkyl group is bound to a nitrogen atom constituting an amine structure, (B) the chain-polymerizable charge transporting compound, (C) the trifunctional or more chain-polymerizable compound and (D) a photopolymerization initiator through chain polymerization.

5. The electrophotographic photoconductor according to claim 2, wherein (B) the chain-polymerizable charge transporting compound is a compound represented by the following Structural Formula (i), Structural Formula (i)

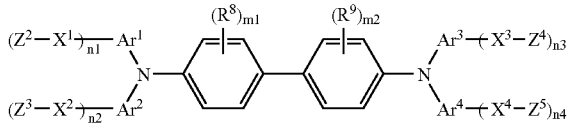

where $Ar^1$ to $Ar^4$ may be same to each other or different from each other and respectively represent any one of an alkylene group that may have a substituent group and an allylene group that may have a substituent group; $R^8$ and $R^9$ respectively represent any one of an alkyl group, an alkoxy group, and a halogen atom; $X^1$ to $X^4$ respectively represent an oxygen atom, a sulfur atom, an alkylene group that may have a substituent group, an allylene group that may have a substituent group, and a divalent group that is a combination thereof;

$Z^2$ to $Z^5$ respectively represent a chain-polymerizable functional group; m1 and m2 are respectively an integer of 0 to 4; n1 to n4 are respectively an integer of 0 to 5, and at least one of them is an integer of 1 or more.

6. The electrophotographic photoconductor according to claim 5, wherein (B) the chain-polymerizable charge transporting compound is a compound represented by the following Structural Formula (ii), Structural Formula (ii)

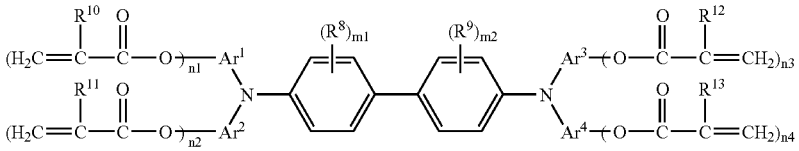

where $Ar^1$ to $Ar^4$, $R^8$ to $R^9$, m1 and m2, and n1 to n4 respectively represent the same meanings as those described in the Structural Formula (i); and $R^1$ to $R^3$ respectively represent any one of a methyl group and a hydrogen atom.

7. The electrophotographic photoconductor according to claim 1, wherein the tertiary amine compound composed of the (A) component is a chain-polymerizable group-containing tertiary amine compound in which two or more alkyl groups are bound to a nitrogen atom constituting an amine structure.

8. The electrophotographic photoconductor according to claim 1, wherein the layer containing the hardened material constitutes the outermost surface layer of the electrophotographic photoconductor.

9. The electrophotographic photoconductor according to claim 8, further comprising a substrate, and at least a photosensitive layer on the substrate, wherein the photosensitive layer constitutes the outermost surface layer of the electrophotographic photoconductor.

10. The electrophotographic photoconductor according to claim 8, further comprising at least a charge generating layer and a charge transporting layer formed in this order on the substrate, wherein the charge transporting layer constitutes the outermost surface layer of the electrophotographic photoconductor.

11. The electrophotographic photoconductor according to claim 8, further comprising a protective layer, wherein the protective layer constitutes the outermost layer of the electrophotographic photoconductor.

12. An image forming apparatus, comprising:

an electrophotographic photoconductor, a latent electrostatic image forming unit having a charger configured to charge the surface of the electrophotographic photoconductor and an exposer configured to expose the charged electrophotographic photoconductor surface to form a latent electrostatic image on the electrophotographic photoconductor surface, a developing unit configured to develop the latent electrostatic image using a toner to form a visible image, a transferring unit configured to transfer the visible image onto a recording medium, and a fixing unit configured to fix the transferred image on the recording medium, wherein the electrophotographic photoconductor comprises a layer containing a hardened material prepared by polymerizing (A) a chain-polymerizable group-containing tertiary amine compound in which at least one alkyl group is bound to a nitrogen atom constituting an amine structure through chain polymerization;

wherein the chain-polymerizable group-containing tertiary amine compound in which at least one alkyl group is bound to a nitrogen atom constituting an amine structure is a compound represented by any one of the Structural Formulas (2) and (2'), Structural Formula (2)

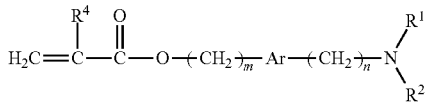

Structural Formula (2')

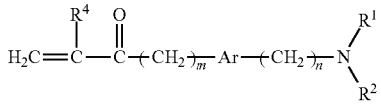

where $R^1$ and $R^2$ may be same to each other or different from each other and respectively represent any one of an alkyl group that may have a substituent group, an aromatic hydrocarbon group that may have a substituent group, a group represented by the following Structural Formula (1-1), and a group represented by the following Structural Formula (1-2), Structural Formula (1-1)

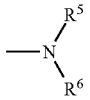

Structural Formula (1-2)

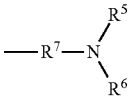

$R^1$ and $R^2$ may be bound together to form a heterocyclic ring, and the heterocyclic ring may be further substituted by a substituent group; $R^4$ represents any one of a hydrogen atom and a methyl group; Ar represents an aromatic hydrocarbon divalent group that may have a substituent group; "m" and "n" are respectively an integer of 0 to 6, and when "n" is equal to zero, any one of $R^1$ and $R^2$ represents the alkyl group that may have a substituent group or the group represented by the Structural Formula (1-2), where $R^5$ and $R^6$ may be same to each other or different from each other and respectively represent any one of an alkyl group that may have a substituent group and an aromatic hydrocarbon group that may have a substituent group; and $R^7$ represents any one of an alkylene group that may have a substituent group, an aromatic hydrocarbon divalent group that may have a substituent group, and a divalent group that is a combination thereof.

13. The image forming apparatus according to claim 12, wherein the exposer is an exposer based on a digital method.

14. A process cartridge, comprising:

an electrophotographic photoconductor, and at least one selected from a charger configured to charge the surface of the electrophotographic photoconductor, an exposer configured to expose the charged electrophotographic photoconductor surface to form a latent electrostatic image on the electrophotographic photoconductor, a developing unit configured to develop the latent electrostatic image formed on the electrophotographic photoconductor using a toner to form a visible image, a transferring unit, a cleaning unit, and a charge-eliminating unit, wherein the electrophotographic photoconductor comprises a layer containing a hardened material prepared by polymerizing (A) a chain-polymerizable group-containing tertiary amine compound in which at least one alkyl group is bound to a nitrogen atom constituting an amine structure through chain polymerization;

wherein the chain-polymerizable group-containing tertiary amine compound in which at least one alkyl group is bound to a nitrogen atom constituting an amine structure is a compound represented by any one of the Structural Formulas (2) and (2'), Structural Formula (2)

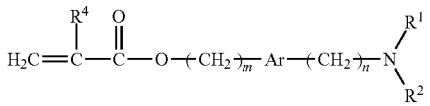

Structural Formula (2')

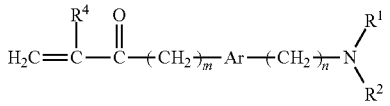

where $R^1$ and $R^2$ may be same to each other or different from each other and respectively represent any one of an alkyl group that may have a substituent group, an aromatic hydrocarbon group that may have a substituent group, a group represented by the following Structural Formula (1-1), and a group represented by the following Structural Formula (1-2), Structural Formula (1-1)

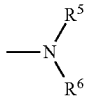

Structural Formula (1-2)

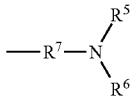

$R^1$ and $R^2$ may be bound together to form a heterocyclic ring, and the heterocyclic ring may be further substituted by a substituent group; $R^4$ represents any one of a hydrogen atom and a methyl group; Ar represents an aromatic hydrocarbon divalent group that may have a substituent group; "m" and "n" are respectively an integer of 0 to 6, and when "n" is equal to zero, any one of $R^1$ and $R^2$ represents the alkyl group that may have a substituent group or the group represented by the Structural Formula (1-2), where $R^5$ and $R^6$ may be same to each other or different from each other and respectively represent any one of an alkyl group that may have a substituent group and an aromatic hydrocarbon group that may have a substituent group; and $R^7$ represents any one of an alkylene group that may have a substituent group, an aromatic hydrocarbon divalent group that may have a substituent group, and a divalent group that is a combination thereof.

* * * * *